US011668442B2

(12) United States Patent
McRae

(10) Patent No.: US 11,668,442 B2
(45) **Date of Patent: *Jun. 6, 2023**

(54) MULTI-COLOR FLAT ROPE LIGHT STRING SYSTEM

(71) Applicant: National Christmas Products LLC, Cranford, NJ (US)

(72) Inventor: Michael M. McRae, Ormond Beach, FL (US)

(73) Assignee: NATIONAL CHRISTMAS PRODUCTS LLC, Cranford, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/480,260

(22) Filed: Sep. 21, 2021

(65) Prior Publication Data

US 2022/0003365 A1 Jan. 6, 2022

Related U.S. Application Data

(63) Continuation-in-part of application No. 16/852,828, filed on Apr. 20, 2020, now Pat. No. 11,129,255, which is a continuation-in-part of application No. 16/588,537, filed on Sep. 30, 2019, now Pat. No. 10,631,386.

(51) Int. Cl.

| | |
|---|---|
| ***H05B 45/20*** | (2020.01) |
| ***F21S 4/26*** | (2016.01) |
| ***F21V 23/00*** | (2015.01) |
| *F21Y 113/13* | (2016.01) |
| *F21Y 115/10* | (2016.01) |
| *F21W 121/04* | (2006.01) |

(52) U.S. Cl.
CPC ..... *F21S 4/26* (2016.01); *F21V 23/005* (2013.01); *F21W 2121/04* (2013.01); *F21Y 2113/13* (2016.08); *F21Y 2115/10* (2016.08)

(58) Field of Classification Search
CPC ..... H05B 45/20; H05B 45/37; H05B 45/50; H05B 45/382; F21S 4/10; F21S 23/04
See application file for complete search history.

(56) References Cited

U.S. PATENT DOCUMENTS

| | | | | |
|---|---|---|---|---|
| 7,859,196 | B2 * | 12/2010 | Lee | H05B 45/3578 315/300 |
| 9,609,709 | B2 * | 3/2017 | Keller | H05B 45/30 |
| 2012/0299480 | A1 * | 11/2012 | Peting | H05B 47/185 315/185 R |
| 2015/0102731 | A1 * | 4/2015 | Altamura | A47G 33/0836 315/152 |

* cited by examiner

*Primary Examiner* — Tung X Le
(74) *Attorney, Agent, or Firm* — Ellenoff Grossman & Schole LLP; Stephen L. Keefe

(57) ABSTRACT

A lighting system is disclosed. The lighting system has a plurality of lighting assemblies; a first controller coupled to a power source at a first connection and at least one of the plurality of lighting assemblies at a second connection, each of said plurality of lighting assemblies including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions.

20 Claims, 76 Drawing Sheets

COLOR ASSIGNMENT/ PAIRINGS

| ROW | LED IDENTIFIER | BULB IDENTIFIER | BULB COLOR | COLOR PAIRINGS |
|---|---|---|---|---|
| 1 | A | BULB1 | WHITE | WHITE/RED |
| 2 | B | BULB1 | RED | |
| 3 | C | BULB2 | WHITE | WHITE/GREEN |
| 4 | D | BULB2 | GREEN | |
| 5 | E | BULB3 | WHITE | WHITE/YELLOW |
| 6 | F | BULB3 | YELLOW | |
| 7 | G | BULB4 | WHITE | WHITE/BLUE |
| 8 | H | BULB4 | BLUE | |

FIG. 1E

COLOR OUTPUT

| ROW | CONTROLLER SWITCH POSITION | OUTPUT LEADS ENERGIZED AND DC POLARITY | RESULTING ILLUMINATION | EVENT/ HOLIDAY |
|---|---|---|---|---|
| 1 | FIRST SWITCH POSITION | OUTPUT LEAD 131-FIRST DC PHASE (+) LEAD 133-COMMON RETURN | LED "A" =WHITE<br>LED "C" =WHITE<br>LED "E" =WHITE<br>LED "G" =WHITE | EVERYDAY, CHRISTMAS |
| 2 | SECOND SWITCH POSITION | OUTPUT LEAD 131-SECOND DC PHASE(-) LEAD 133-COMMON RETURN | LED "B" =RED<br>LED "D" =GREEN<br>LED "F" =YELLOW<br>LED "H" =BLUE | CHRISTMAS |
| 3 | THIRD SWITCH POSITION | ALT 120 Hz BETWEEN<br>OUTPUT LEAD 131-FIRST DC PHASE(+)<br>&<br>OUTPUT LEAD 131-SECOND DC PHASE(-)<br>LEAD 131- COMMON REUTRN | LED (C&D)= ALT (WHITE & GREEN= LIGHT GREEN ILLUMINATION<br>LEDS (E&F) =ALT (WHITE & YELLOW = LIGHT YELLOW ILLUMINATION<br>LEDS (G&H =ALT (WHITE & BLUE = LIGHT BLUE ILLUMINATION | EASTER |

FIG. 1F

COLOR ASSISGNMENTS/ PAIRINGS

| ROW | LED IDENTIFIER | SET IDENTIFIER | BULB IDENTIFIER | BULB COLOR | COLOR PAIRINGS |
|---|---|---|---|---|---|
| 1 | A | 231-A | BULB 1 | ORANGE | ORANGE/ WHITE |
| 2 | B | 231-A | BULB 1 | WHITE | |
| 3 | C | 231-A | BULB 2 | GREEN | GREEN/ BLUE |
| 4 | D | 231-A | BULB 2 | BLUE | |
| 5 | E | 231-A | BULB 3 | PURPLE | PURPLE/ RED |
| 6 | F | 231-A | BULB 3 | RED | |
| | | | | | |
| 7 | A | 231-B | BULB 1 | ORANGE | ORANGE/ WHITE |
| 8 | B | 231-B | BULB 1 | WHITE | |
| 9 | C | 231-B | BULB 2 | GREEN | GREEN/ BLUE |
| 10 | D | 231-B | BULB 2 | BLUE | |
| 11 | E | 231-B | BULB 3 | PURPLE | PURPLE/ RED |
| 12 | F | 231-B | BULB 3 | RED | |
| | | | | | |
| 13 | A | 231-C | BULB 1 | ORANGE | ORANGE/ WHITE |
| 14 | B | 231-C | BULB 1 | WHITE | |
| 15 | C | 231-C | BULB 2 | GREEN | GREEN/ BLUE |
| 16 | D | 231-C | BULB 2 | BLUE | |
| 17 | E | 231-C | BULB 3 | PURPLE | PURPLE/ RED |
| 18 | F | 231-C | BULB 3 | RED | |
| | | | | | |
| 19 | A | 231-D | BULB 1 | ORANGE | ORANGE/ WHITE |
| 20 | B | 231-D | BULB 1 | WHITE | |
| 21 | C | 231-D | BULB 2 | GREEN | GREEN/ BLUE |
| 22 | D | 231-D | BULB 2 | BLUE | |
| 23 | E | 231-D | BULB 3 | PURPLE | PURPLE/ RED |
| 24 | F | 231-D | BULB 3 | RED | |
| | | | | | |
| 25 | A | 231-E | BULB 1 | ORANGE | ORANGE/ WHITE |
| 26 | B | 231-E | BULB 1 | WHITE | |
| 27 | C | 231-E | BULB 2 | GREEN | GREEN/ BLUE |
| 28 | D | 231-E | BULB 2 | BLUE | |
| 29 | E | 231-E | BULB 3 | PURPLE | PURPLE/ RED |
| 30 | F | 231-E | BULB 3 | RED | |

FIG. 2D

COLOR ASSISGNMENTS/ PAIRINGS

| ROW | LED IDENTIFIER | SET IDENTIFIER | BULB IDENTIFIER | BULB COLOR | COLOR PAIRINGS |
|---|---|---|---|---|---|
| 31 | A | 231-F | BULB 1 | ORANGE | ORANGE/ WHITE |
| 32 | B | 231-F | BULB 1 | WHITE | |
| 33 | C | 231-F | BULB 2 | GREEN | GREEN/ BLUE |
| 34 | D | 231-F | BULB 2 | BLUE | |
| 35 | E | 231-F | BULB 3 | PURPLE | PURPLE/ RED |
| 36 | F | 231-F | BULB 3 | RED | |
| | | | | | |
| 37 | A | 231-G | BULB 1 | ORANGE | ORANGE/ WHITE |
| 38 | B | 231-G | BULB 1 | WHITE | |
| 39 | C | 231-G | BULB 2 | GREEN | GREEN/ BLUE |
| 40 | D | 231-G | BULB 2 | BLUE | |
| 41 | E | 231-G | BULB 3 | PURPLE | PURPLE/ RED |
| 42 | F | 231-G | BULB 3 | RED | |
| | | | | | |
| 43 | A | 231-H | BULB 1 | ORANGE | ORANGE/ WHITE |
| 44 | B | 231-H | BULB 1 | WHITE | |
| 45 | C | 231-H | BULB 2 | GREEN | GREEN/ BLUE |
| 46 | D | 231-H | BULB 2 | BLUE | |
| 47 | E | 231-H | BULB 3 | PURPLE | PURPLE/ RED |
| 48 | F | 231-H | BULB 3 | RED | |

FIG. 2D
(CONTINUED)

COLOR OUTPUT

| ROW | CONTROLLER SWITCH POSITION | OUTPUT LEADS ENERGIZED AND DC PHASE | RESULTING ILLUMINATION | HOLIDAY |
|---|---|---|---|---|
| 1 | FIRST SWITCH DC PHASE (+) | OUTPUT LEAD #236 POSITIVE DC POLARITY (+) | ORANGE | CHRISTMAS |
| 2 | SECOND SWITCH POSITION | OUTPUT LEAD #236 NEGATIVE DC POLARITY (-) | WHITE | EVERYDAY,CHRISTMAS |
| 3 | THIRD SWITCH POSITION | OUTPUT LEAD #234 POSITIVE POLARITY (+) | GREEN | CHRISTMAS |
| 4 | FOURTH SWITCH POSITION | OUTPUT LEAD #234 NEGATIVE DC POLARITY (-) | BLUE | CHRISTMAS |
| 5 | FIFTH SWITCH POSITION | OUTPUT LEAD #235 POSITIVE DC POLARITY (+) | PURPLE | CHRISTMAS |
| 6 | SIXTH SWITCH POSITION | OUTPUT LEAD #235 NEGATIVE DC POLARITY (-) | RED | CHRISTMAS |
| 7 | SEVENTH SWITCH POSITION | OUTPUT LEADS 236, #234, #235 ALL NEGATIVE DC POLARITY (-) | RED, WHITE, BLUE | UNITED STATES NATIONAL HOLIDAYS |
| 8 | EIGHTH SWITCH POSITION | OUTPUT LEADS , #235, #236 ALL POSITIVE DC POLARITY (+) | ORANGE, PURPLE | MARDI GRAF/ HALLOWEEN |

FIG. 2E

| ROW | CONTROLLER SWITCH POSITION | OUTPUT LEADS ENERGIZED AND DC POLARITY | RESULTING ILLUMINATION | HOLIDAY |
|---|---|---|---|---|
| ° | ° | ° | ° | ° |
| 9 | NINTH SWITCH POSITION | OUTPUT #236(-) AND 235 (-) | RED, WHITE | CHRISTMAS, VALENTINE |
| 10 | TENTH SWITCH POSITION | ALTERNATING - LEAD 236, NEGATIVE DC POLARITY WITH LEAD 234, POSITIVE DC POLARITY - ALTERNATING EACH LEAD TO BE ON FOR 1 SECOND | WHITE, GREEN | CHRISTMAS, ST. PATS |
| 11 | ELEVENTH SWITCH POSITION | LEADS #236(-),#234(+),#235(-) | WHITE, GREEN, RED | CHRISTMAS, ITALIAN, MEXICAN NATIONAL HOLIDAYS |
| 12 | TWELFTH SWITCH POSITION | ALTERNATING (LEAD 236, (POSITIVE DC POLARITY), (LEAD 234, (POSITIVE DC POLARITY), (LEAD 235, (NEGATIVE DC POLARITY), (LEAD 234, (NEGATIVE DC POLARITY), | ORANGE, GREEN, RED, BLUE | CHRISTMAS |

FIG. 2E
(CONTINUED)

COLOR ASSIGNMENT/ PAIRINGS

| ROW | LED IDENTIFIER | BULB COLOR | COLOR PAIRINGS |
|---|---|---|---|
| 1 | A | WHITE | WHITE/ YELLOW |
| 2 | B | YELLOW | |
| 3 | C | ORANGE | ORANGE/ WHITE |
| 4 | D | WHITE | |
| 5 | E | WHITE | WHITE/ BLUE |
| 6 | F | BLUE | |
| 7 | G | PURPLE | PURPLE/ RED |
| 8 | H | RED | |
| 9 | I | WHITE | WHITE/ RED |
| 10 | J | RED | |
| 11 | K | GREEN | GREEN/ WHITE |
| 12 | L | WHITE | |
| 13 | M | WHITE | WHITE/ GREEN |
| 14 | N | GREEN | |
| 15 | O | PURPLE | PURPLE/ WHITE |
| 16 | P | BLUE | |

COLOR OUTPUT

| ROW | CONTROLLER SWITCH POSITION | OUTPUT LEADS ENERGIZED AND DC PASE | RESULTING ILLUMUNATION | EVENT/ HOLIDAY |
|---|---|---|---|---|
| 1 | FIRST SWITCH POSITION | OUTPUT LEAD #324 POSITIVE DC POLARITY (+) | LED "A" = WHITE<br>LED "E" = WHITE<br>LED "I" = WHITE<br>LED "M" = WHITE | EVERYDAY, CHRISTMAS |
| 2 | SECOND SWITCH POSITION | OUTPUT LEAD #324 POSITIVE DC POLARITY (+) | LED "B" = YELLOW<br>LED "F" = BLUE<br>LED "J" = RED<br>LED "N" = GREEN | CHRISTMAS |
| 3 | THIRD SWITCH POSITION | OUTPUT LEAD #322 POSITIVE DC POLARITY (+) | LED "C" = ORANGE<br>LED "G" = PURPLE<br>LED "K" = GREEN<br>LED "O" = PURPLE | HALLOWEEN, MARDI GRAS |
| 4 | FOURTH SWITCH POSITION | OUTPUT LEAD #322 POSITIVE DC POLARITY (+) | LED "D" = WHITE<br>LED "H" = RED<br>LED "L" = WHITE<br>LED "P" = BLUE | NATIONAL HOLIDAYS, EVENTS |
| 5 | FIFTH SWITCH POSITION | ALT 120 Hz OUTPUT LEAD #324 POSITIVE DC POLARITY (+) &OUTPUT LEAD #324 NEGATIVE DC POLARITY (-) | PASTELS - LT YELLOW, LT - BLUE, PINK, LT - GREEN | EASTER |
| 6 | SIXTH SWITCH POSITION | ALT 120 HZ OUTPUT LEAD #324 POSITIVE DC ENEGRY (+) AND OUTPUT LEAD #324 (-) ALT < 60 Hz FLASH | WHITE/ MUTLICOLOR OR ( YELLOW, BLUE, RED, GREEN | CHRISTMAS |

FIG. 3D

COLOR ASSIGNMENT/ PAIRINGS

| ROW | LED IDENTIFIER | SET IDENTIFIER | BULB COLOR | BULB PAIRINGS |
|---|---|---|---|---|
| 1 | A | 431-A | WHITE | WHITE/ RED |
| 2 | B | 431-A | RED | |
| 3 | C | 431-A | WHITE | WHITE/ RED |
| 4 | D | 431-A | RED | |
| 5 | E | 431-A | PURPLE | PURPLE/ RED |
| 6 | F | 431-A | RED | |
| 7 | G | 431-A | RED | RED/ GREEN |
| 8 | H | 431-A | GREEN | |
| | | | | |
| 9 | A | 431-B | WHITE | WHITE/ GREEN |
| 10 | B | 431-B | GREEN | |
| 11 | C | 431-B | GREEN | GREEN/ WHITE |
| 12 | D | 431-B | WHITE | |
| 13 | E | 431-B | ORANGE | ORANGE/ WHITE |
| 14 | F | 431-B | WHITE | |
| 15 | G | 431-B | WHITE | WHITE/ RED |
| 16 | H | 431-B | RED | |
| | | | | |
| 17 | A | 431-C | WHITE | WHITE/ YELLOW |
| 18 | B | 431-C | YELLOW | |
| 19 | C | 431-C | WHITE | WHITE/ GREEN |
| 20 | D | 431-C | GREEN | |
| 21 | E | 431-C | PURPLE | PURPLE/ RED |
| 22 | F | 431-C | RED | |
| 23 | G | 431-C | BLUE | BLUE/ GREEN |
| 24 | H | 431-C | GREEN | |
| | | | | |
| 25 | A | 431-D | WHITE | WHITE/ BLUE |
| 26 | B | 431-D | BLUE | |
| 27 | C | 431-D | GREEN | GREEN/ WHITE |
| 28 | D | 431-D | WHITE | |
| 29 | E | 431-D | GREEN | GREEN/ WHITE |
| 30 | F | 431-D | WHITE | |
| 31 | G | 431-D | WHITE | WHITE/ RED |
| 32 | H | 431-D | RED | |

FIG. 4D

COLOR ASSIGNMENT/ PAIRINGS

| ROW | LED IDENTIFIER | SET IDENTIFIER | BULB COLOR | BULB PAIRINGS |
|---|---|---|---|---|
| 33 | A | 431-E | WHITE | WHITE/ RED |
| 34 | B | 431-E | RED | |
| 35 | C | 431-E | WHITE | WHITE/ RED |
| 36 | D | 431-E | RED | |
| 37 | E | 431-E | PURPLE | PURPLE/ RED |
| 38 | F | 431-E | RED | |
| 39 | G | 431-E | RED | RED/ GREEN |
| 40 | H | 431-E | GREEN | |
| | | | | |
| 41 | A | 431-F | WHITE | WHITE/ GREEN |
| 42 | B | 431-F | GREEN | |
| 43 | C | 431-F | GREEN | GREEN/ WHITE |
| 44 | D | 431-F | WHITE | |
| 45 | E | 431-F | ORANGE | ORANGE/ WHITE |
| 46 | F | 431-F | WHITE | |
| 47 | G | 431-F | WHITE | WHITE/ RED |
| 48 | H | 431-F | RED | |
| | | | | |
| 49 | A | 431-G | WHITE | WHITE/ YELLOW |
| 50 | B | 431-G | YELLOW | |
| 51 | C | 431-G | WHITE | WHITE/ GREEN |
| 52 | D | 431-G | GREEN | |
| 53 | E | 431-G | PURPLE | PURPLE/ RED |
| 54 | F | 431-G | RED | |
| 55 | G | 431-G | BLUE | BLUE/ GREEN |
| 56 | H | 431-G | GREEN | |
| | | | | |
| 57 | A | 431-H | WHITE | WHITE/ BLUE |
| 58 | B | 431-H | BLUE | |
| 59 | C | 431-H | GREEN | GREEN/ WHITE |
| 60 | D | 431-H | WHITE | |
| 61 | E | 431-H | GREEN | GREEN/ WHITE |
| 62 | F | 431-H | WHITE | |
| 63 | G | 431-H | WHITE | WHITE/ RED |
| 64 | H | 431-H | RED | |

FIG. 4D
(CONTINUED)

COLOR OUTPUT

| ROW | CONTROLLER SWITCH POSITION | OUTPUT LEADS ENERGIZED AND DC POLARITY | RESULTING ILLUMINATION | EVENT/ HOLIDAY |
|---|---|---|---|---|
| 1 | FIRST SWITCH POSITION | OUTPUT LEAD #413 POSITIVE DC POLARITY (+) | WHITE | EVERYDAY/ CHRISTMAS |
| 2 | SECOND SWITCH POSITION | OUTPUT LEAD #413 NEGATIVE DC POLARITY (-) | RED, GREEN, YELLOW, BLUE | CHRISTMAS |
| 3 | THIRD SWITCH POSITION | OUTPUT LEAD #411 POSITIVE DC POLARITY (+) | WHITE, GREEN | CHRISTMAS/ ST.PATS |
| 4 | FOURTH SWITCH POSITION | OUTPUT LEAD #411 NEGATIVE DC POLARITY (-) | RED, WHITE, GREEN, WHITE | CHRISTMAS/ ITALIAN/ MEXICAN/ HOLIDAY |
| 5 | FIFTH SWITCH POSITION | OUTPUT LEAD #409 POSITIVE DC POLARITY (+) | PURPLE, ORANGE, PURPLE, GREEN | MARDI/ GRAS |
| 6 | SIXTH SWITCH POSITION | OUTPUT LEAD #409 NEGATIVE DC POLARITY (-) | RED, WHITE, RED, WHITE | CHRISTMAS/ VALENTINES DAY |
| 7 | SEVENTH SWITCH POSITION | OUTPUT LEAD #407 POSITIVE DC POLARITY(+) | RED,WHITE, BLUE | U.S. |
| 8 | EIGHTH SWITCH POSITION | OUTPUT LEAD #407 NEGATIVE DC POLARITY (-) | GREEN/ RED | CHRISTMAS |
| 9 | NINTH SWITCH POSITION | OUTPUT LEAD #413 ALT 120HZ BETWEEN POSITIVE DC (+) NEGATIVE DC POLARITY (+) | PINK, LT - BLUE, LT - GREEN, LT - YELLOW, BLUE | EASTER |

FIG. 4E

HOLIDAY DISPLAYS

L 1 POSITIVE (+)

| ROW | SERIES | BULBS | LEDs | COLOR |
|---|---|---|---|---|
| 1 | 1 | 1-7 | A,E,I,M,A,E,I | RED |
| | | 8 | M | WHITE |
| | 2 | 1-5 | A,E,I,M,A | WHITE |
| | | 6-8 | E,I,M | RED |
| | 3 | 1 | A | BLUE |
| | | 2-3 | E,I | RED |
| | | 4-8 | M,A,E,I,M | WHITE |
| | 4 | 1 | A | WHITE |
| | | 2-8 | E,I,M,A,E,I,M | RED |
| 2 | 1 | 1-7 | A,E,I,M,A,E,I | RED |
| | | 8 | M | WHITE |
| | 2 | 1-5 | A,E,I,M,A | WHITE |
| | | 6-8 | E,I,M | RED |
| | 3 | 1 | A | BLUE |
| | | 2-3 | E,I | RED |
| | | 4-8 | M,A,E,I,M | WHITE |
| | 4 | 1 | A | WHITE |
| | | 2-8 | E,I,M,A,E,I,M | RED |
| 3 | 1 | 1-7 | A,E,I,M,A,E,I | RED |
| | | 8 | M | WHITE |
| | 2 | 1-5 | A,E,I,M,A | WHITE |
| | | 6-7 | E,I | RED |
| | | 8 | M | BLUE |
| | 3 | 1-2 | A,E | BLUE |
| | | 3 | I | RED |
| | | 4-8 | M,A,E,I,M | WHITE |
| | 4 | 1 | A | WHITE |
| | | 2-8 | E,I,M,A,E,I,M | RED |
| 4 | 1 | 1-7 | A,E,I,M,A,E,I | RED |
| | | 8 | M | WHITE |
| | 2 | 1-5 | A,E,I,M,A | WHITE |
| | | 6-7 | E,I | RED |
| | | 8 | M | BLUE |
| | 3 | 1 | A,E | BLUE |
| | | 2-3 | I | RED |
| | | 4-8 | M,A,E,I,M | WHITE |
| | 4 | 1 | A | WHITE |
| | | 2-8 | E,I,M,A,E,I,M | RED |

4 DISPLAY OPTIONS

4TH OF JULY

| ROW | SERIES | BULBS | LEDs | COLOR |
|---|---|---|---|---|
| 5 | 1 | 1-7 | A,E,I,M,A,E,I | RED |
| | | 8 | M | WHITE |
| | 2 | 1-5 | A,E,I,M,A | WHITE |
| | | 6-7 | E,I | RED |
| | | 8 | M | BLUE |
| | 3 | 1 | A,E | BLUE |
| | | 2-3 | I | RED |
| | | 4-8 | M,A,E,I,M | WHITE |
| | 4 | 1 | A | WHITE |
| | | 2-8 | E,I,M,A,E,I,M | RED |
| 6 | 1 | 1-7 | A,E,I,M,A,E,I | RED |
| | | 8 | M | WHITE |
| | 2 | 1-5 | A,E,I,M,A | WHITE |
| | | 6 | E | RED |
| | | 7-8 | I,M | BLUE |
| | 3 | 1-3 | A,E,I | BLUE |
| | | 4-8 | M,A,E,I,M | WHITE |
| | 4 | 1 | A | WHITE |
| | | 2-8 | E,I,M,A,E,I,M | RED |
| 7 | 1 | 1-7 | A,E,I,M,A,E,I | RED |
| | | 8 | M | WHITE |
| | 2 | 1-5 | A,E,I,M,A | WHITE |
| | | 6 | E | RED |
| | | 7-8 | I,M | BLUE |
| | 3 | 1-3 | A,E,I | BLUE |
| | | 4-8 | M,A,E,I,M | WHITE |
| | 4 | 1 | A | WHITE |
| | | 2-8 | E,I,M,A,E,I,M | RED |
| 8 | 1 | 1-6 | A,E,I,M,A,E | RED |
| | | 7-8 | I,M | BLUE |
| | 2 | 1-8 | A,E,I,M,A,E,I,M | BLUE |
| | 3 | 1-8 | A,E,I,M,A,E,I,M | BLUE |
| | 4 | 1-2 | A,E | BLUE |
| | | 3-8 | I,M,A,E,I,M, | RED |

Fig. 34A

HOLIDAY DISPLAYS

L 1 POSITIVE (+)

| ROW | SERIES | BULBS | LEDs | COLOR |
|---|---|---|---|---|
| 9 | 1 | 1-7 | A,E,I,M,A,E,I | RED |
| | | 8 | M | BLUE |
| | 2 | 1-8 | A,E,I,M,A,E,I,M | BLUE |
| | 3 | 1-8 | A,E,I,M,A,E,I,M | BLUE |
| | 4 | 1 | A | BLUE |
| | | 2-8 | E,I,M,A,E,I,M, | RED |
| 10 | 1 | 1-7 | A,E,I,M,A,E,I | RED |
| | | 8 | M | WHITE |
| | 2 | 1 | A | WHITE |
| | | 2-8 | E,I,M,A,E,I,M | BLUE |
| | 3 | 1-7 | A,E,I,M,A,E,I | BLUE |
| | | 8 | M | WHITE |
| | 4 | 1 | A | WHITE |
| | | 2-8 | E,I,M,A,E,I,M, | RED |
| 11 | 1 | 1-7 | A,E,I,M,A,E,I | RED |
| | | 8 | M | WHITE |
| | 2 | 1-3 | A,E,I | WHITE |
| | | 4-8 | M,A,E,I,M | BLUE |
| | 3 | 1-6 | A,E,I,M,A,E | BLUE |
| | | 7-8 | I,M | WHITE |
| | 4 | 1 | A | WHITE |
| | | 2-8 | E,I,M,A,E,I,M, | RED |
| 12 | 1 | 1-7 | A,E,I,M,A,E,I | RED |
| | | 8 | M | WHITE |
| | 2 | 1-5 | A,E,I,M,A | WHITE |
| | | 6-8 | E,I,M | BLUE |
| | 3 | 1-4 | A,E,I,M | BLUE |
| | | 5-8 | A,M | WHITE |
| | 4 | 1 | A | WHITE |
| | | 2-8 | E,I,M,A,E,I,M, | RED |
| 13 | 1 | 1-7 | A,E,I,M,A,E,I | RED |
| | | 8 | M | WHITE |
| | 2 | 1-4 | A,E,I,M | WHITE |
| | | 5-8 | A,E,I,M | BLUE |
| | 3 | 1-5 | A,E,I,M,A | BLUE |
| | | 6-8 | E,I,M | WHITE |
| | 4 | 1 | A | WHITE |
| | | 2-8 | E,I,M,A,E,I,M, | RED |

4 DISPLAY OPTIONS

4TH OF JULY

| ROW | SERIES | BULBS | LEDs | COLOR |
|---|---|---|---|---|
| 14 | 1 | 1-7 | A,E,I,M,A,E,I | RED |
| | | 8 | M | WHITE |
| | 2 | 1-4 | A,E,I,M | WHITE |
| | | 5-8 | A,E,I,M | BLUE |
| | 3 | 1-5 | A,E,I,M,A | BLUE |
| | | 6-8 | E,I,M | WHITE |
| | 4 | 1 | A | WHITE |
| | | 2-8 | E,I,M,A,E,I,M, | RED |
| 15 | 1 | 1-7 | A,E,I,M,A,E,I | RED |
| | | 8 | M | WHITE |
| | 2 | 1-3 | A,E,I | WHITE |
| | | 4-8 | M,A,E,I,M | BLUE |
| | 3 | 1 | A | WHITE |
| | | 2-6 | E,I,M,A,E, | BLUE |
| | | 7-8 | I,M | WHITE |
| | 4 | 1 | A | WHITE |
| | | 2-8 | E,I,M,A,E,I,M, | RED |
| 16 | 1 | 1-7 | A,E,I,M,A,E,I | RED |
| | | 8 | M | WHITE |
| | 2 | 1-3 | A,E,I | WHITE |
| | | 4-7 | M,A,E,I | BLUE |
| | | 8 | M | WHITE |
| | 3 | 1-2 | A,E | WHITE |
| | | 3-6 | I,M,A,E, | BLUE |
| | | 7-8 | I,M | WHITE |
| | 4 | 1 | A | WHITE |
| | | 2-8 | E,I,M,A,E,I,M, | RED |
| 17 | 1 | 1-7 | A,E,I,M,A,E,I | RED |
| | | 8 | M | WHITE |
| | 2 | 1-3 | A,E,I | WHITE |
| | | 4-5 | M,A | BLUE |
| | | 6-8 | E,I,M | RED |
| | 3 | 1-3 | A,E,I | RED |
| | | 4 | M | WHITE |
| | | 5-6 | A,E, | BLUE |
| | | 7-8 | I,M | WHITE |
| | 4 | 1 | A | WHITE |
| | | 2-8 | E,I,M,A,E,I,M, | RED |

Fig. 34B

HOLIDAY DISPLAYS

L 1 POSITIVE (+)

| ROW | SERIES | BULBS | LEDs | COLOR |
|---|---|---|---|---|
| 18 | 1 | 1-7 | A,E,I,M,A,E,I | RED |
| | | 8 | M | WHITE |
| | 2 | 1-2 | A,E | WHITE |
| | | 3-4 | I,M | BLUE |
| | | 5 | A | WHITE |
| | | 6-8 | E,I,M | RED |
| | 3 | 1-3 | A,E,I | RED |
| | | 4-5 | M,A | WHITE |
| | | 6-7 | E,I | BLUE |
| | | 8 | M | WHITE |
| | 4 | 1 | A | WHITE |
| | | 2-8 | E,I,M,A,E,I,M, | RED |
| 19 | 1 | 1-7 | A,E,I,M,A,E,I | RED |
| | | 8 | M | WHITE |
| | 2 | 1-2 | A,E | WHITE |
| | | 3 | I | BLUE |
| | | 4-5 | M,A | WHITE |
| | | 6-8 | E,I,M | RED |
| | 3 | 1-3 | A,E,I | RED |
| | | 4-6 | M,A,E | WHITE |
| | | 7 | I | BLUE |
| | | 8 | M | WHITE |
| | 4 | 1 | A | WHITE |
| | | 2-8 | E,I,M,A,E,I,M, | RED |
| 20 | 1 | 1-7 | A,E,I,M,A,E,I | RED |
| | | 8 | M | WHITE |
| | 2 | 1-5 | A,E,I,M,A | WHITE |
| | | 6-8 | E,I,M | RED |
| | 3 | 1-3 | A,E,I | RED |
| | | 4-8 | M,A,E,I,M | WHITE |
| | 4 | 1 | A | WHITE |
| | | 2-8 | E,I,M,A,E,I,M, | RED |

4 DISPLAY OPTIONS

4TH OF JULY

| ROW | SERIES | BULBS | LEDs | COLOR |
|---|---|---|---|---|
| 21 | 1 | 1-7 | A,E,I,M,A,E,I | RED |
| | | 8 | M | WHITE |
| | 2 | 1-5 | A,E,I,M,A | WHITE |
| | | 6-8 | E,I,M | RED |
| | 3 | 1-3 | A,E,I | RED |
| | | 4-8 | M,A,E,I,M | WHITE |
| | 4 | 1 | A | WHITE |
| | | 2-8 | E,I,M,A,E,I,M, | RED |
| 22 | 1 | 1-7 | A,E,I,M,A,E,I | RED |
| | | 8 | M | WHITE |
| | 2 | 1-5 | A,E,I,M,A | WHITE |
| | | 6-8 | E,I,M | RED |
| | 3 | 1-3 | A,E,I | RED |
| | | 4-8 | M,A,E,I,M | WHITE |
| | 4 | 1 | A | WHITE |
| | | 2-8 | E,I,M,A,E,I,M, | RED |
| 23 | 1 | 1-7 | A,E,I,M,A,E,I | RED |
| | | 8 | M | WHITE |
| | 2 | 1-5 | A,E,I,M,A | WHITE |
| | | 6-8 | E,I,M | RED |
| | 3 | 1-3 | A,E,I | RED |
| | | 4-8 | M,A,E,I,M | WHITE |
| | 4 | 1 | A | WHITE |
| | | 2-8 | E,I,M,A,E,I,M, | RED |
| 23 | 1 | 1-7 | A,E,I,M,A,E,I | RED |
| | | 8 | M | WHITE |
| | 2 | 1-5 | A,E,I,M,A | WHITE |
| | | 6-8 | E,I,M | RED |
| | 3 | 1-3 | A,E,I | RED |
| | | 4-8 | M,A,E,I,M | WHITE |
| | 4 | 1 | A | WHITE |
| | | 2-8 | E,I,M,A,E,I,M, | RED |

Fig. 34C

SPORTS AND HOLIDAY

L 1 POSITIVE (+)

| ROW | SERIES | BULBS | LEDs | COLOR |
|---|---|---|---|---|
| 1 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 2 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 3 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 4 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 5 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 6 | 1 | 1-8 | A,E,I,M,A,E,I,M | GREEN |
| | 2 | 1-4 | A,E,I,M | GREEN |
| | | 5-8 | A,E,I,M | WHITE |
| | 3 | 1-4 | A,E,I,M | WHITE |
| | | 5-8 | A,E,I,M | GREEN |
| | 4 | 1-8 | A,E,I,M,A,E,I,M | GREEN |
| 7 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I | WHITE |
| | | 6-8 | M,A,E,I,M | GREEN |
| | 4 | 1-8 | A,E,I,M,A,E,I,M | GREEN |
| 8 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I | WHITE |
| | | 6-8 | M,A,E,I,M | GREEN |
| | 4 | 1-8 | A,E,I,M,A,E,I,M | GREEN |

4 DISPLAY OPTIONS

MICHIGAN STATE

| ROW | SERIES | BULBS | LEDs | COLOR |
|---|---|---|---|---|
| 9 | 1 | 1-8 | A,E,I,M,A,E,I,M | GREEN |
| | 2 | 1-3 | A,E,I | GREEN |
| | | 4-7 | M,A,E,I | WHITE |
| | | 8 | M | GREEN |
| | 3 | 1 | A | GREEN |
| | | 2-5 | E,I,M,A | WHITE |
| | | 6-8 | E,I,M | GREEN |
| | 4 | 1-8 | A,E,I,M,A,E,I,M | GREEN |
| | | 4-8 | M,A,E,I,M | WHITE |
| 10 | 1 | 1-8 | A,E,I,M,A,E,I,M | WHITE |
| | 2 | 1-3 | A,E,I | GREEN |
| | | 4-7 | M,A,E,I | WHITE |
| | | 8 | M | GREEN |
| | 3 | 1-8 | A,E,I,M,A,E,I,M | GREEN |
| | 4 | 1-8 | A,E,I,M,A,E,I,M | GREEN |
| 11 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-3 | A,E,I | WHITE |
| | | 4-8 | M,A,E,I,M | GREEN |
| | 4 | 1-8 | A,E,I,M,A,E,I,M | GREEN |
| 12 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-4 | A,E,I,M | WHITE |
| | | 5-8 | A,E,I,M | GREEN |
| | 4 | 1-8 | A,E,I,M,A,E,I,M | GREEN |
| 13 | 1 | 1-8 | A,E,I,M,A,E,I,M | GREEN |
| | 2 | 1-4 | A,E,I,M | GREEN |
| | | 5-8 | A,E,I,M | WHITE |
| | 3 | 1-5 | A,E,I,M,A,E,I,M | WHITE |
| | | 4-8 | E,I,M | GREEN |
| | 4 | 1-8 | A,E,I,M,A,E,I,M | GREEN |
| 14 | 1 | 1-8 | A,E,I,M,A,E,I,M | GREEN |
| | 2 | 1-8 | A,E,I,M,A,E,I,M | GREEN |
| | 3 | 1 | A | GREEN |
| | | 2-5 | E,I,M,A | WHITE |
| | 4 | 6-8 | E,I,M | GREEN |

Fig. 35A

SPORTS AND HOLIDAY

L 1 POSITIVE (+)

| ROW | SERIES | BULBS | LEDs | COLOR |
|---|---|---|---|---|
| 15 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | GREEN |
| | 4 | 1-8 | A,E,I,M,A,E,I,M | GREEN |
| 16 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | GREEN |
| | 4 | 1-8 | A,E,I,M,A,E,I,M | GREEN |
| 17 | 1 | 1-8 | A,E,I,M,A,E,I,M | GREEN |
| | 2 | 1-4 | A,E,I,M | GREEN |
| | | 5-8 | A,E,I,M | WHITE |
| | 3 | 1-5 | A,E,I,M,A | WHITE |
| | | 6-8 | E,I,M | GREEN |
| | 4 | 1-8 | A,E,I,M,A,E,I,M | GREEN |
| 18 | 1 | 1-8 | A,E,I,M,A,E,I,M | GREEN |
| | 2 | 1-5 | A,E,I,M,A | GREEN |
| | | 6-8 | E,I,M | WHITE |
| | 3 | 1-4 | A,E,I,M | WHITE |
| | | 5-8 | A,E,I,M | GREEN |
| | 4 | 1-8 | A,E,I,M,A,E,I,M | GREEN |

4 DISPLAY OPTIONS

MICHIGAN STATE

| ROW | SERIES | BULBS | LEDs | COLOR |
|---|---|---|---|---|
| 19 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 20 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 21 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 22 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 23 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |
| 24 | 1 | 1-8 | A,E,I,M,A,E,I,M | GREEN |
| | 2 | 1-8 | A,E,I,M,A,E,I,M | GREEN |
| | 3 | 1-8 | A,E,I,M,A,E,I,M | GREEN |
| | 4 | 1-8 | A,E,I,M,A,E,I,M | GREEN |

Fig. 35B

SPORTS AND HOLIDAY

L 2 POSITIVE (+)

| ROW | SERIES | BULBS | LEDs | COLOR |
|---|---|---|---|---|
| 1 | 1 | 1-8 | B,F,J,N,B,F,J,N | YELLOW |
| | 2 | 1-8 | B,F,J,N,B,F,J,N | YELLOW |
| | 3 | 1-8 | B,F,J,N,B,F,J,N | YELLOW |
| | 4 | 1-8 | B,F,J,N,B,F,J,N | YELLOW |
| 2 | 1 | 1-8 | B,F,J,N,B,F,J,N | YELLOW |
| | 2 | 1-4 | B,F,J,N | YELLOW |
| | | 5-8 | B,F,J,N | RED |
| | 3 | 1-4 | B,F,J,N | RED |
| | | 5-8 | B,F,J,N | YELLOW |
| | 4 | 1-8 | B,F,J,N,B,F,J,N | YELLOW |
| 3 | 1 | 1-8 | B,F,J,N,B,F,J,N | YELLOW |
| | 2 | 1 | B | YELLOW |
| | | 2-4 | F,J,N | RED |
| | | 5-8 | B,F,J,N | YELLOW |
| | 3 | 1-3 | B,F,J | YELLOW |
| | | 4-6 | N,B,F | RED |
| | | 7-8 | J,N | YELLOW |
| | 4 | 1-8 | B,F,J,N,B,F,J,N | RED |
| 4 | 1 | 1-8 | B,F,J,N,B,F,J,N | YELLOW |
| | 2 | 1-2 | B,F | RED |
| | | 3 | J,N | YELLOW |
| | 3 | 4-8 | N,B,F,J,N | RED |
| | 4 | 1-8 | B,F,J,N,B,F,J,N | YELLOW |
| 5 | 1 | 1-7 | B,F,J,N,B,F,J,N | YELLOW |
| | | 8 | N | RED |
| | 2 | 1 | B | RED |
| | | 2 | F | YELLOW |
| | | 3-5 | J,N,B | RED |
| | | 6-8 | F,J,N | YELLOW |
| | 3 | 1-3 | B,F,J | RED |
| | | 4-8 | N,B,F,J,N | YELLOW |
| | 4 | 1-2 | B,F | RED |
| | | 3-8 | J,N,B,F,J,N | YELLOW |
| 6 | 1 | 1-6 | B,F,J,N,B,F | YELLOW |
| | | 7-8 | J,N | RED |
| | 2 | 1-2 | B,F | YELLOW |
| | | 3-4 | J,N | RED |
| | | 5-8 | B,F | YELLOW |
| | 3 | 1-8 | B,F,J,N,B,F,J,N | YELLOW |
| | 4 | 1 | B | YELLOW |
| | | 2-3 | F,J | RED |
| | | 4-8 | N,B,F,J,N | YELLOW |

4 DISPLAY OPTIONS

SAN FRANCISCO

| ROW | SERIES | BULBS | LEDs | COLOR |
|---|---|---|---|---|
| 7 | 1 | 1-5 | B,F,J,N,B | YELLOW |
| | | 6-7 | F,J | RED |
| | 4 | 8 | N | YELLOW |
| 8 | 1 | 1-4 | B,F,J,N | YELLOW |
| | | 5-6 | B,F | RED |
| | | 7-8 | J,N | YELLOW |
| | 2 | 1-4 | B,F,J,N | YELLOW |
| | | 5-8 | B,F,J,M | RED |
| | 3 | 1-3 | B,F,J | RED |
| | | 4-8 | N,B,F,J,N | YELLOW |
| | 4 | 1-3 | B,F,J | YELLOW |
| | | 4-5 | N,B | RED |
| | | 6-8 | F,J,N | YELLOW |
| 9 | 1 | 1-3 | B,F,J | YELLOW |
| | | 4-5 | N,B | RED |
| | | 6-8 | F,J,N | YELLOW |
| | 2 | 1-8 | B,F,J,N,B,F,J,N | YELLOW |
| | 3 | 1 | B | YELLOW |
| | | 2-3 | F,J | RED |
| | | 4-8 | N,B,F,J,N | YELLOW |
| | 4 | 1-4 | B,F,J,N | YELLOW |
| | | 5-6 | B,F | RED |
| | | 7-8 | J,N | YELLOW |
| 10 | 1 | 1-2 | B,F | YELLOW |
| | | 2-3 | J,N | RED |
| | | 4-8 | B,F,J,N | YELLOW |
| | 2 | 1-2 | B,F | YELLOW |
| | | 3-4 | J,N | RED |
| | | 5 | B | YELLOW |
| | | 6-8 | F,J | RED |
| | 3 | 1-6 | B,F,J,N,B,F | RED |
| | | 7-8 | J,N | YELLOW |
| | 4 | 1-5 | B,F,J,N,B | YELLOW |
| | | 6-7 | F,J | RED |
| | | 8 | N | YELLOW |

Fig. 36A

SPORTS AND HOLIDAY

L 2 POSITIVE (+)

| ROW | SERIES | BULBS | LEDs | COLOR |
|---|---|---|---|---|
| 11 | 1 | 1-2 | B,F | YELLOW |
| | | 3-5 | J,N,B | RED |
| | | 6-8 | F,J,N | YELLOW |
| | 2 | 1-2 | B,F | YELLOW |
| | | 3-8 | J,N,B,F,J,N | RED |
| | | 1 | B | YELLOW |
| | | 2 | F | RED |
| | | 3-4 | J,N | YELLOW |
| | | 5-6 | B,F | RED |
| | | 7-8 | J,N | YELLOW |
| | 3 | 1-4 | B,F,J,N | YELLOW |
| | | 5-6 | B,F | RED |
| | | 7-8 | J,N | YELLOW |
| | 4 | 1-4 | B,F,J,N | YELLOW |
| | | 5-6 | B,F | RED |
| | | 7-8 | J,N | YELLOW |
| 12 | 1 | 1-4 | B,F,J,N | YELLOW |
| | | 5-6 | B,F | RED |
| | | 7-8 | J,N | YELLOW |
| | 2 | 1-6 | B,F,J,N,B,F | YELLOW |
| | | 7-8 | J,N | RED |
| | 3 | 1 | B | RED |
| | | 2-3 | F,J | YELLOW |
| | | 4-5 | N,B | RED |
| | | 6-8 | F,J,N | YELLOW |
| | 4 | 1-3 | B,F,J | YELLOW |
| | | 4-5 | M,B | RED |
| | | 6-8 | J,N | YELLOW |
| 13 | 1 | 1-5 | B,F,J,N,B | YELLOW |
| | | 6-7 | F,J | RED |
| | | 8 | N,B | YELLOW |
| | 2 | 1-6 | B,F,J,N,B,F | YELLOW |
| | | 7-8 | J,N | RED |
| | 3 | 1-5 | B,F,J,N,B | RED |
| | | 6-8 | F,J,N | YELLOW |
| | 4 | 1-2 | B,F | YELLOW |
| | | 3-4 | J,N | RED |
| | | 5-8 | B,F,J,N | YELLOW |

4 DISPLAY OPTIONS

SAN FRANCISCO

| ROW | SERIES | BULBS | LEDs | COLOR |
|---|---|---|---|---|
| 14 | 1 | 1-6 | B,F,J,N,B,F | YELLOW |
| | | 7-8 | J,N | RED |
| | 2 | 1-6 | B,F,J,N,B,F | YELLOW |
| | | 7-8 | J,N | RED |
| | 3 | 1-3 | B,F,J | YELLOW |
| | | 4-5 | M,B | RED |
| | | 6-8 | F,J,N | YELLOW |
| | 4 | 1 | B | YELLOW |
| | | 2-3 | J,F | RED |
| | | 4-8 | N,D,F,J,N | YELLOW |
| 15 | 1 | 1-7 | B,F,J,N,B,F,J | YELLOW |
| | | 8 | N | RED |
| | 2 | 1 | B | RED |
| | | 2-6 | J,N,B,F,J,N | YELLOW |
| | | 7-8 | J,N | RED |
| | 3 | 1-8 | B,F,J,N,B,F,J,N | YELLOW |
| | 4 | 1-2 | B,F | RED |
| | | 3-8 | J,N,B,F,J,N | YELLOW |
| 16 | 1 | 1-8 | B,F,J,N,B,F,J,N | YELLOW |
| | | 1-2 | B,F | RED |
| | | 3-5 | J,N,B,F,J,N | YELLOW |
| | | 6-8 | J,N,B,F,J,N | RED |
| | 2 | 1 | B | RED |
| | | 2-7 | F,J,N,B,F,J | YELLOW |
| | | 8 | N | RED |
| | 3 | 1 | B | RED |
| | | 2-7 | F,J,N,B,F,J | YELLOW |
| | | 8 | N | RED |
| | 4 | 1 | B | RED |
| | | 2-8 | J,N,B,F,J,N | YELLOW |
| 17 | 1 | 1-8 | B,F,J,N,B,F,J,N | YELLOW |
| | 2 | 1 | B | YELLOW |
| | | 2-3 | F,J,N | RED |
| | | 4 | N | YELLOW |
| | | 5-8 | B,F,J,N | RED |
| | 3 | 1-2 | B,F | RED |
| | | 3-6 | J,N,B,F | YELLOW |
| | | 7-8 | J,N | RED |
| | 4 | 1-8 | B,F,J,N,B,F,J,N | YELLOW |

Fig. 36B

SPORTS AND HOLIDAY

L 2 POSITIVE (+)

| ROW | SERIES | BULBS | LEDs | COLOR |
|---|---|---|---|---|
| 18 | 1 | 1-8 | B,F,J,N,B,F,J,N | YELLOW |
| | | 1-2 | B,F | YELLOW |
| | | 3-4 | J,N | RED |
| | | 5-8 | B,F,J,N | YELLOW |
| | 2 | 1-4 | B,F,J,N | YELLOW |
| | | 5-8 | B,F,J,N | RED |
| | 3 | 1-4 | B,F,J,N | YELLOW |
| | | 5-6 | B,F | RED |
| | | 7-8 | J,N | YELLOW |
| | 4 | 1-8 | B,F,J,N,B,F,J,N | YELLOW |
| 19 | 1 | 1-8 | B,F,J,N,B,F,J,N | YELLOW |
| | 2 | 1-3 | B,F,J | YELLOW |
| | | 4-5 | N,B | RED |
| | | 6-8 | F,J,N | YELLOW |
| | 3 | 1-3 | B,F,J | YELLOW |
| | | 4-5 | N,B | RED |
| | | 6-8 | F,J,N | YELLOW |
| | 4 | 1-8 | B,F,J,N,B,F,J,N | YELLOW |
| 20 | 1 | 1-8 | B,F,J,N,B,F,J,N | YELLOW |
| | 2 | 1-8 | B,F,J,N,B,F,J,N | YELLOW |
| | 3 | 1-8 | B,F,J,N,B,F,J,N | YELLOW |
| | 4 | 1-8 | B,F,J,N,B,F,J,N | YELLOW |

4 DISPLAY OPTIONS

SAN FRANCISCO

| ROW | SERIES | BULBS | LEDs | COLOR |
|---|---|---|---|---|
| 21 | 1 | 1-8 | B,F,J,N,B,F,J,N | YELLOW |
| | 2 | 1-8 | B,F,J,N,B,F,J,N | YELLOW |
| | 3 | 1-8 | B,F,J,N,B,F,J,N | YELLOW |
| | 4 | 1-8 | B,F,J,N,B,F,J,N | YELLOW |
| 22 | 1 | 1-8 | B,F,J,N,B,F,J,N | YELLOW |
| | 2 | 1-8 | B,F,J,N,B,F,J,N | YELLOW |
| | 3 | 1-8 | B,F,J,N,B,F,J,N | YELLOW |
| | 4 | 1-8 | B,F,J,N,B,F,J,N | YELLOW |
| 23 | 1 | 1-8 | B,F,J,N,B,F,J,N | YELLOW |
| | 2 | 1-8 | B,F,J,N,B,F,J,N | YELLOW |
| | 3 | 1-8 | B,F,J,N,B,F,J,N | YELLOW |
| | 4 | 1-8 | B,F,J,N,B,F,J,N | YELLOW |
| 24 | 1 | 1-8 | B,F,J,N,B,F,J,N | YELLOW |
| | 2 | 1-8 | B,F,J,N,B,F,J,N | YELLOW |
| | 3 | 1-8 | B,F,J,N,B,F,J,N | YELLOW |
| | 4 | 1-8 | B,F,J,N,B,F,J,N | YELLOW |

Fig. 36C

HOLIDAY DISPLAYS

L 1 NEGATIVE (-)

| ROW | SERIES | BULBS | LEDs | COLOR |
|---|---|---|---|---|
| 1 | 1 | 1-8 | B,F,J,N,B,F,J,N | WHITE |
| | 2 | 1-8 | B,F,J,N,B,F,J,N | WHITE |
| | 3 | 1-8 | B,F,J,N,B,F,J,N | WHITE |
| | 4 | 1-8 | B,F,J,N,B,F,J,N | WHITE |
| 2 | 1 | 1-8 | B,F,J,N,B,F,J,N | WHITE |
| | 2 | 1-8 | B,F,J,N,B,F,J,N | WHITE |
| | 3 | 1-8 | B,F,J,N,B,F,J,N | WHITE |
| | 4 | 1-8 | B,F,J,N,B,F,J,N | WHITE |
| 3 | 1 | 1-8 | B,F,J,N,B,F,J,N | WHITE |
| | 2 | 1-5 | B,F,J,N,B | RED |
| | | 6-8 | F,J,N | WHITE |
| | 3 | 1-3 | B,F,J | WHITE |
| | | 4-8 | N,B,F,J,N | RED |
| | 4 | 1 | B | RED |
| | | 2-8 | F,J,N,B,F,J,N | WHITE |
| 4 | 1 | 1-7 | B,F,J,N,B,F,J,N | WHITE |
| | | 8 | N | RED |
| | 2 | 1-7 | B,F,J,N,B,F,J | WHITE |
| | | 8 | N | RED |
| | 3 | 1 | B | WHITE |
| | | 2-8 | F,J,N,B,F,J,N | RED |
| | 4 | 1 | B | RED |
| | | 2-8 | F,J,N,B,F,J,N | WHITE |
| 5 | 1 | 1-6 | B,F,J,N,B,F | WHITE |
| | | 7-8 | J,N, | RED |
| | 2 | 1-8 | B,F,J,N,B,F,J,N | RED |
| | 3 | 1-8 | B,F,J,N,B,F,J,N | RED |
| | 4 | 1-2 | B,F | RED |
| | | 3-8 | J,N,B,F,J,N | WHITE |
| 6 | 1 | 1-6 | B,F,J,N,B,F | WHITE |
| | | 7-8 | J,N | RED |
| | 2 | 1-8 | B,F,J,N,B,F,J,N | RED |
| | 3 | 1-8 | B,F,J,N,B,F,J,N | RED |
| | 4 | 1-3 | B,F,J | RED |
| | | 4-8 | N,B,F,J,N | WHITE |
| 7 | 1 | 1-5 | B,F,J,N,B | RED |
| | 2 | 6-8 | F,J,N | RED |
| | 3 | 1-8 | B,F,J,N,B,F,J,N | RED |
| | 4 | 1-3 | B,F,J | RED |
| | | 4-8 | N,B,F,J,N | WHITE |

4 DISPLAY OPTIONS

VALENTINES DAY

| ROW | SERIES | BULBS | LEDs | COLOR |
|---|---|---|---|---|
| 8 | 1 | 1-5 | B,F,J,N | WHITE |
| | | 6-8 | F,J,N | RED |
| | 2 | 1-8 | B,F,J,N,B,F,J,N | RED |
| | 3 | 1-8 | B,F,J,N,B,F,J,N | RED |
| | 4 | 1-3 | B,F,J | RED |
| | | 4-8 | N,B,F,J,N | WHITE |
| 9 | 1 | 1-5 | B,F,J,N,B | WHITE |
| | | 6-8 | F,J,N | RED |
| | 2 | 1-8 | B,F,J,N,B,F,J,N | RED |
| | 3 | 1-8 | B,F,J,N,B,F,J,N | RED |
| | 4 | 1-3 | B,F,J | RED |
| | | 4-8 | N,B,F,J,N | WHITE |
| 10 | 1 | 1-5 | B,F,J,N,B | WHITE |
| | | 6-8 | F,J,N | RED |
| | 2 | 1-8 | B,F,J,N,B,F,J,N | RED |
| | 3 | 1-8 | B,F,J,N,B,F,J,N | RED |
| | 4 | 1-3 | B,F,J | RED |
| | | 4-8 | N,B,F,J,N | WHITE |
| 11 | 1 | 1-5 | B,F,J,N,B | WHITE |
| | | 6-8 | F,J,N | RED |
| | 2 | 1-8 | B,F,J,N,B,F,J,N | RED |
| | 3 | 1-8 | B,F,J,N,B,F,J,N | RED |
| | 4 | 1-3 | B,F,J | RED |
| | | 4-8 | N,B,F,J,N | WHITE |
| 12 | 1 | 1-6 | B,F,J,N,B,F | WHITE |
| | | 7-8 | J,N | RED |
| | 2 | 1-8 | B,F,J,N,B,F,J,N | RED |
| | 3 | 1-8 | B,F,J,N,B,F,J,N | RED |
| | 4 | 1-3 | B,F,J | RED |
| | | 4-8 | N,B,F,J,N | WHITE |
| 13 | 1 | 1-7 | B,F,J,N,B,F,J | WHITE |
| | | 8 | N | RED |
| | 2 | 1-8 | B,F,J,N,B,F,J,N | RED |
| | 3 | 1-8 | B,F,J,N,B,F,J,N | RED |
| | 4 | 1-2 | A,E | RED |
| | | 3-8 | I,M,A,E,I,M | WHITE |
| 14 | 1 | 1-8 | B,F,J,N,B,F,J,N | WHITE |
| | 2 | 1-8 | B,F,J,N,B,F,J,N | RED |
| | 3 | 1-8 | B,F,J,N,B,F,J,N | RED |
| | 4 | 1 | B | RED |
| | | 2-8 | F,J,N,B,F,J,N | WHITE |

Fig. 37A

HOLIDAY DISPLAYS

L 1 NEGATIVE (-)

| ROW | SERIES | BULBS | LEDs | COLOR |
|---|---|---|---|---|
| 15 | 1 | 1-8 | B,F,J,N,B,F,J,N | WHITE |
| | 2 | 1 | B | WHITE |
| | | 2-8 | F,J,N,B,F,J,N | RED |
| | 3 | 1-8 | B,F,J,N,B,F,J,N | RED |
| | 4 | 1 | B | RED |
| | | 2-8 | F,J,N,B,F,J,N | WHITE |
| 16 | 1 | 1-8 | B,F,J,N,B,F,J,N | WHITE |
| | 2 | 1-2 | B,F | WHITE |
| | | 3-8 | J,N,B,F,J,N | RED |
| | 3 | 1-7 | B,F,J,N,B,F,J | RED |
| | | 8 | N | WHITE |
| | 4 | 1-8 | B,F,J,N,B,F,J,N | WHITE |
| 17 | 1 | 1-8 | B,F,J,N,B,F,J,N | WHITE |
| | 2 | 1-3 | B,F,J | WHITE |
| | | 4-8 | N,B,F,J,N | RED |
| | 3 | 1-6 | B,F,J,N,B,F | RED |
| | | 7-8 | J,N | WHITE |
| | 4 | 1-8 | B,F,J,N,B,F,J,N | WHITE |
| 18 | 1 | 1-8 | B,F,J,N,B,F,J,N | WHITE |
| | 2 | 1-4 | B,F,J,N | WHITE |
| | | 5-8 | B,F,J,N | RED |
| | 3 | 1-5 | B,F,J,N,B | RED |
| | | 6-8 | F,J,N,B,F,J,N | WHITE |
| | 4 | 1-8 | B,F,J,N,B,F,J,N | WHITE |
| 19 | 1 | 1-8 | B,F,J,N,B,F,J,N | WHITE |
| | 2 | 1-5 | B,F,J,N,B | WHITE |
| | | 6-8 | F,J,N | RED |
| | 3 | 1-4 | B,F,J,N | RED |
| | | 5-8 | B,F,J,N | WHITE |
| | 4 | 1-8 | B,F,J,N,B,F,J,N | WHITE |

4 DISPLAY OPTIONS

VALENTINES DAY

| ROW | SERIES | BULBS | LEDs | COLOR |
|---|---|---|---|---|
| 20 | 1 | 1-8 | B,F,J,N,B,F,J,N | WHITE |
| | 2 | 1-6 | B,F,J,N,B,F | WHITE |
| | | 7-8 | J,N | RED |
| | 3 | 1-5 | B,F,J,N,B | RED |
| | | 6-8 | F,J,N | WHITE |
| | 4 | 1-8 | B,F,J,N,B,F,J,N | WHITE |
| 21 | 1 | 1-8 | B,F,J,N,B,F,J,N | WHITE |
| | 2 | 1-7 | A,E,I,M,A,E,I | WHITE |
| | | 8 | N | RED |
| | 3 | 1-2 | B,F | RED |
| | | 3-8 | J,N,B,F,J,N | WHITE |
| | 4 | 1-8 | B,F,J,N,B,F,J,N | WHITE |
| 22 | 1 | 1-8 | B,F,J,N,B,F,J,N | WHITE |
| | 2 | 1-8 | B,F,J,N,B,F,J,N | WHITE |
| | 3 | 1 | A | RED |
| | | 2-8 | E,I,M,A,E,I,M | WHITE |
| | 4 | 1-8 | B,F,J,N,B,F,J,N | WHITE |
| 23 | 1 | 1-8 | B,F,J,N,B,F,J,N | WHITE |
| | 2 | 1-8 | B,F,J,N,B,F,J,N | WHITE |
| | 3 | 1-8 | B,F,J,N,B,F,J,N | WHITE |
| | 4 | 1-8 | B,F,J,N,B,F,J,N | WHITE |
| 24 | 1 | 1-8 | B,F,J,N,B,F,J,N | WHITE |
| | 2 | 1-8 | B,F,J,N,B,F,J,N | WHITE |
| | 3 | 1-8 | B,F,J,N,B,F,J,N | WHITE |
| | 4 | 1-8 | B,F,J,N,B,F,J,N | WHITE |

Fig. 37B

HOLIDAY DISPLAYS

L2 POSITIVE (+)

| ROW | SERIES | BULBS | LEDs | COLOR |
|---|---|---|---|---|
| 1 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 2 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 3 | 1 | 1-8 | C,G,K,O,C,G,K,O | GREEN |
| | 2 | 1-7 | C,G,K,O,C,G,K | GREEN |
| | | 8 | O | RED |
| | 3 | 1 | C | RED |
| | | 2-8 | G,K,O,C,G,K,O | GREEN |
| | 4 | 1-8 | C,G,K,O,C,G,K,O | GREEN |
| 4 | 1 | 1-8 | C,G,K,O,C,G,K,O | GREEN |
| | 2 | 1-6 | C,G,K,O,C,G | GREEN |
| | | 7-8 | K,O | RED |
| | 3 | 1-2 | C,G | RED |
| | | 3-8 | K,O,C,G,K,O | GREEN |
| | 4 | 1-8 | C,G,K,O,C,G,K,O | GREEN |
| 5 | 1 | 1-8 | C,G,K,O,C,G,K,O | GREEN |
| | 2 | 1-4 | C,G,K,O | GREEN |
| | | 5-8 | C,G,K,O | RED |
| | 3 | 1-3 | C,G,J | RED |
| | | 4-8 | O,C,G,K,O | GREEN |
| | 4 | 1-8 | C,G,K,O,C,G,K,O | GREEN |
| 6 | 1 | 1-8 | C,G,K,O,C,G,K,O | GREEN |
| | 2 | 1-3 | C,G,K | GREEN |
| | | 4-8 | O,C,G,K,O | RED |
| | 3 | 1-4 | C,G,K,O | RED |
| | | 5-8 | C,G,K,O | GREEN |
| | 4 | 1-8 | C,G,K,O,C,G,K,O | GREEN |
| 7 | 1 | 1-8 | C,G,K,O,C,G,K,O | GREEN |
| | 2 | 1-3 | C,G,J | GREEN |
| | | 4-8 | O,C,G,K,O | RED |
| | 3 | 1-4 | C,G,K,O | RED |
| | | 5-8 | C,G,K,O | GREEN |
| | 4 | 1-8 | C,G,K,O,C,G,K,O | GREEN |

4 DISPLAY OPTIONS

Christmas

| ROW | SERIES | BULBS | LEDs | COLOR |
|---|---|---|---|---|
| 8 | 1 | 1-8 | C,G,K,O,C,G,K,O | GREEN |
| | 2 | 1-2 | C,G | GREEN |
| | | 3-8 | K,O,C,G,K,O | RED |
| | 3 | 1-5 | C,G,K,O,C | RED |
| | | 6-8 | G,K,O | GREEN |
| | 4 | 1-8 | C,G,K,O,C,G,K,O | GREEN |
| 9 | 1 | 1-8 | C,G,K,O,C,G,K,O | GREEN |
| | 2 | 1-2 | C,G | GREEN |
| | | 3-8 | K,O,C,G,K,O | RED |
| | 3 | 1-5 | C,G,K,O,C | RED |
| | | 6-8 | G,K,O | GREEN |
| | 4 | 1-8 | C,G,K,O,C,G,K,O | GREEN |
| 10 | 1 | 1-8 | C,G,K,O,C,G,K,O | GREEN |
| | 2 | 1-2 | C,G | GREEN |
| | | 3-8 | K,O,C,G,K,O, | RED |
| | 3 | 1-5 | C,G,K,O,C | RED |
| | | 6-8 | G,K,O | GREEN |
| | 4 | 1-8 | C,G,K,O,C,G,K,O | GREEN |
| 11 | 1 | 1-8 | C,G,K,O,C,G,K,O | GREEN |
| | 2 | 1-2 | C,G | GREEN |
| | | 3-8 | K,O,C,G,K,O | RED |
| | 3 | 1-5 | C,G,K,O,C | RED |
| | | 6-8 | G,K,O | GREEN |
| | 4 | 1-8 | C,G,K,O,C,G,K,O | GREEN |
| 12 | 1 | 1-8 | C,G,K,O,C,G,K,O | GREEN |
| | 2 | 1-2 | C,G | GREEN |
| | | 3-8 | K,O,C,G,K,O | RED |
| | 3 | 1-5 | C,G,K,O,C | RED |
| | | 6-8 | G,K,O | GREEN |
| | 4 | 1-8 | C,G,K,O,C,G,K,O | GREEN |
| 13 | 1 | 1-8 | C,G,K,O,C,G,K,O | GREEN |
| | 2 | 1-2 | C,G | GREEN |
| | | 3-8 | K,O,C,G,K,O | RED |
| | 3 | 1-5 | C,G,K,O,C | RED |
| | | 6-8 | G,K,O | GREEN |
| | 4 | 1-8 | C,G,K,O,C,G,K,O | GREEN |
| 14 | 1 | 1-8 | C,G,K,O,C,G,K,O | GREEN |
| | 2 | 1-2 | C,G | GREEN |
| | | 3-8 | K,O,C,G,K,O | RED |
| | 3 | 1-5 | C,G,K,O,C | RED |
| | | 6-8 | G,K,O | GREEN |
| | 4 | 1-8 | C,G,K,O,C,G,K,O | GREEN |

Fig. 38A

HOLIDAY DISPLAYS

L2 POSITIVE (+)

| ROW | SERIES | BULBS | LEDs | COLOR |
|---|---|---|---|---|
| 15 | 1 | 1-8 | C,G,K,O,C,G,K,O | GREEN |
| | 2 | 1-2 | C,G | GREEN |
| | | 3-8 | K,O,C,G,K,O | RED |
| | 3 | 1-5 | C,G,K,O,C | RED |
| | | 6-8 | G,K,O | GREEN |
| | 4 | 1-8 | C,G,K,O,C,G,K,O | GREEN |
| 16 | 1 | 1-8 | C,G,K,O,C,G,K,O | GREEN |
| | 2 | 1 | C | GREEN |
| | | 2-8 | G,K,O,C,G,K,O | RED |
| | 3 | 1-6 | C,G,K,O,C,G | RED |
| | | 7-8 | K,O | GREEN |
| | 4 | 1-8 | C,G,K,O,C,G,K,O | GREEN |
| 17 | 1 | 1-8 | C,G,K,O,C,G,K,O | GREEN |
| | 2 | 1 | C | GREEN |
| | | 2-8 | G,K,O,C,G,K,O | RED |
| | 3 | 1-6 | C,G,K,O,C,G | RED |
| | | 7-8 | K,O | GREEN |
| | 4 | 1-8 | C,G,K,O,C,G,K,O | GREEN |
| 18 | 1 | 1-8 | C,G,K,O,C,G,K,O | GREEN |
| | 2 | 1 | C | GREEN |
| | | 2-8 | G,K,O,C,G,K,O | RED |
| | 3 | 1-6 | C,G,K,O,C,G | RED |
| | | 7-8 | K,O | GREEN |
| | 4 | 1-8 | C,G,K,O,C,G,K,O | GREEN |
| 19 | 1 | 1-8 | C,G,K,O,C,G,K,O | GREEN |
| | 2 | 1-8 | C,G,K,O,C,G,K,O | RED |
| | 3 | 1-7 | C,G,K,O,C,G,K | RED |
| | | 8 | O | GREEN |
| | 4 | 1-8 | C,G,K,O,C,G,K,O | GREEN |

4 DISPLAY OPTIONS

CHRISTMAS

| ROW | SERIES | BULBS | LEDs | COLOR |
|---|---|---|---|---|
| 20 | 1 | 1-7 | C,G,K,O,C,G,K | GREEN |
| | | 8 | O | RED |
| | 2 | 1-8 | C,G,K,O,C,G,K,O | RED |
| | 3 | 1-8 | C,G,K,O,C,G,K,O | RED |
| | 4 | 1-8 | C,G,K,O,C,G,K,O | GREEN |
| 21 | 1 | 1-6 | C,G,K,O,C,G | GREEN |
| | | 7-8 | K,O | RED |
| | 2 | 1-8 | C,G,K,O,C,G,K,O | RED |
| | 3 | 1-8 | C,G,K,O,C,G,K,O | RED |
| | 4 | 1 | C | RED |
| | | 7-8 | G,K,O,C,G,K,O | GREEN |
| 22 | 1 | 1-5 | C,G,K,O,C | GREEN |
| | | 6-8 | G,K,O | RED |
| | 2 | 1-8 | C,G,K,O,C,G,K,O | RED |
| | 3 | 1-8 | C,G,K,O,C,G,K,O | RED |
| | 4 | 1-6 | C,G | RED |
| | | 7-8 | K,O,C,G,K,O | GREEN |
| 23 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 24 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |

Fig. 38B

HOLIDAY DISPLAYS

L2 NEGATIVE (-)

| ROW | SERIES | BULBS | LEDs | COLOR |
|---|---|---|---|---|
| 1 | 1 | 1-8 | D,H,L,P,D,H,L,P | YELLOW |
| | 2 | 1-8 | D,H,L,P,D,H,L,P | YELLOW |
| | 3 | 1-8 | D,H,L,P,D,H,L,P | YELLOW |
| | 4 | 1-8 | D,H,L,P,D,H,L,P | YELLOW |
| 2 | 1 | 1-8 | D,H,L,P,D,H,L,P | YELLOW |
| | 2 | 1-8 | D,H,L,P,D,H,L,P | YELLOW |
| | 3 | 1-8 | D,H,L,P,D,H,L,P | YELLOW |
| | 4 | 1-8 | D,H,L,P,D,H,L,P | YELLOW |
| 3 | 1 | 1-8 | D,H,L,P,D,H,L,P | YELLOW |
| | 2 | 1-3 | D,H,L | YELLOW |
| | | 4-6 | P,D,H | GREEN |
| | | 7-8 | L,P | YELLOW |
| | 3 | 1 | D | YELLOW |
| | | 2-4 | H,L,P | GREEN |
| | | 5-8 | D,H,L,P, | YELLOW |
| | 4 | 1-8 | D,H,L,P,D,H,L,P | YELLOW |
| 4 | 1 | 1-8 | D,H,L,P,D,H,L,P | YELLOW |
| | 2 | 1 | D | GREEN |
| | | 2-8 | H,L,P,D,H,L,P | GREEN |
| | 3 | 1-5 | D,H,L,P,D | GREEN |
| | | 6-8 | H,L,P | YELLOW |
| | 4 | 1-8 | D,H,L,P,D,H,L,P | YELLOW |
| 5 | 1 | 1-8 | D,H,L,P,D,H,L,P | YELLOW |
| | 2 | 1 | D | YELLOW |
| | | 2-8 | H,L,P,D,H,L,P | GREEN |
| | 3 | 1-6 | D,H,L,P,D,H | GREEN |
| | | 7-8 | L,P | YELLOW |
| | 4 | 1-8 | D,H,L,P,D,H,L,P | YELLOW |
| 6 | 1 | 1-8 | D,H,L,P,D,H,L,P | YELLOW |
| | 2 | 1 | D | YELLOW |
| | | 2-4 | H,L,P | GREEN |
| | | 5-8 | D,H,L,P | YELLOW |
| | 3 | 1-3 | D,H,L | YELLOW |
| | | 4-7 | P,D,H,L | GREEN |
| | | 8 | P | YELLOW |
| | 4 | 1-8 | D,H,L,P,D,H,L,P | YELLOW |
| 7 | 1 | 1-8 | D,H,L,P,D,H,L,P | YELLOW |
| | 2 | 1 | D | YELLOW |
| | | 2-4 | H,L,P | GREEN |
| | | 5-8 | D,H,L,P | YELLOW |
| | 3 | 1-3 | D,H,L | YELLOW |
| | | 4-7 | P,D,H,L | GREEN |
| | | 8 | P | YELLOW |
| | 4 | 1-8 | D,H,L,P,D,H,L,P | YELLOW |

4 DISPLAY OPTIONS

ST. PATRICK'S DAY

| ROW | SERIES | BULBS | LEDs | COLOR |
|---|---|---|---|---|
| 8 | 1 | 1-8 | D,H,L,P,D,H,L,P | YELLOW |
| | 2 | 1-2 | D,H | YELLOW |
| | | 3-4 | L,P | GREEN |
| | | 5-8 | D,H,L,P | YELLOW |
| | 3 | 1-3 | D,H,L | YELLOW |
| | | 4-6 | P,D,H | GREEN |
| | | 7-8 | L,P, | YELLOW |
| | 4 | 1-8 | D,H,L,P,D,H,L,P | YELLOW |
| 9 | 1 | 1-7 | D,H,L,P,D,H,L | YELLOW |
| | | 8 | P | GREEN |
| | 2 | 1-4 | D,H,L,P | GREEN |
| | | 5-8 | D,H,L,P | YELLOW |
| | 3 | 1-4 | D,H,L,P | YELLOW |
| | | 5-6 | D,H | GREEN |
| | | 7 | L | YELLOW |
| | | 8 | P | GREEN |
| | 4 | 1-8 | D,H,L,P,D,H,L,P | YELLOW |
| 10 | 1 | 1-6 | D,H,L,P,D,H | YELLOW |
| | | 7-8 | L,P | GREEN |
| | 2 | 1-3 | D,H,L | GREEN |
| | | 4-8 | P,D,H,L,P | YELLOW |
| | 3 | 1-4 | D,H,L,P | YELLOW |
| | | 5-8 | D,H,L,P | GREEN |
| | 4 | 1 | D | GREEN |
| | | 2-8 | H,L,P,D,H,L,P | YELLOW |
| 11 | 1 | 1-4 | D,H,L,P | YELLOW |
| | | 5-8 | D,H,L,P | GREEN |
| | 2 | 1-2 | D,H | GREEN |
| | | 3-8 | L,P,D,H,L,P | YELLOW |
| | 3 | 1-4 | D,H,L,P | YELLOW |
| | | 5-8 | D,H,L,P | GREEN |
| | 4 | 1-3 | D,H,L | GREEN |
| | | 4-8 | P,D,H,L,P | YELLOW |
| 12 | 1 | 1-4 | D,H,L,P | YELLOW |
| | | 5-8 | D,H,L,P | GREEN |
| | 2 | 1 | D | GREEN |
| | | 2-8 | H,L,P,D,H,L,P | YELLOW |
| | 3 | 1-5 | D,H,L,P,D | YELLOW |
| | | 6-8 | H,L,P | GREEN |
| | 4 | 1-2 | D,H | GREEN |
| | | 3-8 | L,P,D,H,L,P | YELLOW |

Fig. 39A

HOLIDAY DISPLAYS

L2 NEGATIVE (-)

| ROW | SERIES | BULBS | LEDs | COLOR |
|---|---|---|---|---|
| 13 | 1 | 1-4 | D,H,L,P | YELLOW |
| | | 5-8 | D,H,L,P | GREEN |
| | 2 | 1 | D | GREEN |
| | | 2-8 | H,L,P,D,H,L,P | YELLOW |
| | 3 | 1-8 | D,H,L,P,D,H,L,P | YELLOW |
| | 4 | 1-3 | D,H,L | GREEN |
| | | 4-8 | L,P,D,H,L,P | YELLOW |
| 14 | 1 | 1-5 | D,H,L,P,D | YELLOW |
| | | 6-8 | H,L | GREEN |
| | 2 | 1-2 | D,H | GREEN |
| | | 3-8 | L,P,D,H,L,P | YELLOW |
| | 3 | 1-8 | D,H,L,P,D,H,L,P | YELLOW |
| | 4 | 1-3 | D,H,L | GREEN |
| | | 4-8 | P,D,H,L,P | YELLOW |
| 15 | 1 | 1-6 | D,H,L,P,D,H | YELLOW |
| | | 7-8 | L,P | GREEN |
| | 2 | 1-3 | D,H,L | GREEN |
| | | 4-8 | P,D,H,L,P | YELLOW |
| | 3 | 1-7 | D,H,P,L,D,H,L | YELLOW |
| | | 8 | P | GREEN |
| | 4 | 1-3 | D,H,L | GREEN |
| | | 4-8 | P,D,H,L,P | YELLOW |
| 16 | 1 | 1-7 | D,H,L,P,D,L | YELLOW |
| | | 8 | P | GREEN |
| | 2 | 1-3 | D,H,L | GREEN |
| | | 4-6 | P,D,H | YELLOW |
| | | 7-8 | L,P | GREEN |
| | 3 | 1-3 | D,H,L | GREEN |
| | | 4-6 | P,D,H | YELLOW |
| | | 7-8 | L,P | GREEN |
| | 4 | 1 | D | GREEN |
| | | 2-8 | H,L,P,D,H,L,P | YELLOW |
| 17 | 1 | 1-6 | D,H,L,P,D,H | YELLOW |
| | | 7-8 | L,P | GREEN |
| | 2 | 1-3 | D,H,L | GREEN |
| | | 4-5 | P,D | YELLOW |
| | | 6-8 | H,L,P | GREEN |
| | 3 | 1-4 | D,H,L,P | GREEN |
| | | 5-6 | D,H | YELLOW |
| | | 7-8 | L,P | GREEN |
| | 4 | 1-2 | D,H | GREEN |
| | | 3-8 | L,P,D,P,L,P | YELLOW |

4 DISPLAY OPTIONS

ST. PATRICK'S DAY

| ROW | SERIES | BULBS | LEDs | COLOR |
|---|---|---|---|---|
| 18 | 1 | 1-6 | D,H,L,P,D,H | YELLOW |
| | | 7-8 | L,P | GREEN |
| | 2 | 1-8 | D,H,L,P,D,H,L,P | GREEN |
| | 3 | 1-8 | D,H,L,P,D,H,L,P | GREEN |
| | 4 | 1-2 | D,H | GREEN |
| | | 3-8 | L,P,D,H,LP, | YELLOW |
| 19 | 1 | 1-5 | D,H,L,P,D | YELLOW |
| | | 6-8 | H,L,P | GREEN |
| | 2 | 1-6 | D,H,L,P,D,H | GREEN |
| | | 7 | L | YELLOW |
| | | 8 | P | GREEN |
| | 3 | 1-8 | D,H,L,P,D,H,L,P | GREEN |
| | 4 | 1-2 | D,L | GREEN |
| | | 3-8 | H,L,P,D,H,L,P | YELLOW |
| 20 | 1 | 1-8 | D,H,L,P,D,H,L,P | YELLOW |
| | 2 | 1-4 | D,H,L,P | GREEN |
| | | 5-7 | D,H,L | YELLOW |
| | | 8 | P | GREEN |
| | 3 | 1 | D | GREEN |
| | | 2-3 | H,L | YELLOW |
| | | 4-8 | P,D,H,L,P | GREEN |
| | 4 | 1-8 | D,H,L,P,D,H,L,P | YELLOW |
| 21 | 1 | 1-8 | D,H,L,P,D,H,L,P | YELLOW |
| | 2 | 1-6 | D,H,L,P,D,H | YELLOW |
| | | 7-8 | L,P | GREEN |
| | 3 | 1 | D | GREEN |
| | | 2-5 | D,H,L,P,D | YELLOW |
| | | 6 | H | GREEN |
| | | 7-8 | L,P | YELLOW |
| | 4 | 1-8 | D,H,L,P,D,H,L,P | YELLOW |
| 22 | 1 | 1-8 | D,H,L,P,D,H,L,P | YELLOW |
| | | 1-6 | D,H,L,P,D,H | YELLOW |
| | | 7-8 | L,P | GREEN |
| | 2 | 1-5 | D,H,L,P,D | YELLOW |
| | | 6-8 | L,P,D,H,L,P | GREEN |
| | 3 | 1-8 | D,H,L,P,D,H,L,P | YELLOW |
| | 4 | 1-8 | D,H,L,P,D,H,L,P | YELLOW |
| 23 | 1 | 1-8 | D,H,L,P,D,H,L,P | YELLOW |
| AND | 2 | 1-8 | D,H,L,P,D,H,L,P | YELLOW |
| 24 | 3 | 1-8 | D,H,L,P,D,H,L,P | YELLOW |
| | 4 | 1-8 | D,H,L,P,D,H,L,P | YELLOW |

Fig. 39B

NATIONAL FLAGS

L 1 POSITIVE (+)

| ROW | SERIES | BULBS | LEDs | COLOR |
|---|---|---|---|---|
| 1 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 2 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 3 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 4 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 5 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 6 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 7 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |

4 DISPLAY OPTIONS

ITALIAN FLAG

| ROW | SERIES | BULBS | LEDs | COLOR |
|---|---|---|---|---|
| 8 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 9 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 10 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 11 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 12 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 13 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 14 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |

Fig. 40A

NATIONAL FLAGS

L 1 POSITIVE (+)

| ROW | SERIES | BULBS | LEDs | COLOR |
|---|---|---|---|---|
| 15 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 16 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 17 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 18 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 19 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |

4 DISPLAY OPTIONS

ITALIAN FLAG

| ROW | SERIES | BULBS | LEDs | COLOR |
|---|---|---|---|---|
| 20 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 21 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 22 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 23 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |
| 24 | 1 | 1-8 | A,E,I,M,A,E,I,M | GREEN |
| | 2 | 1-3 | A,E,I | GREEN |
| | | 4-8 | M,A,E,I,M | WHITE |
| | 3 | 1-5 | A,E,I,M,A | WHITE |
| | | 6-8 | E,I,M | RED |
| | 4 | 1-8 | A,E,I,M,A,E,I,M | RED |

Fig. 40B

FLAGS DISPLAYS

L 1 NEGATIVE (-)

| ROW | SERIES | BULBS | LEDs | COLOR |
|---|---|---|---|---|
| 1 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 2 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 3 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 4 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 5 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 6 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 7 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |

4 DISPLAY OPTIONS

MEXICAN FLAG

| ROW | SERIES | BULBS | LEDs | COLOR |
|---|---|---|---|---|
| 8 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 9 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 10 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 11 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 12 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 13 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 14 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |

Fig. 41A

FLAGS DISPLAYS

L 1 NEGATIVE (-)

| ROW | SERIES | BULBS | LEDs | COLOR |
|---|---|---|---|---|
| 15 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 16 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 17 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 18 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 19 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |

4 DISPLAY OPTIONS

MEXICAN FLAG

| ROW | SERIES | BULBS | LEDs | COLOR |
|---|---|---|---|---|
| 20 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 21 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 22 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 23 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |
| 24 | 1 | 1-8 | B,F,J,N,B,F,J,N | RED |
| | 2 | 1-3 | B,F,J | RED |
| | | 4-8 | N,B,F,J,N | WHITE |
| | 3 | 1-5 | N,B,F,J,N | WHITE |
| | | 6-8 | B,F,J | GREEN |
| | 4 | 1-8 | B,F,J,N,B,F,J,N | GREEN |

Fig. 41B

NATIONAL FLAGS

L 2 POSITIVE (+)

| ROW | SERIES | BULBS | LEDs | COLOR |
|---|---|---|---|---|
| 1 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 2 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 3 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 4 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 5 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 6 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 7 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |

4 DISPLAY OPTIONS

IRISH FLAG

| ROW | SERIES | BULBS | LEDs | COLOR |
|---|---|---|---|---|
| 8 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 9 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 10 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 11 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 12 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 13 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 14 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |

Fig. 42A

NATIONAL FLAGS

L 2 POSITIVE (+)

| ROW | SERIES | BULBS | LEDs | COLOR |
|---|---|---|---|---|
| 15 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 16 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 17 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 18 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 19 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |

4 DISPLAY OPTIONS

IRISH FLAG

| ROW | SERIES | BULBS | LEDs | COLOR |
|---|---|---|---|---|
| 20 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 21 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 22 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 23 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |
| 24 | 1 | 1-8 | C,G,K,O,C,G,K,O | GREEN |
| | 2 | 1-3 | C,G,K | GREEN |
| | | 4-8 | O,C,G,K,O | WHITE |
| | 3 | 1-5 | O,C,G,K,O | WHITE |
| | | 6-8 | C,G,K | ORANGE |
| | 4 | 1-8 | C,G,K,O,C,G,K,O | ORANGE |

Fig. 42B

NATIONAL FLAGS

L 2 POSITIVE (-)

| ROW | SERIES | BULBS | LEDs | COLOR |
|---|---|---|---|---|
| 1 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 2 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 3 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 4 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 5 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 6 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 7 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |

4 DISPLAY OPTIONS

FRENCH FLAG

| ROW | SERIES | BULBS | LEDs | COLOR |
|---|---|---|---|---|
| 8 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 9 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 10 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 11 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 12 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 13 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 14 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |

Fig. 43A

FLAGS DISPLAYS

L 2 POSITIVE (-)

| ROW | SERIES | BULBS | LEDs | COLOR |
|---|---|---|---|---|
| 15 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 16 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 17 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 18 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 19 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |

4 DISPLAY OPTIONS

FRENCH FLAG

| ROW | SERIES | BULBS | LEDs | COLOR |
|---|---|---|---|---|
| 20 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 21 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 22 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 23 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |
| 24 | 1 | 1-8 | D,H,L,P,D,H,L,P | BLUE |
| | 2 | 1-3 | D,H,L | BLUE |
| | | 4-8 | P,D,H,L,P | WHITE |
| | 3 | 1-5 | P,D,H,L,P | WHITE |
| | | 6-8 | D,H,L | RED |
| | 4 | 1-8 | D,H,L,P,D,H,L,P | RED |

Fig. 43B

SPORTS AND HOLIDAY

L 2 NEGATIVE (-)

| ROW | SERIES | BULBS | LEDs | COLOR |
|---|---|---|---|---|
| 1 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 2 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 3 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 4 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 5 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 6 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 7 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |
| 8 | 1 | 1-8 | C,G,K,O,C,G,K,O | GREEN |
| | 2 | 1-8 | C,G,K,O,C,G,K,O | GREEN |
| | 3 | 1-8 | C,G,K,O,C,G,K,O | GREEN |
| | 4 | 1-8 | C,G,K,O,C,G,K,O | GREEN |

4 DISPLAY OPTIONS

MARDI GRAS FLAG

| ROW | SERIES | BULBS | LEDs | COLOR |
|---|---|---|---|---|
| 9 | 1 | 1-8 | C,G,K,O,C,G,K,O | YELLOW |
| | 2 | 1-8 | C,G,K,O,C,G,K,O | YELLOW |
| | 3 | 1-8 | C,G,K,O,C,G,K,O | YELLOW |
| | 4 | 1-8 | C,G,K,O,C,G,K,O | YELLOW |
| 10 | 1 | 1-8 | C,G,K,O,C,G,K,O | YELLOW |
| | 2 | 1-8 | C,G,K,O,C,G,K,O | YELLOW |
| | 3 | 1-8 | C,G,K,O,C,G,K,O | YELLOW |
| | 4 | 1-8 | C,G,K,O,C,G,K,O | YELLOW |
| 11 | 1 | 1-8 | C,G,K,O,C,G,K,O | YELLOW |
| | 2 | 1-8 | C,G,K,O,C,G,K,O | YELLOW |
| | 3 | 1-8 | C,G,K,O,C,G,K,O | YELLOW |
| | 4 | 1-8 | C,G,K,O,C,G,K,O | YELLOW |
| 12 | 1 | 1-8 | C,G,K,O,C,G,K,O | YELLOW |
| | 2 | 1-8 | C,G,K,O,C,G,K,O | YELLOW |
| | 3 | 1-8 | C,G,K,O,C,G,K,O | YELLOW |
| | 4 | 1-8 | C,G,K,O,C,G,K,O | YELLOW |
| 13 | 1 | 1-8 | C,G,K,O,C,G,K,O | YELLOW |
| | 2 | 1-8 | C,G,K,O,C,G,K,O | YELLOW |
| | 3 | 1-8 | C,G,K,O,C,G,K,O | YELLOW |
| | 4 | 1-8 | C,G,K,O,C,G,K,O | YELLOW |
| 14 | 1 | 1-8 | C,G,K,O,C,G,K,O | YELLOW |
| | 2 | 1-8 | C,G,K,O,C,G,K,O | YELLOW |
| | 3 | 1-8 | C,G,K,O,C,G,K,O | YELLOW |
| | 4 | 1-8 | C,G,K,O,C,G,K,O | YELLOW |
| 15 | 1 | 1-8 | C,G,K,O,C,G,K,O | YELLOW |
| | 2 | 1-8 | C,G,K,O,C,G,K,O | YELLOW |
| | 3 | 1-8 | C,G,K,O,C,G,K,O | YELLOW |
| | 4 | 1-8 | C,G,K,O,C,G,K,O | YELLOW |
| 16 | 1 | 1-8 | C,G,K,O,C,G,K,O | YELLOW |
| | 2 | 1-8 | C,G,K,O,C,G,K,O | YELLOW |
| | 3 | 1-8 | C,G,K,O,C,G,K,O | YELLOW |
| | 4 | 1-8 | C,G,K,O,C,G,K,O | YELLOW |

Fig. 44A

SPORTS AND HOLIDAY

L 2 NEGATIVE (-)

| ROW | SERIES | BULBS | LEDs | COLOR |
|---|---|---|---|---|
| 17 | 1 | 1-8 | C,G,K,O,C,G,K,O | PURPLE |
| | 2 | 1-8 | C,G,K,O,C,G,K,O | PURPLE |
| | 3 | 1-8 | C,G,K,O,C,G,K,O | PURPLE |
| | 4 | 1-8 | C,G,K,O,C,G,K,O | PURPLE |
| 18 | 1 | 1-8 | C,G,K,O,C,G,K,O | PURPLE |
| | 2 | 1-8 | C,G,K,O,C,G,K,O | PURPLE |
| | 3 | 1-8 | C,G,K,O,C,G,K,O | PURPLE |
| | 4 | 1-8 | C,G,K,O,C,G,K,O | PURPLE |
| 19 | 1 | 1-8 | C,G,K,O,C,G,K,O | PURPLE |
| | 2 | 1-8 | C,G,K,O,C,G,K,O | PURPLE |
| | 3 | 1-8 | C,G,K,O,C,G,K,O | PURPLE |
| | 4 | 1-8 | C,G,K,O,C,G,K,O | PURPLE |
| 20 | 1 | 1-8 | C,G,K,O,C,G,K,O | PURPLE |
| | 2 | 1-8 | C,G,K,O,C,G,K,O | PURPLE |
| | 3 | 1-8 | C,G,K,O,C,G,K,O | PURPLE |
| | 4 | 1-8 | C,G,K,O,C,G,K,O | PURPLE |

4 DISPLAY OPTIONS

MARDI GRAS FLAG

| ROW | SERIES | BULBS | LEDs | COLOR |
|---|---|---|---|---|
| 21 | 1 | 1-8 | C,G,K,O,C,G,K,O | PURPLE |
| | 2 | 1-8 | C,G,K,O,C,G,K,O | PURPLE |
| | 3 | 1-8 | C,G,K,O,C,G,K,O | PURPLE |
| | 4 | 1-8 | C,G,K,O,C,G,K,O | PURPLE |
| 22 | 1 | 1-8 | C,G,K,O,C,G,K,O | PURPLE |
| | 2 | 1-8 | C,G,K,O,C,G,K,O | PURPLE |
| | 3 | 1-8 | C,G,K,O,C,G,K,O | PURPLE |
| | 4 | 1-8 | C,G,K,O,C,G,K,O | PURPLE |
| 23 | 1 | 1-8 | C,G,K,O,C,G,K,O | PURPLE |
| | 2 | 1-8 | C,G,K,O,C,G,K,O | PURPLE |
| | 3 | 1-8 | C,G,K,O,C,G,K,O | PURPLE |
| | 4 | 1-8 | C,G,K,O,C,G,K,O | PURPLE |
| 24 | 1 | 1-8 | C,G,K,O,C,G,K,O | PURPLE |
| | 2 | 1-8 | C,G,K,O,C,G,K,O | PURPLE |
| | 3 | 1-8 | C,G,K,O,C,G,K,O | PURPLE |
| | 4 | 1-8 | C,G,K,O,C,G,K,O | PURPLE |

Fig. 44B

SPORTS AND HOLIDAY

L 2 NEGATIVE (-)

| ROW | SERIES | BULBS | LEDs | COLOR |
|---|---|---|---|---|
| 1 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |
| 2 | 1 | 1-8 | D,H,L,P,D,H,L,P | PURPLE |
| | 2 | 1-8 | D,H,L,P,D,H,L,P | PURPLE |
| | 3 | 1 | D | PURPLE |
| | | 2-3 | H,L | GREEN |
| | | 4-8 | P,D,H,L,P | PURPLE |
| | 4 | 1-8 | D,H,L,P,D,H,L,P | PURPLE |
| 3 | 1 | 1-8 | D,H,L,P,D,H,L,P | PURPLE |
| | 2 | 1-8 | D,H,L,P,D,H,L,P | PURPLE |
| | 3 | 1-2 | D,H | GREEN |
| | | 3-8 | L,P,D,H,L,P | PURPLE |
| | 4 | 1-8 | D,H,L,P,D,H,L,P | PURPLE |
| 4 | 1 | 1-8 | D,H,L,P,D,H,L,P | PURPLE |
| | 2 | 1-7 | D,H,L,P,D,H,L | PURPLE |
| | | 8 | P | GREEN |
| | 3 | 1 | D | GREEN |
| | | 2-8 | H,L,P,D,H,L,P | PURPLE |
| | 4 | 1-8 | D,H,L,P,D,H,L,P | PURPLE |
| 5 | 1 | 1-8 | D,H,L,P,D,H,L,P | PURPLE |
| | 2 | 1-2 | D,H | PURPLE |
| | | 3-7 | L,P,D,H,L | ORANGE |
| | | 8 | P | GREEN |
| | 3 | 1 | D | GREEN |
| | | 2-6 | H,L,P,D,H | ORANGE |
| | | 7-8 | L,P | PURPLE |
| | 4 | 1-8 | D,H,L,P,D,H,L,P | PURPLE |
| 6 | 1 | 1-8 | D,H,L,P,D,H,L,P | PURPLE |
| | 2 | 1 | D | PURPLE |
| | | 2-8 | H,L,P,D,H,L,P | ORANGE |
| | 3 | 1-7 | D,H,L,P,D,H,L | ORANGE |
| | | 8 | P | PURPLE |
| | 4 | 1-8 | D,H,L,P,D,H,L,P | PURPLE |

4 DISPLAY OPTIONS

HALLOWEEN PUMPKIN

| ROW | SERIES | BULBS | LEDs | COLOR |
|---|---|---|---|---|
| 7 | 1 | 1-7 | D,H,L,P,D,H,L | PURPLE |
| | | 8 | P | ORANGE |
| | 2 | 1-8 | D,H,L,P,D,H,L,P | ORANGE |
| | 3 | 1-8 | D,H,L,P,D,H,L,P | ORANGE |
| | 4 | 1 | D | ORANGE |
| | | 2-8 | H,L,P,D,H,L,P | PURPLE |
| 8 | 1 | 1-6 | D,H,L,P,D,H | PURPLE |
| | | 7-8 | L,P | ORANGE |
| | 2 | 1-8 | D,H,L,P,D,H,L,P | ORANGE |
| | 3 | 1-8 | D,H,L,P,D,H,L,P | ORANGE |
| | 4 | 1-2 | D,H, | ORANGE |
| | | 3-8 | L,P,D,H,L,P | PURPLE |
| 9 | 1 | 1-6 | D,H,L,P,D,H | PURPLE |
| | | 7-8 | L,P | ORANGE |
| | 2 | 1-8 | D,H,L,P,D,H,L,P | ORANGE |
| | 3 | 1-8 | D,H,L,P,D,H,L,P | ORANGE |
| | 4 | 1-2 | D,H, | ORANGE |
| | | 3-8 | L,P,D,H,L,P | PURPLE |
| 10 | 1 | 1-5 | D,H,L,P,D | PURPLE |
| | | 6-8 | H,L,P | ORANGE |
| | 2 | 1-3 | D,H,L | ORANGE |
| | | 4 | P | RED |
| | | 5-8 | H,L,P | ORANGE |
| | 3 | 1-4 | D,H,L,P | ORANGE |
| | | 5 | P,D,H | RED |
| | | 6-8 | L,P | ORANGE |
| | 4 | 1-2 | D,H, | ORANGE |
| | | 3-8 | L,P,D,H,L,P | PURPLE |
| 11 | 1 | 1-5 | D,H,L,P,D | PURPLE |
| | | 6-8 | H,L,P | ORANGE |
| | 2 | 1-2 | D,H | ORANGE |
| | | 3-5 | P,H,L | RED |
| | | 5-8 | D,H,L,P | ORANGE |
| | 3 | 1-3 | D,H,L | ORANGE |
| | | 4-6 | P,D,H | RED |
| | | 7-8 | H,L,P | ORANGE |
| | 4 | 1-2 | D,H, | ORANGE |
| | | 3-8 | L,P,D,H,L,P | PURPLE |

Fig. 45A

SPORTS AND HOLIDAY

L 2 NEGATIVE (-)

| ROW | SERIES | BULBS | LEDs | COLOR |
|---|---|---|---|---|
| 12 | 1 | 1-5 | D,H,L,P,D | PURPLE |
| | | 6-8 | H,L,P | ORANGE |
| | 2 | 1-2 | D,H | ORANGE |
| | | 3-5 | P,H,L | RED |
| | | 5-8 | D,H,L,P | ORANGE |
| | 3 | 1-3 | D,H,L | ORANGE |
| | | 4-6 | P,D,H | RED |
| | | 7-8 | H,L,P | ORANGE |
| | 4 | 1-2 | D,H, | ORANGE |
| | | 3-8 | L,P,D,H,L,P | PURPLE |
| 13 | 1 | 1-6 | D,H,L,P,H | PURPLE |
| | | 7-8 | L,P,D,H,L,P | ORANGE |
| | 2 | 1-8 | D,H,L,P,D,H,L,P | ORANGE |
| | 3 | 1-8 | D,H,L,P,D,H,L,P | ORANGE |
| | 4 | 1-2 | D,H,L,P,D,H | ORANGE |
| | | 3-8 | L,P | PURPLE |
| 14 | 1 | 1-6 | D,H,L,P,H | PURPLE |
| | | 7-8 | L,P,D,H,L,P | ORANGE |
| | 2 | 1-8 | D,H,L,P,D,H,L,P | ORANGE |
| | 3 | 1-8 | D,H,L,P,D,H,L,P | ORANGE |
| | 4 | 1-2 | D,H,L,P,D,H | ORANGE |
| | | 3-8 | L,P | PURPLE |
| 15 | 1 | 1-6 | D,H,L,P,H | PURPLE |
| | | 7-8 | L,P,D,H,L,P | ORANGE |
| | 2 | 1-4 | D,H,L,P | ORANGE |
| | | 5 | D | RED |
| | | 6-8 | H,L,P | ORANGE |
| | 3 | 1-3 | D,H,L | ORANGE |
| | | 4 | P | RED |
| | | 5-8 | D,H,L,P | ORANGE |
| | 4 | 1-2 | D,H,L,P,D,H | ORANGE |
| | | 3-8 | L,P | PURPLE |
| 16 | 1 | 1-7 | D,H,L,P,D,H,L | PURPLE |
| | | 8 | P | ORANGE |
| | 2 | 1-4 | D,H,L,P | ORANGE |
| | | 5-8 | D,H,L,P | RED |
| | 3 | 1-4 | D,H,L,P | RED |
| | | 5-8 | D,H,L,P | ORANGE |
| | 4 | 1 | D | ORANGE |
| | | 2-8 | H,L,P,D,H,L,P | PURPLE |

4 DISPLAY OPTIONS

HALLOWEEN PUMPKIN

| ROW | SERIES | BULBS | LEDs | COLOR |
|---|---|---|---|---|
| 17 | 1 | 1-8 | D,H,L,P,D,H,L,P | PURPLE |
| | 2 | 1-4 | D,H,L,P | ORANGE |
| | | 5-8 | D,H,L,P | RED |
| | 3 | 1-5 | D,H,L,P | RED |
| | | 5-9 | D,H,L,P | ORANGE |
| | 4 | 1-8 | D,H,L,P,D,H,L,P | ORANGE |
| 18 | 1 | 1-8 | D,H,L,P,D,H,L,P | ORANGE |
| | 2 | 1 | D | PURPLE |
| | | 2-5 | H,L,P,D | ORANGE |
| | | 6-8 | H,L,P | RED |
| | 3 | 1-3 | D,H,L | RED |
| | | 4-7 | P,D,H,L | ORANGE |
| | | 8 | P,D,H,L | PURPLE |
| | 4 | 1-8 | D,H,L,P,D,H,L,P | ORANGE |
| 19 | 1 | 1-8 | D,H,L,P,D,H,L,P | ORANGE |
| | 2 | 1-2 | D,H | PURPLE |
| | | 3-8 | L,P,D,H,L,P | ORANGE |
| | 3 | 1-4 | D,H,L,P, | ORANGE |
| | | 5-8 | D,H,L,P | PURPLE |
| | 4 | 1-8 | D,H,L,P,D,H,L,P | PURPLE |
| 20 | 1 | 1-8 | D,H,L,P,D,H,L,P | PURPLE |
| | 2 | 1-4 | D,H,L,P, | PURPLE |
| | | 5-8 | D,H,L,P, | ORANGE |
| | 3 | 1-4 | D,H,L,P, | ORANGE |
| | | 5-8 | D,H,L,P, | PURPLE |
| | 4 | 1-8 | D,H,L,P,D,H,L,P | PURPLE |
| 21 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |
| 22 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |
| 23 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |
| 24 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |

Fig. 45B

SPORTS AND HOLIDAY

L 2 NEGATIVE (-)

| ROW | SERIES | BULBS | LEDs | COLOR |
|---|---|---|---|---|
| 1 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |
| 2 | 1 | 1-8 | D,H,L,P,D,H,L,P | PURPLE |
| | 2 | 1-8 | D,H,L,P,D,H,L,P | PURPLE |
| | 3 | 1 | D | PURPLE |
| | | 2-3 | H,L | GREEN |
| | | 4-8 | P,D,H,L,P | PURPLE |
| | 4 | 1-8 | D,H,L,P,D,H,L,P | PURPLE |
| 3 | 1 | 1-8 | D,H,L,P,D,H,L,P | PURPLE |
| | 2 | 1-8 | D,H,L,P,D,H,L,P | PURPLE |
| | 3 | 1-2 | D,H | GREEN |
| | | 3-8 | L,P,D,H,L,P | PURPLE |
| | 4 | 1-8 | D,H,L,P,D,H,L,P | PURPLE |
| 4 | 1 | 1-8 | D,H,L,P,D,H,L,P | PURPLE |
| | 2 | 1-7 | D,H,L,P,D,H,L | PURPLE |
| | | 8 | P | GREEN |
| | 3 | 1 | D | GREEN |
| | | 2-8 | H,L,P,D,H,L,P | PURPLE |
| | 4 | 1-8 | D,H,L,P,D,H,L,P | PURPLE |
| 5 | 1 | 1-8 | D,H,L,P,D,H,L,P | PURPLE |
| | 2 | 1-2 | D,H | PURPLE |
| | | 3-7 | L,P,D,H,L | ORANGE |
| | | 8 | P | GREEN |
| | 3 | 1 | D | GREEN |
| | | 2-6 | H,L,P,D,H | ORANGE |
| | | 7-8 | L,P | PURPLE |
| | 4 | 1-8 | D,H,L,P,D,H,L,P | PURPLE |
| 6 | 1 | 1-8 | D,H,L,P,D,H,L,P | PURPLE |
| | 2 | 1 | D | PURPLE |
| | | 2-8 | H,L,P,D,H,L,P | ORANGE |
| | 3 | 1-7 | D,H,L,P,D,H,L | ORANGE |
| | | 8 | P | PURPLE |
| | 4 | 1-8 | D,H,L,P,D,H,L,P | PURPLE |

4 DISPLAY OPTIONS

HALLOWEEN PUMPKIN

| ROW | SERIES | BULBS | LEDs | COLOR |
|---|---|---|---|---|
| 7 | 1 | 1-7 | D,H,L,P,D,H,L | PURPLE |
| | | 8 | P | ORANGE |
| | 2 | 1-8 | D,H,L,P,D,H,L,P | ORANGE |
| | 3 | 1-8 | D,H,L,P,D,H,L,P | ORANGE |
| | 4 | 1 | D | ORANGE |
| | | 2-8 | H,L,P,D,H,L,P | PURPLE |
| 8 | 1 | 1-6 | D,H,L,P,D,H | PURPLE |
| | | 7-8 | L,P | ORANGE |
| | 2 | 1-8 | D,H,L,P,D,H,L,P | ORANGE |
| | 3 | 1-8 | D,H,L,P,D,H,L,P | ORANGE |
| | 4 | 1-2 | D,H, | ORANGE |
| | | 3-8 | L,P,D,H,L,P | PURPLE |
| 9 | 1 | 1-6 | D,H,L,P,D,H | PURPLE |
| | | 7-8 | L,P | ORANGE |
| | 2 | 1-8 | D,H,L,P,D,H,L,P | ORANGE |
| | 3 | 1-8 | D,H,L,P,D,H,L,P | ORANGE |
| | 4 | 1-2 | D,H, | ORANGE |
| | | 3-8 | L,P,D,H,L,P | PURPLE |
| 10 | 1 | 1-5 | D,H,L,P,D | PURPLE |
| | | 6-8 | H,L,P | ORANGE |
| | 2 | 1-3 | D,H,L | ORANGE |
| | | 4 | P | RED |
| | | 5-8 | H,L,P | ORANGE |
| | 3 | 1-4 | D,H,L,P | ORANGE |
| | | 5 | P,D,H | RED |
| | | 6-8 | L,P | ORANGE |
| | 4 | 1-2 | D,H, | ORANGE |
| | | 3-8 | L,P,D,H,L,P | PURPLE |
| 11 | 1 | 1-5 | D,H,L,P,D | PURPLE |
| | | 6-8 | H,L,P | ORANGE |
| | 2 | 1-2 | D,H | ORANGE |
| | | 3-5 | P,H,L | RED |
| | | 5-8 | D,H,L,P | ORANGE |
| | 3 | 1-3 | D,H,L | ORANGE |
| | | 4-6 | P,D,H | RED |
| | | 7-8 | H,L,P | ORANGE |
| | 4 | 1-2 | D,H, | ORANGE |
| | | 3-8 | L,P,D,H,L,P | PURPLE |

Fig. 54A

SPORTS AND HOLIDAY

L 2 NEGATIVE (-)

| ROW | SERIES | BULBS | LEDs | COLOR |
|---|---|---|---|---|
| 12 | 1 | 1-5 | D,H,L,P,D | PURPLE |
| | | 6-8 | H,L,P | ORANGE |
| | 2 | 1-2 | D,H | ORANGE |
| | | 3-5 | P,H,L | RED |
| | | 5-8 | D,H,L,P | ORANGE |
| | 3 | 1-3 | D,H,L | ORANGE |
| | | 4-6 | P,D,H | RED |
| | | 7-8 | H,L,P | ORANGE |
| | 4 | 1-2 | D,H, | ORANGE |
| | | 3-8 | L,P,D,H,L,P | PURPLE |
| 13 | 1 | 1-6 | D,H,L,P,H | PURPLE |
| | | 7-8 | L,P,D,H,L,P | ORANGE |
| | 2 | 1-8 | D,H,L,P,D,H,L,P | ORANGE |
| | 3 | 1-8 | D,H,L,P,D,H,L,P | ORANGE |
| | 4 | 1-2 | D,H,L,P,D,H | ORANGE |
| | | 3-8 | L,P | PURPLE |
| 14 | 1 | 1-6 | D,H,L,P,H | PURPLE |
| | | 7-8 | L,P,D,H,L,P | ORANGE |
| | 2 | 1-8 | D,H,L,P,D,H,L,P | ORANGE |
| | 3 | 1-8 | D,H,L,P,D,H,L,P | ORANGE |
| | 4 | 1-2 | D,H,L,P,D,H | ORANGE |
| | | 3-8 | L,P | PURPLE |
| 15 | 1 | 1-6 | D,H,L,P,H | PURPLE |
| | | 7-8 | L,P,D,H,L,P | ORANGE |
| | 2 | 1-4 | D,H,L,P | ORANGE |
| | | 5 | D | RED |
| | | 6-8 | H,L,P | ORANGE |
| | 3 | 1-3 | D,H,L | ORANGE |
| | | 4 | P | RED |
| | | 5-8 | D,H,L,P | ORANGE |
| | 4 | 1-2 | D,H,L,P,D,H | ORANGE |
| | | 3-8 | L,P | PURPLE |
| 16 | 1 | 1-7 | D,H,L,P,D,H,L | PURPLE |
| | | 8 | P | ORANGE |
| | 2 | 1-4 | D,H,L,P | ORANGE |
| | | 5-8 | D,H,L,P | RED |
| | 3 | 1-4 | D,H,L,P | RED |
| | | 5-8 | D,H,L,P | ORANGE |
| | 4 | 1 | D | ORANGE |
| | | 2-8 | H,L,P,D,H,L,P | PURPLE |

4 DISPLAY OPTIONS

HALLOWEEN PUMPKIN

| ROW | SERIES | BULBS | LEDs | COLOR |
|---|---|---|---|---|
| 17 | 1 | 1-8 | D,H,L,P,D,H,L,P | PURPLE |
| | 2 | 1-4 | D,H,L,P | ORANGE |
| | | 5-8 | D,H,L,P | RED |
| | 3 | 1-5 | D,H,L,P | RED |
| | | 5-9 | D,H,L,P | ORANGE |
| | 4 | 1-8 | D,H,L,P,D,H,L,P | ORANGE |
| 18 | 1 | 1-8 | D,H,L,P,D,H,L,P | ORANGE |
| | 2 | 1 | D | PURPLE |
| | | 2-5 | H,L,P,D | ORANGE |
| | | 6-8 | H,L,P | RED |
| | 3 | 1-3 | D,H,L | RED |
| | | 4-7 | P,D,H,L | ORANGE |
| | | 8 | P,D,H,L | PURPLE |
| | 4 | 1-8 | D,H,L,P,D,H,L,P | ORANGE |
| 19 | 1 | 1-8 | D,H,L,P,D,H,L,P | ORANGE |
| | 2 | 1-2 | D,H | PURPLE |
| | | 3-8 | L,P,D,H,L,P | ORANGE |
| | 3 | 1-4 | D,H,L,P, | ORANGE |
| | | 5-8 | D,H,L,P | PURPLE |
| | 4 | 1-8 | D,H,L,P,D,H,L,P | PURPLE |
| 20 | 1 | 1-8 | D,H,L,P,D,H,L,P | PURPLE |
| | 2 | 1-4 | D,H,L,P, | PURPLE |
| | | 5-8 | D,H,L,P, | ORANGE |
| | 3 | 1-4 | D,H,L,P, | ORANGE |
| | | 5-8 | D,H,L,P, | PURPLE |
| | 4 | 1-8 | D,H,L,P,D,H,L,P | PURPLE |
| 21 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |
| 22 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |
| 23 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |
| 24 | 1 | 1-8 | D,H,L,P,D,H,L,P | PURPLE |
| | 2 | 1-8 | D,H,L,P,D,H,L,P | PURPLE |
| | 3 | 1-8 | D,H,L,P,D,H,L,P | PURPLE |
| | 4 | 1-8 | D,H,L,P,D,H,L,P | PURPLE |

Fig. 54B

MULTI-COLOR FLAT ROPE LIGHT STRING SYSTEM

CROSS-REFERENCE TO RELATED APPLICATIONS

This application is a continuation-in part of U.S. nonprovisional patent application Ser. No. 16/852,828 filed on Apr. 20, 2020, and entitled "Multi-Color Flat Rope Light String System," which is a continuation-in part of U.S. nonprovisional patent application Ser. No. 16/588,537 filed on Sep. 30, 2019, and entitled "Multi-Color Flat Rope Light String System," issued as U.S. Pat. No. 10,631,386 on Apr. 21, 2020, the entire disclosure of each of which is incorporated herein by reference.

TECHNICAL FIELD

The present invention relates generally to a flat rope light string system and more particularly to a flat rope light string system employing light emitting diodes (LEDs).

BACKGROUND

Light emitting diodes (LEDs) are increasingly employed as a basic lighting source in a variety of forms, including decorative lighting, for reasons among the following. First, as a device, LEDs have a very long lifespan, compared with common incandescent and fluorescent sources, with typical LED lifespan at least 100,000 hours. Second, LEDs have several favorable physical properties, including ruggedness, cool operation, and ability to operate under wide temperature variations. Third, LEDs are currently available in all primary and several secondary colors, as well as in a "white" form employing a blue source and phosphors. Fourth, with newer doping techniques, LEDs are becoming increasingly efficient, and colored LED sources currently available may consume an order of magnitude less power than incandescent bulbs of equivalent light output. Moreover, with expanding applications and resulting larger volume demand, as well as with new manufacturing techniques, LEDs are increasingly cost effective.

Various LED light strings have been proposed for decorative illumination purposes. Most LED light sets and rope lights, including flat rope lights come with a variety of lighting options. Most are rotating color combinations or have the ability to change colors as desired, within a limit. Those LED light sets where colors can be programmed or selected by the user, have the entire set change to any one color at a time. One example of this is commonly referred to as a dual colored light string. This type of LED light string takes advantage of the fact that LEDs only illuminate when a voltage is applied in the correct direction. By coupling two LEDs together in parallel, anode to cathode and cathode to anode, so that only one of the LEDs will light with each voltage polarity, a dual color light string can be created. This type of light string may emit white light when a positive voltage is applied and multi-colored light when a negative voltage is applied. While multiple variations of this kind of dual-polarity LED light string are known, such LED light strings are not capable of placing different combinations of LEDs on the light string in specific locations to be energized in a forward and reverse bias as selected by a controller.

Exemplary LED-based light strings are described in the literature which employ purely parallel wiring of discrete LED lamps using a step-down transformer and rectifier power conversion scheme. The LED light string descriptions found in the prior art convert input electrical power, usually assumed to be the common U.S. household power of 110 VAC to a low voltage, nearly DC input.

Thus, conventional LED light string controllers are lacking in certain aspects. In particular, none of the prior art LED light string controllers disclose an LED light string that includes different combinations of LEDs on a light string in specific locations, under control of a controller that can easily and conveniently select a plurality of LED light display patterns that correspond to pre-arranged lighting color schemes applicable to holidays and other events.

Conventional flat rope systems lack in one additional aspect. Namely, these conventional systems utilize three LEDs in parallel where all of the LEDs change to the same color at the same time and do not have the capability to dynamically change the display pattern over in accordance with pre-programmed event patterns.

SUMMARY OF THE INVENTION

In one exemplary aspect, the present disclosure is directed to a lighting system. The lighting system includes a plurality of lighting assemblies; a first controller coupled to a power source at a first connection and at least one of the plurality of lighting assemblies at a second connection, each of said plurality of lighting assemblies including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions including: a first switch position for providing electrical power at said second connection to said plurality of lighting assemblies by applying said first voltage polarity on a first connection lead, said first voltage polarity biasing said first light in each of said plurality of pairs of different colored lights within each of said plurality of lighting elements; a second switch position for providing electrical power at said second connection to said plurality of lighting assemblies by applying said second voltage polarity on said first connection lead, said second voltage polarity biasing said second light in each of said plurality of pairs of different colored lights within each of said plurality of lighting elements; a third switch position for providing electrical power at said second connection to said plurality of lighting assemblies by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of lighting assemblies by applying said second voltage polarity on said second connection lead, said second voltage polarity biasing said second light in each of said plurality of pairs of different colored lights within each of said plurality of lighting elements; a second controller coupled to one of the plurality of lighting assemblies; and a communication device configured to communicate with the first controller and the second controller.

In another exemplary aspect, the present disclosure is directed to a lighting system. The lighting system includes a plurality of lighting assemblies; a first controller coupled to a power source at a first connection and at least one of the plurality of lighting assemblies at a second connection, each of said plurality of lighting assemblies including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions including: a first switch position for providing electrical power at said second connection to said plurality of lighting assemblies by applying said first voltage polarity on a first connection lead, said first voltage polarity biasing said first light in each of said plurality of pairs of different colored lights within each of said plurality of lighting elements; a second switch position for providing electrical power at said second connection to said plurality of lighting assemblies by applying said second voltage polarity on said first connection lead, said second voltage polarity biasing said second light in each of said plurality of pairs of different colored lights within each of said plurality of lighting elements; a third switch position for providing electrical power at said second connection to said plurality of lighting assemblies by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of lighting assemblies by applying said second voltage polarity on said second connection lead, said second voltage polarity biasing said second light in each of said plurality of pairs of different colored lights within each of said plurality of lighting elements; a second controller coupled to a first one of the plurality of lighting assemblies; a third controller coupled to a second one of the plurality of lighting assemblies; and a communication device configured to communicate with the first controller, the second controller, and the third controller.

In another exemplary aspect, the present disclosure is directed to a system. The system includes a plurality of flat rope light strings, and a controller coupled to a power source at a first connection and at least one of the plurality of flat rope light strings at a second connection, said second connection including a plurality of connection leads, said second connection being polarized such that said plurality of flat rope light strings is capable of one connection orientation at said second connection, each of said plurality of flat rope light strings including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity. Said controller has a switch with a plurality of switch positions including a first switch position for providing electrical power at said second connection to said plurality of flat rope light strings by applying said first voltage polarity on a first connection lead, said first voltage polarity biasing said first light in each of said plurality of pairs of different colored lights within each of said plurality of lighting elements; a second switch position for providing electrical power at said second connection to said plurality of flat rope light strings by applying said second voltage polarity on said first connection lead, said second voltage polarity biasing said second light in each of said plurality of pairs of different colored lights within each of said plurality of lighting elements; a third switch position for providing electrical power at said second connection to said plurality of flat rope light strings by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of flat rope light strings by applying said second voltage polarity on said second connection lead, said second voltage polarity biasing said second light in each of said plurality of pairs of different colored lights within each of said plurality of lighting elements. Said plurality of lighting elements of said plurality of flat rope light strings form a grid.

In another exemplary aspect, the present disclosure is directed to a system. The system includes a plurality of flat rope light strings; and a controller coupled to a power source at a first connection and at least one of the plurality of flat rope light strings at a second connection, said second connection including three connection leads, said second connection being polarized such that said plurality of flat rope light strings is capable of only one connection orientation at said second connection, each of said plurality of flat rope light strings including a plurality of lighting elements, each of said lighting elements including three pairs of different colored lights, each of said three pairs including a first light and a second light, said first light of said light pair activated via a first voltage polarity and said second light of said light pair activated via a second voltage polarity. Said controller has a switch with a plurality of switch positions including a first switch position for providing electrical power at said second connection to said plurality of flat rope light strings by applying said first voltage polarity on a first connection lead, said first voltage polarity biasing said first light in each of said three pairs of different colored lights within each of said plurality of lighting elements; a second switch position for providing electrical power at said second connection to said plurality of flat rope light strings by applying said second voltage polarity on said first connection lead, said second voltage polarity biasing said second light in each of said three pairs of different colored lights within each of said plurality of lighting elements; a third switch position for providing electrical power at said second connection to said plurality of flat rope light strings by applying said first voltage polarity on a second connection lead, said first voltage polarity biasing said first light in each of said three pairs of different colored lights within each of said plurality of lighting elements; a fourth switch position for providing electrical power at said second connection to said plurality of flat rope light strings by applying said second voltage polarity on said second connection lead, said second voltage polarity biasing said second light in each of said three pairs of different colored lights within each of said plurality of lighting elements; a fifth switch position for providing electrical power at said second connection to said plurality of flat rope light strings by applying said first voltage polarity on a third connection lead, said first voltage polarity biasing said first light in each of said three pairs of different colored lights within each of said plurality of lighting elements; and a sixth switch position for providing electrical power at said second connection to said plurality of flat rope light strings by applying said second voltage polarity on said third connection lead, said second voltage polarity biasing said second light in each of said three pairs of different colored lights within each of said plurality of lighting elements. Said plurality of lighting elements of said plurality of flat rope light strings form a mat. Said plurality of lighting elements of said plurality of flat rope light strings forming the mat includes a plurality of rows of flat rope strings.

Embodiments of the present invention provide a unique multi-color light emitting diode (LED) flat rope light string system including a controller for coordinating the illumination of the different multi-colored LED lights in accordance with a series of selectable color displays via a switching mechanism. The multi-colored LED lights being selected at a time of manufacture and contained within a single light string in pairs or among several interconnected LED light strings. The flat rope light string system uniquely providing a capability for realizing a plurality of different holiday patterns not available heretofore in conventional light string systems. Capabilities are provided to allow a customer, at a time of manufacture, to select the location and color for different multi-colored LEDs in the bulb housings of the flat rope light string system of the invention. A customer may also select, at a time of manufacture, which LEDs are to be energized such that the flat rope light string system illuminates specific illumination patterns representing a specific desired holiday, special event, sports team or display. The customer specific set of selected multi-colored LEDs along with the customer specific selectable patterns can be conveniently printed on the box display at the time of manufacture. That is, the invention uniquely provides customers with the capability of selecting preset holiday display patterns, known in advance of purchase. To the best of knowledge, these capabilities are not available anywhere in the prior art.

According to one aspect, the present invention provides unique light string system construction layout features including, for example, unique layout features of conductor pathways on a singular common insulator thereby allowing for multiple interconnections, which in turn provides for complex circuit paths to the LEDs in the bulb housings utilizing fewer current carrying conductors than used in the prior art. By utilizing unique layout features of conductor pathways on a singular common insulator, in a manner to be described in detail below, the LED light string system of the invention may be more easily mass produced in a continuous method of automated fabrication.

Various embodiments of the flat rope light string system of the invention may comprise at least one light string, coupled to and controlled by a controller. The one or more light strings being comprised of a plurality of bulb housings, each bulb housing having a plurality of LEDs, the LEDs being organized in pairs with each pair being configured in a back-to-back configuration such that a positive bias energizes a first LED of an LED pair and a negative bias energizes the second LED of the LED pair. Advantageously, the unique back-to-back configuration allows the LEDs to be alternatively energized in each pair such that a first LED from each pair is energized in a forward direction in a first phase of operation followed by the corresponding LED of the pair being energized in a reverse direction, in a second phase of operation. Where energizing the respective LED pairs occurs at a selectable energizing frequency, typically in the range of 120-180 Hz AC to obtain unique color output patterns not achievable by existing prior art flat rope light string systems.

The controller is arranged to change the color patterns of the at least one light string of the flat rope light string system of the invention by energizing and de-energizing the individual leads of the light strings and their polarity. In an illustrative example, the LED pairs within the respective bulb housings are electrically coupled such that a first positive voltage polarity is applied, via the controller, to the at least one light string to provide a turn-on bias to all of the positively biased LEDs in the LED pairs of the plurality of bulb housings, with a second negative voltage polarity being subsequently applied to the at least one light string to provide a turn-on bias to all of the negatively biased LEDs in the LED pairs of the plurality of bulb housings. The LED pairs being pre-determined at the time of manufacture. A resulting display illuminates a different color of in dependence of the type of bias being applied.

The controller of the flat rope light string system is preferably electrically coupled in parallel to the at least one light string, and in the case where there are at least two light strings, the at least two light strings are preferably coupled together in series via harnesses, which may, in some embodiments, be polarized harnesses for making the mating connection between the at least two light strings.

In various embodiments, the flat rope light string system includes; a voltage conversion module for converting a high voltage AC electric power source to a low voltage AC electric power source; a rectifier for accepting an input electrical power source to provide an output DC electrical power to the at least one light string and a controller electrically coupled to a power source at a first connection and electrically coupled, in parallel, to a plurality of light strings at a second connection, the second connection being preferably polarized. The plurality of light strings preferably having a polarized connector at one end for connection to the second connection of the controller such that the light strings are capable of only one connection orientation at the second connection, the light strings having a plurality of bulbs containing a first color LED and a second color LED, the LEDs within the bulbs electrically coupled so that a first voltage polarity applied to the light string provides a turn-on bias to the first color LEDs within the bulbs and a second voltage polarity applied to the light string provides a turn-on bias to the second color LEDs within the bulbs, the controller having switching means with a plurality of switch positions including: a first switch position for providing electrical power at the second connection to the LED light string by applying the first voltage polarity on a first connection lead, the first voltage polarity biasing the first color LED among the plurality of different colored lights within the lighting elements; the second switch position for providing electrical power at the second connection to the LED light strings by applying a second voltage polarity on the first connection lead, the second voltage phase biasing a second color LED among the plurality of different colored lights within the lighting elements; and a third switch position for providing electrical power at the second connection to the light string by simultaneously applying the first voltage polarity and the second voltage polarity on a third connection lead, the plurality of applied voltage phases simultaneously biasing the first color LED and the second color LED within the bulbs, the lighting element including a diffusion element for blending the colors of the plurality of biased lights. In some embodiments, it is contemplated to have six or more switch positions, each switch position corresponding to a different combination of connection lead and applied voltage polarity.

In one embodiment, a flat rope light string system includes a controller coupled to a power source at a first connection and at least one light string at a second connection, the second connection including at least two connection leads, the second connection being polarized such that the at least one light string is capable of only one connection orientation at the second connection, the at least one light string containing a plurality of lighting elements arranged in pairs, the controller having a switch with a plurality of switch positions, including: a first switch position for providing electrical power at the second connection to the light string by applying a first voltage polarity on a first connection lead, the first voltage phase biasing a plurality of first lights among the plurality of different colored lights within the lighting elements; a second switch position for providing electrical power at the second connection to the at least one light string by applying a second voltage phase on the first connection lead, the second voltage polarity biasing a plurality of second lights from among the plurality of different colored lights within the light elements; and a third switch position for providing electrical power at the second connection to the at least one light string by alternately applying the first and second voltage polarities at the second connection lead.

In another embodiment, a flat rope light string system includes a controller coupled to a power source at a first connection and at least one light string at a second connection, the second connection including at least three connection leads, the second connection being polarized such that the at least one light string is capable of only one connection orientation at the second connection, the at least one light string containing a plurality of lighting elements arranged in pairs, the controller having a switch with a plurality of switch positions, including: a first switch position for providing electrical power at the second connection to the light string by applying a first voltage polarity on a first connection lead, the first voltage polarity positively biasing a plurality of first lights among the plurality of different colored lights within the lighting elements; a second switch position for providing electrical power at the second connection to the at least one light string by applying a second voltage polarity on the first connection lead, the second voltage polarity negative biasing a plurality of second lights among the plurality of different colored lights within the light elements; and a third switch position for providing electrical power at the second connection to the at least one light string by applying the first voltage polarity on the second connection lead, the second voltage polarity positively biasing a plurality of second lights among the plurality of different colored lights within the light elements; and a fourth switch position for providing electrical power at the second connection to the at least one light string by applying the first voltage polarity on the second connection lead, the second voltage polarity negatively biasing a plurality of second lights among the plurality of different colored lights within the light elements; and a fifth switch position for providing electrical power at the second connection to the at least one light string by applying the first voltage polarity on the third connection lead, the first voltage polarity positively biasing a plurality of second lights among the plurality of different colored lights within the light elements; and a sixth switch position for providing electrical power at the third connection to the at least one light string by applying a second voltage polarity on the second connection lead, the second voltage polarity negatively biasing a plurality of second lights among the plurality of different colored lights within the light elements; and a seventh switch position for providing electrical power simultaneously at the first, second and third connections to the at least one light string by applying the second voltage polarity on the second connection lead, the second voltage polarity negatively biasing the plurality of different colored lights within the light elements; and an eighth switch position for providing electrical power simultaneously at the first and third connections to the at least one light string by applying a first voltage polarity on the second connection lead, the first voltage polarity positively biasing a plurality of first and third lights from among the plurality of different colored lights within the light elements; and a ninth switch position for providing electrical power simultaneously at the first and third connections to the at least one light string by applying a second voltage polarity on the second connection lead, the second voltage polarity negatively biasing the plurality of different colored lights within the light elements; and a tenth switch position for providing electrical power simultaneously at the first and third connections to the at least one light string by alternatingly applying a first voltage polarity on the second connection lead and a second voltage polarity on the second connection lead, the first voltage polarity positively biasing a plurality of first lights among the plurality of different colored lights within the lighting elements, the second voltage polarity negatively biasing a plurality of second lights from among the plurality of different colored lights within the light elements; and an eleventh switch position for providing electrical power simultaneously at the first, second and third connections to the at least one light string by simultaneously applying a first voltage polarity on the second connection lead and a second voltage polarity on the first and third connection leads, the first voltage polarity positively biasing a plurality of first lights among the plurality of different colored lights within the lighting elements, the second voltage polarity negatively biasing a plurality of second and third lights from among the plurality of different colored lights within the light elements;

In certain preferred aspects of the invention, the plurality of different colored lights are multicolored LEDs and the lighting element is a bulb containing the multicolored LEDs.

In one aspect, the two or more light strings of a flat rope light string system comprise a plurality of multi-colored LEDs placed in lighting elements at specific locations on a flat rope. The specific bulb placements being determined at a time of manufacture. The LEDs capable of being energized in a forward or reverse bias, as selected by a controller. The energizing state allowing the multi-colored LEDs to change from one holiday pattern to another In another aspect, LED pairs are connected back-to-back in bulb housings on a flat rope of a flat rope light string system. The LED pairs capable of being energized in a forward and reverse bias as selected by a controller. "Back to back" LEDs herein, shall refer to LEDs that are connected in reverse parallel such that the anode of the first LED is connected to the cathode of the second LED and the anode of the second LED is connected to the cathode of the first LED, resulting in the LEDs being illuminated individually when the electrical current is applied in one direction one is illuminated and the other being illuminated when the electrical current is reversed.

In one embodiment, a circuit layout of the flat rope light string system is made in a continuous extrusion process with layers added by automated or semi-automated machinery. The continuous extrusion process provides flat conductors deposited on a singular common insulation. Further, this process results in fewer current carrying conductors than conventional LED light strings. The construction of the inventive flat rope string of LEDs versus a string of LEDs as is common in the art, advantageously eliminates a multiplicity of parts and materials, for example, the need for sockets for each bulb, bulb bases for the bulbs and terminals in the sockets and the material cost fabrication cost and labor to assemble the parts.

In one embodiment, the flat rope light string system is made in a continuous extrusion process with layers added by automated or semi-automated machinery. The continuous extrusion process provides flat conductors deposited on a singular insulated surface. The invention further applies to a method of constructing a flat rope light string system. The method includes predetermining an arrangement and color of a plurality of multicolored LEDs in an LED light string at a time of manufacture, predetermining a proper biasing of a plurality of leads within the LED light string, coupling a controller to the LED light string, biasing the plurality of the multicolor LEDs within each lighting element on the light string via the controller.

Various embodiments may achieve one or more advantages. For example, under control of the controller, the various switch positions of the controller provide a plurality of preprogrammed color displays based on factory pre-set LED color combinations of the LED pairs and positions in the at least one light string, thereby providing unique color display options as compared to conventional rotating color combinations associated with conventional LED light strings. The possible arrangements of individual LED color selections is unique and virtually boundless by virtue of being selected at a time of manufacture to allow the illumination of specific pre-programmed patterns. For example, the holiday patterns as shown in the detailed charts. Notably, unlike conventional flat rope flat rope light string systems, customization of the lighting patterns of the flat rope light string system of the invention is achieved by requiring pre-programming of the lighting patterns at the time of manufacture.

It should be noted that the above-mentioned embodiments illustrate rather than limit the invention, and that those skilled in the art will be able to design many alternative embodiments without departing from the scope of the appended claims. In the claims, any reference signs placed between parenthesis shall not be construed as limiting the claim. The article "a" or "an" preceding an element does not exclude the presence of a plurality of such elements. The mere fact that certain measures are recited in mutually different dependent claims does not indicate that a combination of these measures cannot be used to advantage.

The details of various embodiments are set forth in the accompanying drawings and the description below. Other features and advantages will be apparent from the description and drawings, and from the claims.

BRIEF DESCRIPTION OF THE DRAWINGS

FIG. 1E depicts a chart illustrating the color assignments/pairings displayed by the LED light elements according to one embodiment of the invention;

FIG. 1F depicts a chart illustrating the output leads energized by the power source and the resulting color patterns displayed by the LED light elements for the various switch positions of the controller according to one embodiment of the invention;

FIG. 2D depicts a chart illustrating the color assignments/pairings displayed by the LED light elements of the flat rope light string system of FIG. 2A;

FIG. 2E depicts a chart illustrating the output leads energized by the power source and the resulting color patterns displayed by the LED light elements for the various switch positions of the controller of the flat rope light string system of FIG. 2A according to the embodiment of FIG. 2A;

FIG. 3D depicts a chart illustrating the output leads energized by the power source and the resulting color patterns displayed by the LED light elements for the various switch positions of the controller according to one embodiment of FIG. 3A;

FIG. 4D depicts a chart illustrating the color assignments/pairings displayed by the LED light elements according to the embodiment of FIG. 4A;

FIG. 4E depicts a chart illustrating the output leads energized by the power source and the resulting color patterns displayed by the LED light elements for the various switch positions of the controller according to one embodiment of FIG. 4A

FIGS. 34A, 34B, and 34C depict a chart illustrating an exemplary color pattern displayed by the exemplary disclosed light elements according to one embodiment of the invention;

FIGS. 35A and 35B depict a chart illustrating an exemplary color pattern displayed by the exemplary disclosed light elements according to one embodiment of the invention;

FIGS. 36A, 36B, and 36C depict a chart illustrating an exemplary color pattern displayed by the exemplary disclosed light elements according to one embodiment of the invention;

FIGS. 37A and 37B depict a chart illustrating an exemplary color pattern displayed by the exemplary disclosed light elements according to one embodiment of the invention;

FIGS. 38A and 38B depict a chart illustrating an exemplary color pattern displayed by the exemplary disclosed light elements according to one embodiment of the invention;

FIGS. 39A and 39B depict a chart illustrating an exemplary color pattern displayed by the exemplary disclosed light elements according to one embodiment of the invention;

FIGS. 40A and 40B depict a chart illustrating an exemplary color pattern displayed by the exemplary disclosed light elements according to one embodiment of the invention;

FIGS. 41A and 41B depict a chart illustrating an exemplary color pattern displayed by the exemplary disclosed light elements according to one embodiment of the invention;

FIGS. 42A and 42B depict a chart illustrating an exemplary color pattern displayed by the exemplary disclosed light elements according to one embodiment of the invention;

FIGS. 43A and 43B depict a chart illustrating an exemplary color pattern displayed by the exemplary disclosed light elements according to one embodiment of the invention;

FIGS. 44A and 44B depict a chart illustrating an exemplary color pattern displayed by the exemplary disclosed light elements according to one embodiment of the invention;

FIGS. 45A and 45B depict a chart illustrating an exemplary color pattern displayed by the exemplary disclosed light elements according to one embodiment of the invention;

FIGS. 54A and 54B depict a chart illustrating an exemplary color pattern displayed by the exemplary disclosed light elements according to one embodiment of the invention.

DETAILED DESCRIPTION OF THE INVENTION

The various embodiments and variations thereof illustrated in the accompanying figures and/or described herein are merely exemplary and are not meant to limit the scope of the invention. It is to be appreciated that numerous variations of the invention have been contemplated as would be obvious to one of ordinary skill in the art with the benefit of this disclosure. Rather, the scope and breadth afforded this document should only be limited by the claims provided herein while applying either the plain meaning to each of the terms and phrases in the claims or the meaning clearly and unambiguously provided in this specification.

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention.

It is also to be understood that certain aspects of the present invention may be implemented in various forms of hardware, software, firmware, special purpose processors, or a combination thereof. Preferably, certain aspects of the present invention may be implemented in software as a program tangibly embodied on a program storage device. The program may be uploaded to, and executed by, a machine comprising any suitable architecture. Preferably, certain aspects of the invention are implemented on a computer platform having hardware such as one or more central processing units (CPU), a random-access memory (RAM), and input/output (I/O) interface(s). The computer platform may also include an operating system and microinstruction code. The various processes and functions described herein may either be part of the microinstruction code or part of the program (or combination thereof) which is executed via the operating system. In addition, various other peripheral devices may be connected to the computer platform such as an additional data storage device and a printing device.

Figure 1A:
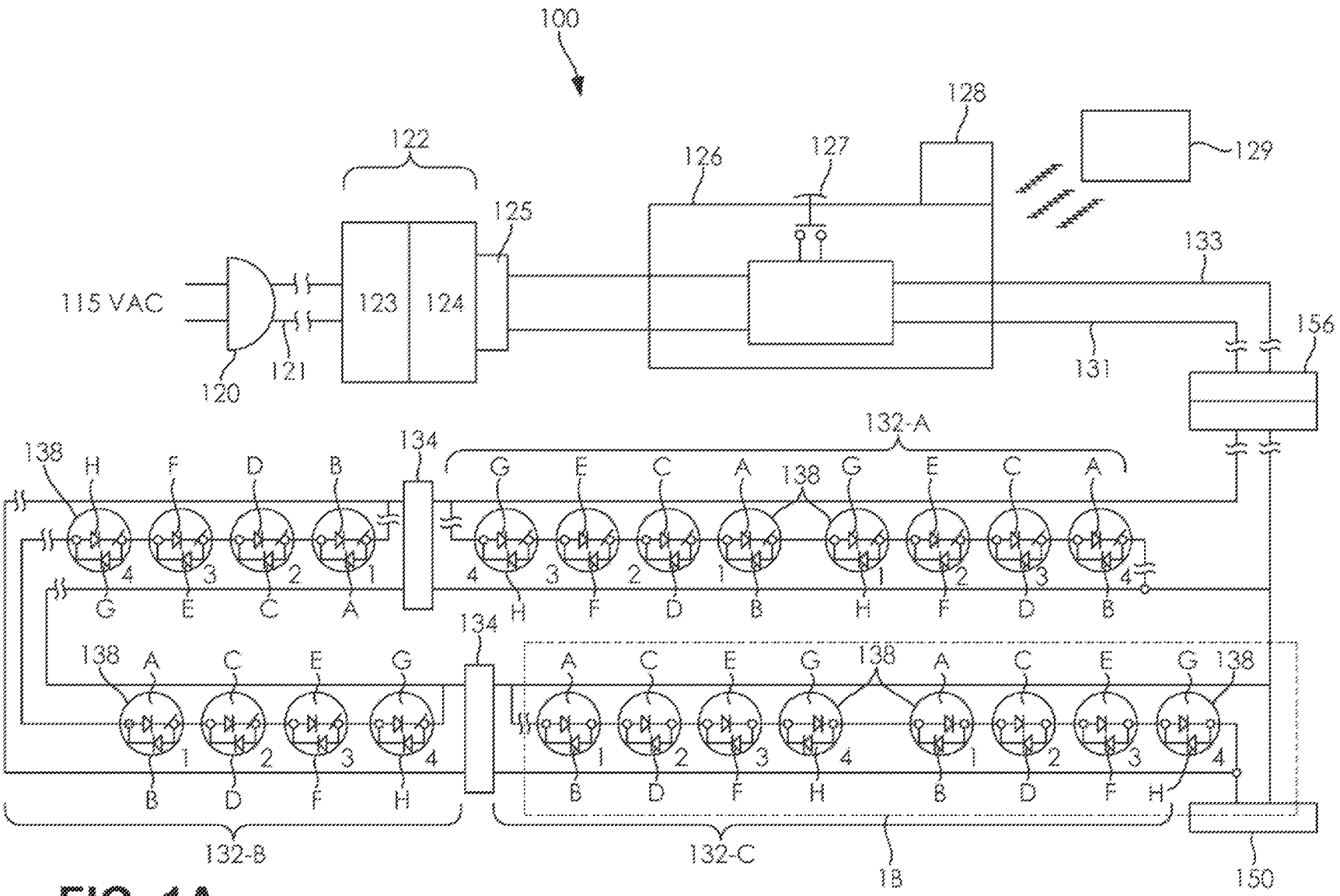
FIG. 1A is a circuit diagram of the invention according to one embodiment.

Although the physical construction and electrical circuit layout of the circuits have been specifically disclosed, those of skill in the art will appreciate that alternative physical constructions and electrical arrangements may exist to accomplish the above-described functions without departing from the teaching of the present invention FIGS. 1A-1F, illustrate a flat rope light string system in accordance with one embodiment of the present invention FIG. 1A shows a circuit diagram of a flat rope light string system 100 of the present invention. The flat rope light string system 100 includes a high-to-low voltage conversion and rectification module 122, a controller 126 and one or more light strings 132A-C. Three light strings are shown by way of example only. The high-to-low voltage conversion and rectification module 122 is connected at a first connection 121 to a high voltage power source 120, such as a typical 115V AC power source as found in a residence or a building. Connection 121 may be either polarized, meaning that it has only one connection orientation or unpolarized. The high-to-low voltage conversion and rectification module 122 is separated into two separate and discrete modules, namely, a voltage conversion module 123, for performing a high-to-low voltage conversion function and a rectification module 124 for performing a rectification function. The high-to-low voltage conversion and rectification module 122 may be composed of any known or heretofore developed commercial voltage converters such as those provided by power converters, power inverters, power adaptors or power transformers. The high-to-low voltage conversion and rectification module 122 is connected at a second connection 125 to the controller 126 including a manual switch 127 and a wireless receiver/transmitter head 128. Controller 126 provides various switching functions to control the light strings 132A-C of the light string system. Each of the three, light string 132A-C includes eight light elements 138, which are preferably bulb housings 138. Each light string 132A-C is wired in parallel between electrical connectors 131 and 133, with connector 133 being a common return. The light strings 132A-C are coupled together in series via harnesses 134, 150, 156. Harnesses 134, 150, 156 may be comprised of any of the standard male-female mating systems typically used for making electrical connections for light strings. Further, harnesses 134, 150, 156 may be polarized so that only one connection orientation is possible in making the mating connection between the two light strings.

While the present embodiment describes a flat rope light string system 100 having three LED light strings 132A-C, it is contemplated to utilize more or less light strings depending upon the application.

As stated above, the light strings 132A-C comprise eight bulb housings 138, each bulb housing 138 including a single dual color light-emitting diode (LED) pair (i.e., two LEDs) configured in a back-to-back orientation. Upon insertion of all the LED light elements {A/B, C/D, E/F, G/H} into sockets of the light strings 132A-C, the single lead circuit of the light strings are completed. It should be noted that the LEDs are arranged in the bulb housings in a back-to-back configuration such that a positive bias energizes a first LED of each LED pair and a negative bias energizes a second LED of each LED pair. Thus, the LEDs are biased and thereby illuminated in each light string 132A-C according to the following table:

TABLE I

| Connector ID | Applied Voltage | LED ID |
|---|---|---|
| 131 | Positive | Voltage applied to LED A |
| 131 | Negative | Voltage applied to LED B |
| 131 | Positive | Voltage applied to LED C |
| 131 | Negative | Voltage applied to LED D |
| 131 | Positive | Voltage applied to LED E |
| 131 | Negative | Voltage applied to LED F |
| 131 | Positive | Voltage applied to LED G |
| 131 | Negative | Voltage applied to LED H |

Notably, an applied positive voltage is applied to LED's {A,C,E,G} simultaneously. Similarly, an applied negative voltage is applied to LED's {B,D,F,H} simultaneously. Similarly, Controller 126 provides various switching functions to control the light strings 132A-C. It is understood that the flat rope light string system 100 may be organized in any feasible arrangement given the power supply capabilities of controller 126.

Operation of the switching functions of controller 126 is described as follows.

With switch button 127 of controller 126 positioned in a first rotary position, a positive polarity (+) DC voltage is conducted through the light strings 132A-C, coupled across conductor 131 and common return 133. In this first switch position, all of the positively biased LEDs within each of the respective bulbs housings 138 are illuminated, as further indicated in the table above. In accordance with the LED arrangement, a single-color positively biased LED from among the 2 LEDs of each LED pair will be illuminated in each bulb housing 138 in each light string 132A-C while positioned in this first rotary position.

With switch 127 of controller 126 positioned in a second rotary position, a negative polarity (−) DC voltage is conducted through the light strings 132A-C, coupled across conductor 131 and common return 133. In this second switch position, all of the negatively biased LEDs within each of the bulb housings 138 will be illuminated, as indicated in the table above. In accordance with the LED arrangement, a single-color negatively biased LED will be illuminated in each LED pair in each of the bulb housings 138 of light strings 132A-C. See table above.

According to the table above, the positively biased LEDs labeled {A, C, E, G} in each light string 132A-C will be illuminated by the first positive polarity (+) DC voltage in the first switch position. Thereafter, the negatively biased LEDs labeled {B, D, F, H} will be illuminated in each LED light string by the second negatively biased (−) DC voltage in the second switch position.

With switch 127 of controller 126 positioned in a third rotary position, with the input power maintained as 115 VAC and 120 Hz AC, both the positively biased LEDs {A, C, E, G} and the negatively biased LEDs {B, D, F, H} will be alternately illuminated as biased by an appropriate phase of the AC power cycle. More particularly, in this third switch position, the AC input power simultaneously provides two different DC power components, having two different polarities. For example, the two different polarities correspond to a positive DC level and a negative DC level, where each level (+/−) can range substantially between 18-24 volts DC. The different sets of LEDs {A, C, E, G} and {B, D, F, H} in each LED light string 132A-C appear to the eye to illuminate simultaneously in this third rotary position. In a practical application, the "flicker" that is taking place electrically through the alternation of the phases is likely to be imperceptible to the human eye and the light string will have the appearance of having all the LEDs, {A, C, E, G} and {B, D, F, H}, in each LED light string 132A-C on simultaneously. In this fashion, more than two colors may be obtained from a single light element.

Alternatively, or in addition, remote control capability may be added for switching the controller 126. For example, in an embodiment shown in FIG. 1A, wireless receiver/transmitter head 128 is included in controller 126 for coordinating wireless communication with remote 129 having its own wireless receiver/transmitter head. A push-button switch on the remote 129 is used to switch the switch position 127 of the controller and wireless signals are exchanged between the receiver/transmitter.

Figure 1B:
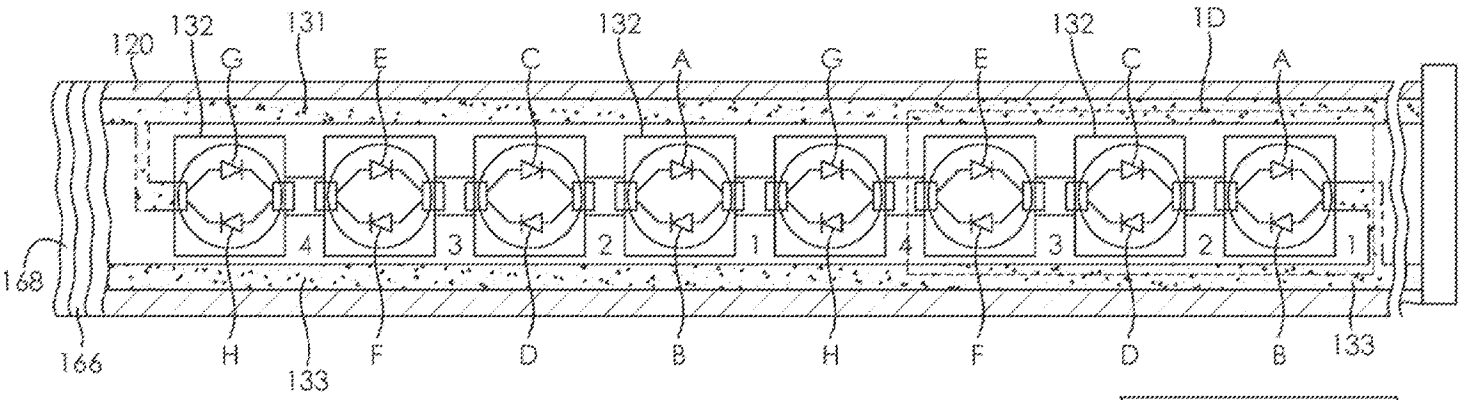
FIG. 1B depicts a top down partial cut-away view of a plurality of interconnected LED bulb housings comprising a portion of a flat rope light string system, according to one embodiment of the present invention.
Figure 1C:
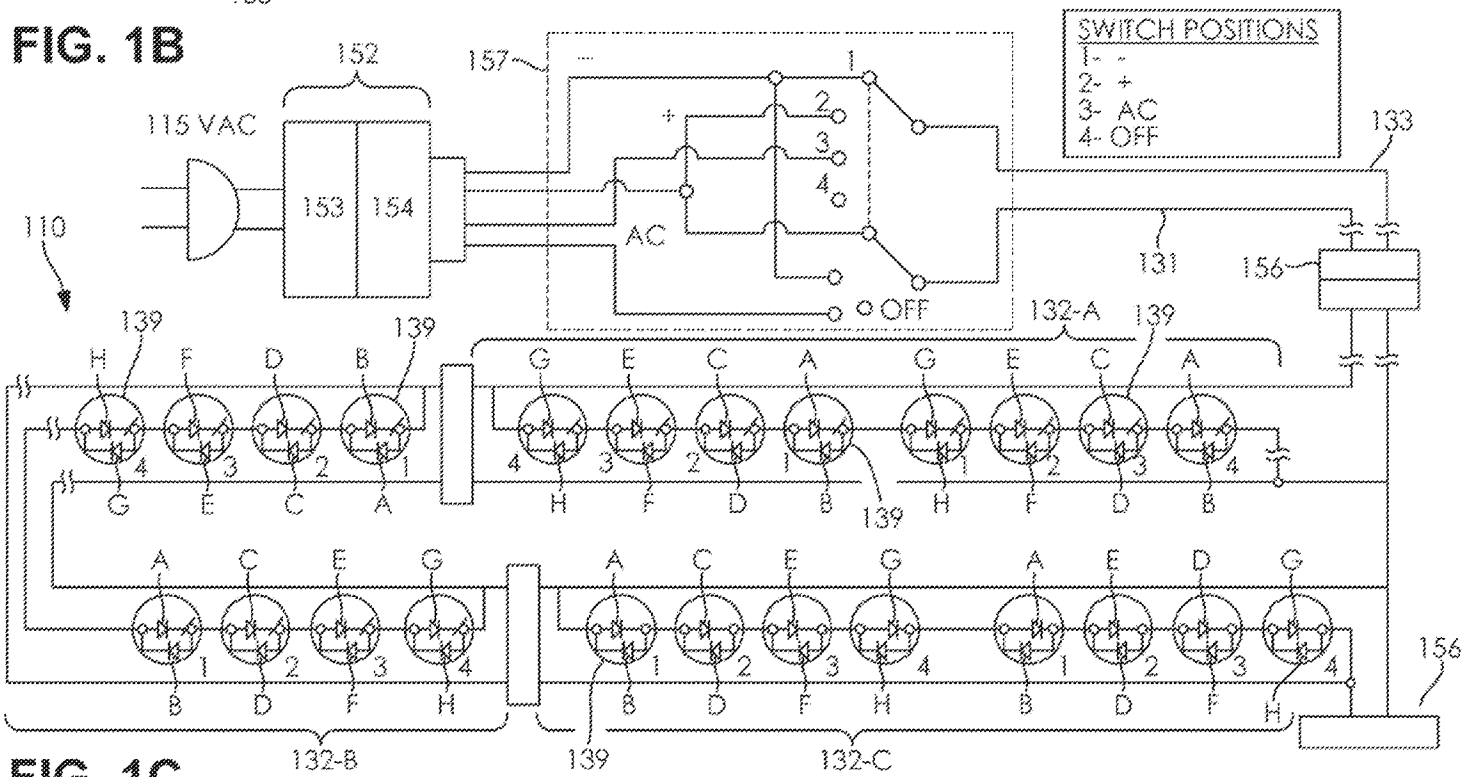
FIG. 1C is a circuit diagram of the invention according to one embodiment.

Referring now to FIG. 1C, there is shown a circuit diagram of a flat rope light string system 300 according to a variation of the first embodiment of the invention shown in FIG. 1A. That is, the flat rope light string system 300 includes many of the same components introduced in FIG. 1A above. However, one notable distinction between the two circuit representations is that in the present embodiment, there is shown a four-position rotary selection switch 157 which replaces controller 126 of the first embodiment. In contrast to the controller 126 of the first embodiment, which automatically sequences through the various phases of operation, i.e., first, second and third phase, as described above, in the present embodiment, sequencing through the various phases is performed manually via the four-position rotary selection switch 157, as shown in FIG. 1C. The four-position rotary selection switch 157 allows a user to manually select any of the previously described phases of operation, namely, (1) positive polarity DC voltage, (2) negative polarity DC voltage, and (3) 120 Hz AC voltage, with the fourth position of selection switch 157 being the OFF position. Notably, in each of the two embodiments described above, when a particular rotary switch position is selected or a controller selection is made, the predetermined illumination pattern will repeat continuously until the user actively selects a different rotary switch position or controller selection.

Figure 1D:
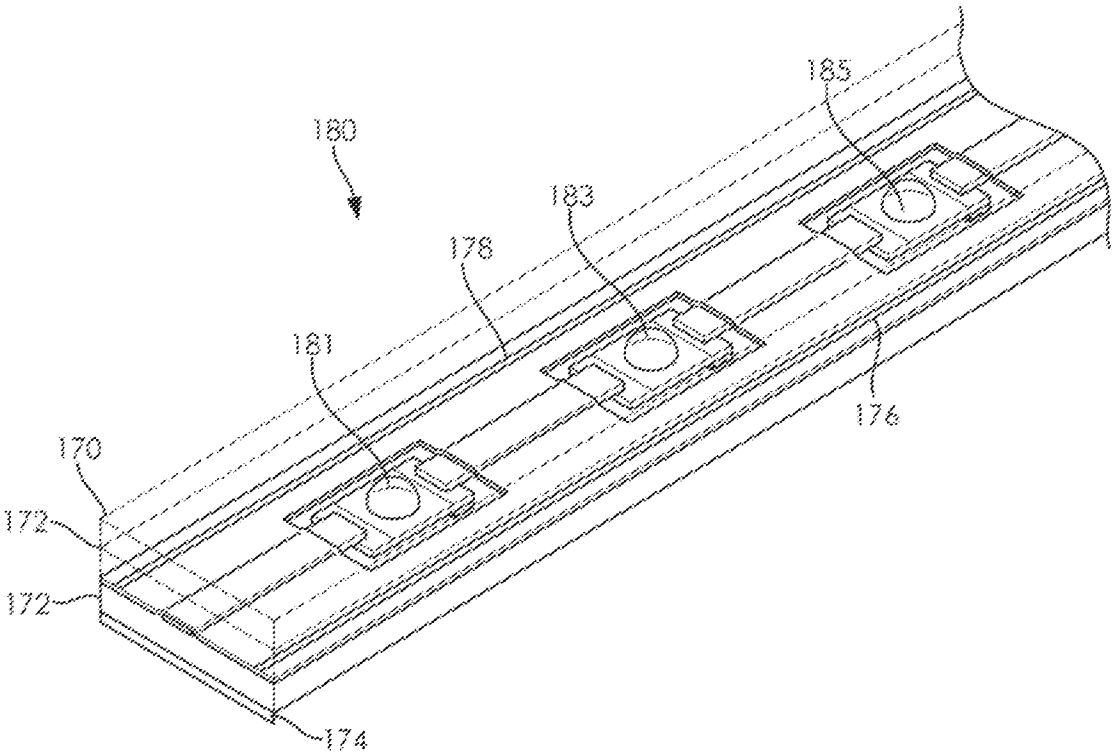
FIG. 1D depicts a perspective view of a portion of FIG. 1B according to one embodiment.

Referring now to FIG. 1D, a flat rope light string system 180 constructed in accordance with one embodiment of the invention comprises a plurality of LEDs 181, 183, 185 in series, (two of which are shown) electrically coupled to power leads 176, 178 in the insulator substrate 172 for powering the LEDs. When connected with a controller, such as the one shown in FIG. 1A or rotatory switch position selector as shown in FIG. 1C, for providing different illuminations, the LEDs 181, 183 will light up sequentially. Specifically, those LEDs coupled to the first power lead 176 will light up with the application of a positive polarity DC voltage (+). Upon switching from the first switch position to the second switch position, those LEDs coupled to the second power lead 178 will light up with the application of a negative polarity DC voltage (−). The power leads 176, 178 are shown on the same insulation substrate.

With reference back to the circuit depictions of FIG. 1A and FIG. 1C, in the third switch position of controller 126, a flashing effect of the flat rope light string system 180, as shown in FIG. 1D, is observed as alternating positive and negative polarity DC current being fed to power leads 176, 178. More particularly, as power lead 176 goes positive, power lead 178 simultaneously goes negative. This process is then reversed with power lead 176 going negative while power lead 178 simultaneously going positive. Advantageously, a flashing effect is achieved without the provision of diodes, as is required in conventional flat rope system constructions.

With continued reference to FIG. 1D, the flat rope light string system 180 is shown to be enclosed in a clear insulator 170, which comprises a flat rectangular section. In the present embodiment, an adhesive layer 174 is mounted to an insulator substrate 172. The adhesive layer 174 includes a first adhesive material on the bottom side of the adhesive layer 174 and a second adhesive material on the top side of the adhesive layer 174. The insulator substrate 172, may include one or more sheets of ceramic, metal, laminate, circuit board, Mylar, or another suitable material. A plurality of apertures 185 are provided for receiving the LEDs 181, 183 and screws.

According to one aspect, the apertures 185 for housing the LEDs lie axially and centrally along the length of the insulator substrate 172. However, it is contemplated that the apertures can lie in a different pattern in other embodiments. The apertures 185 provide a novel and convenient means to provide power to the LEDs 181, 183 and are known to people having ordinary skill in the art. However, other means for conveying power to the LEDs 181, 183, as will be described in detail below.

In contrast to the circuit construction of the invention, shown in FIGS. 1B and 1D, there is shown a top down partial cut-away view of a flat rope LED light string 190 construction according to the prior art. The circuit construction of the present invention provides numerous advantages and overcomes the drawbacks associated with such prior art constructions, such as the one shown in FIG. 1G, described as follows.

Figure 1G:
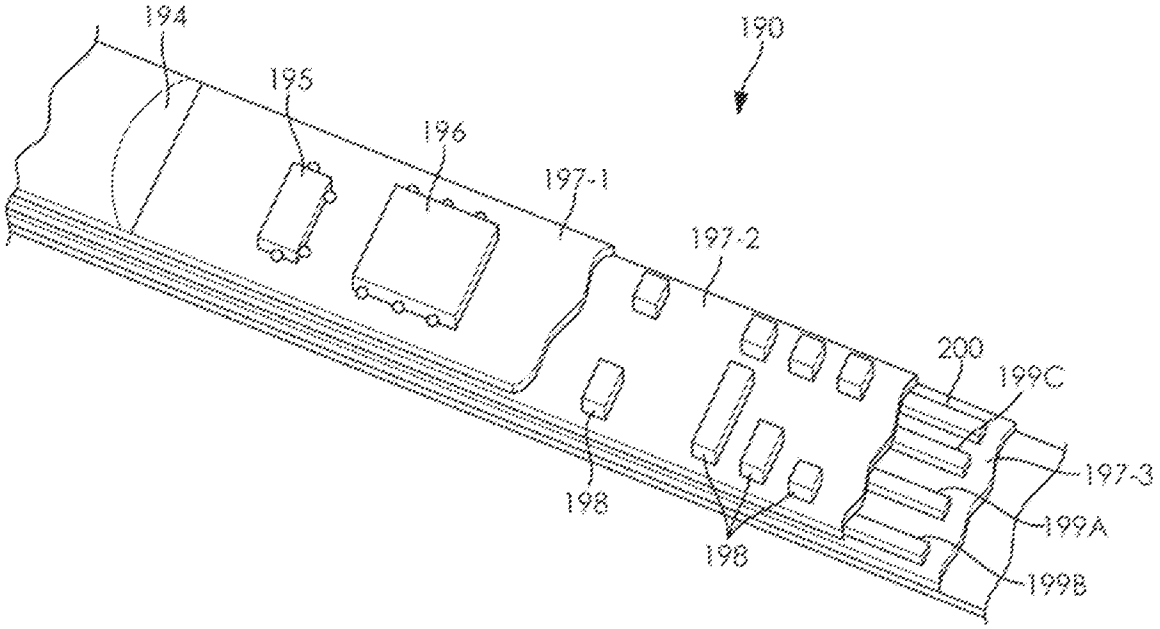
FIG. 1G (PRIOR ART)
FIG. 1G depicts a top down partial cut-away view of a plurality of interconnected LED bulb housings of a conventional flat rope light string system, according to the prior art.

A drawback of existing flat rope LED systems of the prior art, such as the one shown in FIG. 1G, relates to the complexity of their construction. The conventional flat rope LED system 190 shown in FIG. 1G includes a plurality of interconnected LED bulb housings, embedded within component 196 on the first layer of a multi-layer construction. Specifically, component 196 on the first layer 197-1 includes 3 LED bulb housings with 3 different colored LEDs per housing, sometimes referred to in the art as a segment. The 3 LED bulb housings are typically arranged in parallel within a segment, with each LED bulb housing in the segment being sourced from a separate power lead and a common return lead. The conventional flat rope LED system 190 shown in FIG. 1G includes a clear insulation layer 194, as a top layer, below which there is shown the aforementioned first layer 197-1 which includes: component 196 including 3 LED bulb housings, a plurality of resistors 195, one for each different color LED in the 3 LED bulb housings. For example, in an embodiment, an LED bulb housing 196 may include 3 different colored LEDs (e.g., Red, Blue, Green), which would require a need for 3 resistors for each segment, one resistor per color, where a segment comprises 3 LED bulb housings in parallel.

The conventional flat rope LED system 190 shown in FIG. 1G further includes a number of jumper conductors 198 on a second layer 197-2. The jumper conductors 198 of the second layer 197-2 allow each LED in the LED bulb housing 196 of the first layer to connect to its dedicated power source via dedicated power leads shown on the third layer 197-3 via plated thru holes (not shown). Three dedicated LED power leads 199A-C are shown on the third layer 197-3. LED power lead 199A sources a first LED of the 3 segment LED 196 of layer 197-1. LED Power lead 199B sources a second LED of the 3 segment LED 196 of layer 197-1, and LED Power lead 199C sources a third LED of the 3 segment 196 of layer 197-1. There is also shown a common lead 200 on layer 197-3 corresponding to the power leads 199A-C.

As stated above, a drawback of existing flat rope LED systems of the prior art, such as the one shown in FIG. 1G, relates to the complexity of their construction. More particularly, conventional flat rope LED systems have multi-layers of foil conductors, such as the three-layered construction 197-1, 197-2, 197-3 as shown in FIG. 1G. A disadvantage of such a multi-layer construction is the need to use jumpers to connect the LED bulb housing 196 on layer 197-1 with the lower layer LED power conductors 199A-C on layer 197-3. A further disadvantage is that jumper conductors 198 are also required, on the intermediate layer 197-2 for connecting the three LEDs 196 on layer 197-1, the power lead layer 197-2, including common lead 200. A further drawback of conventional flat rope LED systems is the need for additional components, such as resistors and capacitors. For example, FIG. 1G includes resistor 195 which is typically mounted on the top layer 197-1 to adjust the voltage level.

FIG. 1B is a top down partial cut-away view of the circuit configuration of FIG. 1D which includes a plurality of interconnected LED bulb housings 132 where pairs of LEDs in each housing (e.g., pairs A/B, C/D, E/F, G/H) are coupled together in a novel back-to-back configuration, as described herein. Further elements of the construction include, an adhesive layer 168, an insulation layer 166 adjacent to the adhesive layer 168, two primary current carrying connectors 131, 133, and an AC wall plug connector 120. The aforementioned drawbacks of existing flat rope LED light string systems is overcome by the circuit configuration of FIG. 1B. These advantages include, but are not limited to, optimized device placement, back-to-back placement of LEDs, minimized component count and utilization of a single layer foil conductor. Each advantage will be described in further detail as follows.

A first advantage afforded by the circuit construction of embodiments of the invention, as exemplified by the circuit construction of FIG. 1B, is the placement of the LEDs in a back-to-back configuration. See, for example, LEDs {A/B}, {C/D}, {E/F}, {G/H], shown arranged in a back-to-back configuration in FIGS. 1A, 1C, 2A, 3A and 4A. The back-to-back configuration of the LED pairs advantageously removes the need for multiple separate power leads to each LED, such as the three separate power leads 199A-C shown in the prior art circuit construction of the flat rope LED light string system FIG. 1G. The back-to-back circuit construction advantageously uses the same conductors, instead of multiple separate power leads, but by reversing the polarity in operation, the individual LEDs illuminate alternatingly. If the LEDs were on separate dedicated leads, as shown in FIG. 1G, then an additional lead would be required. More particularly, the additional lead could be a common return lead, with the overall requirement being three leads required in total, (i.e., a power lead for each of the two LEDs of the LED pair and a shared common lead.

A second advantage afforded by the circuit construction of embodiments of the invention, is the absence of resistors and capacitors on the top layer of the flat rope LED system, such as those shown in the prior art construction of FIG. 1G. The need for these additional components (i.e., resistors and capacitors) is overcome by the circuit construction of the invention by virtue of installing these additional components in the controller and accommodating this change by matching the series of LEDs to the output of the controller.

A third advantage afforded by the circuit construction of embodiments of the invention, is the use of a single layer of foil conductors. In contrast to using a single layer of foil of conductors, the prior art construction of FIG. 1G utilizes multiple foil layers (e.g., three or more layers). More particularly, referring to FIG. 1G, a lower layer foil conductor 197-3 supplies the various power leads or conductors for each different colored LED and the common return. A separate middle or adjoining foil layer 197-2 provides jumper conductors from the individually colored LEDs in each housing on the upper layer 197-1 to the power leads 199A-C and common lead 200 on the lower layer 197-3.

Notably contact between the upper layer jumpers and the lower layer power leads and is made by a "Plated thru" type of connection.

FIG. 1E is a color assignment/pairings chart describing the LED bulb color assignments and bulb color pairings in the LED bulb housings 138 of the first embodiment and the LED bulb housings 139 of the second embodiment.

With reference to FIGS. 1C and 1E, LED "A" is shown paired with LED "B" in a back-back configuration in the first bulb housing of respective LED light strings 132-A through 132-C. LED "A" is pre-selected at the factory as a "white" bulb and LED "B" is pre-selected at the factory as a "red" bulb. In an embodiment, the bulb colors may be selected by a user/customer at the time of manufacture from among a plurality of manufacturer display options. Alternatively, a customer could request different color combinations of their own choosing.

FIG. 1F is a color output chart associated with the color assignment/pairings chart of FIG. 1E. The color output chart describes the resulting illumination (i.e., actual color output) of a particular flat rope light string system as the flat rope light string system is cycled through its various energized states of operation, described as follows.

Referring to row 1 of the color output chart of FIG. 1F, there is shown resulting illuminations for the three switch positions of the respective controllers 127, 157 illustrated in FIGS. 1A and 1C. In a first switch position, under control of controller 127, 157, a positive polarity DC voltage is generated by the light system thereby energizing LEDs "A", "E", "I" and LEDs "M" "A, C, E and G" in each of the LED light strings 132A-C of flat rope light string systems 100, 110 of FIGS. 1A and 1C. In this first switch position, the resulting illumination (i.e., actual color output) is selected to be white corresponding to both everyday events and Christmas as shown in the last column of the chart of FIG. 1F.

Upon switching the controller 127, 157 from the first switch position to the second switch position, a negative polarity DC voltage is generated energizing LEDs "B", "F", "J", "N" and LEDs "B, D, F and H" in each of the LED light strings 132A-C of flat rope light string systems 100, 110 of FIGS. 1A and 1C. In this second switch position, the resulting illumination (i.e., actual color output) will be a combination of "red, green, yellow, blue" corresponding to Christmas, as shown in the last column of the chart.

Upon switching the controller 127, 157 from the second switch position to the third switch position, an alternating 120 Hz output is generated that generates an alternating positive polarity DC voltage and negative polarity DC voltage, as described above, at a rate of 120 Hz. In this third switch position, the resulting illumination (i.e., actual color output) will be white a combination of pastel colors corresponding to Easter, as shown in the last column of the chart.

Although the physical construction and electrical circuit layout illustrated in FIGS. 1A and 1C have been specifically disclosed, those of skill in the art will appreciate that alternative physical constructions and electrical arrangements may exist to accomplish the above-described functions without departing from the teaching of the present invention Referring now to FIGS. 2A-2E, schematic diagrams and associated charts illustrating a flat rope light string system in accordance to with a further embodiment of the present invention are shown.

Figure 2A:
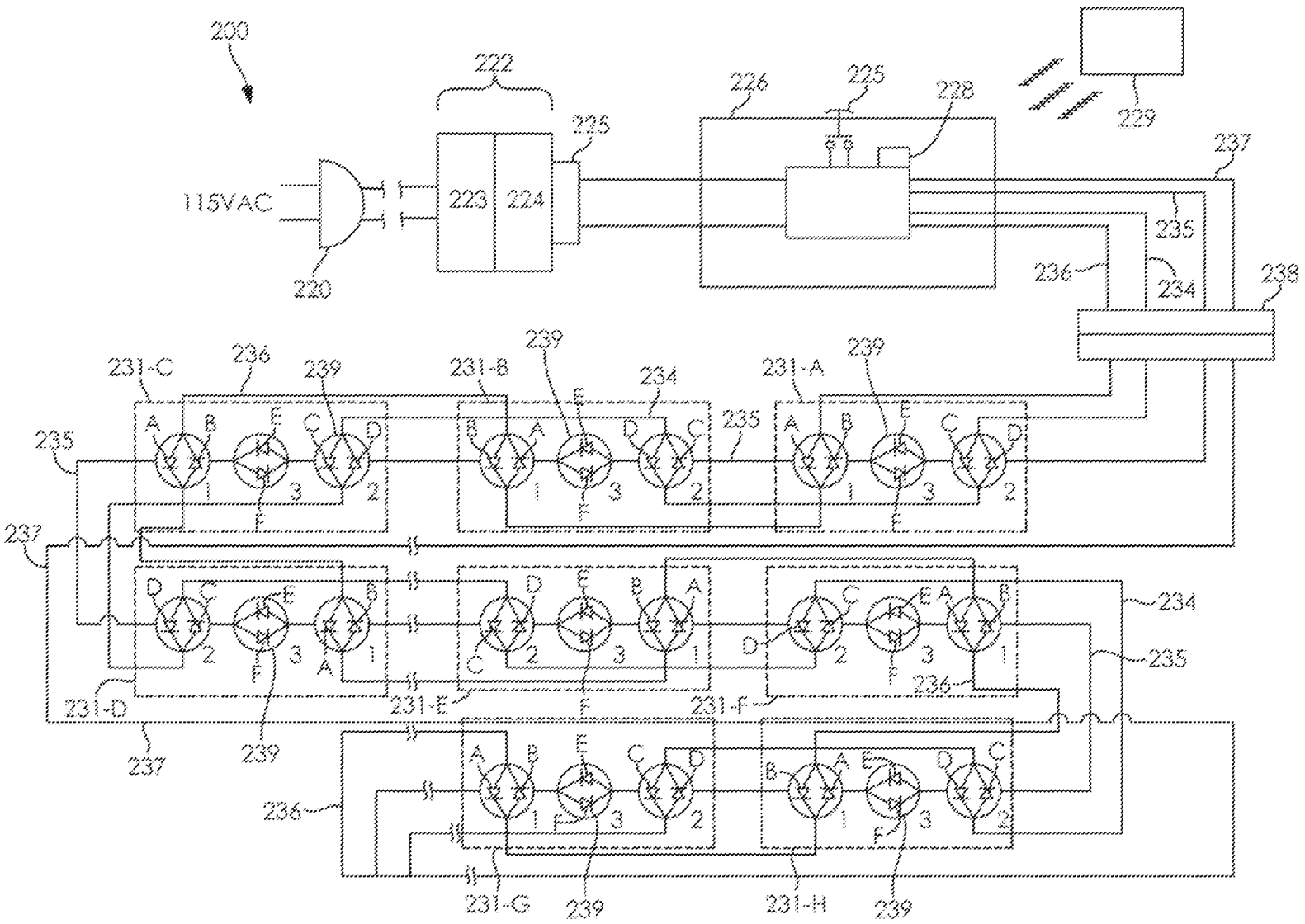
FIG. 2A depicts a circuit diagram of a flat rope light string system according to one embodiment.

Referring to FIG. 2A, there is shown a flat rope light string system 200 including a controller 226, a high-to-low voltage conversion and rectification module 222, and eight light strings 231A-H. Each light string 231A-H comprises 3 LED bulb housings 239. Each light string 231A-H is coupled to controller 226 in parallel. The flat rope light string system 200 of the present embodiment utilizes 8 light strings, each comprising 3 LED bulb housing, each bulb housing including 3 LED pairs provide a more robust set of illuminations than what may be achieved from the circuit diagrams of the embodiments shown in FIGS. 1A and 1C, as described above. More particularly, by providing 3 LED pairs per bulb housing in the present embodiment instead of 2 LED pairs per bub housing, as described in the previous embodiment, a wider variety of lighting combinations can be provided.

Alternatively, or in addition, remote control capability may be added for switching the controller 226. Wireless receiver/transmitter head 228 may be included in controller 226 for coordinating wireless communication with remote 229 having its own wireless receiver/transmitter head (not shown). A push-button switch on the remote is used to switch the switch position of the controller and wireless signals are exchanged between the receiver/transmitter.

Although the physical construction and electrical circuit layout of FIG. 2A have been specifically disclosed, those of skill in the art will appreciate that alternative physical constructions and electrical arrangements may exist to accomplish the above-described functions without departing from the teaching of the present invention.

Figure 2B:
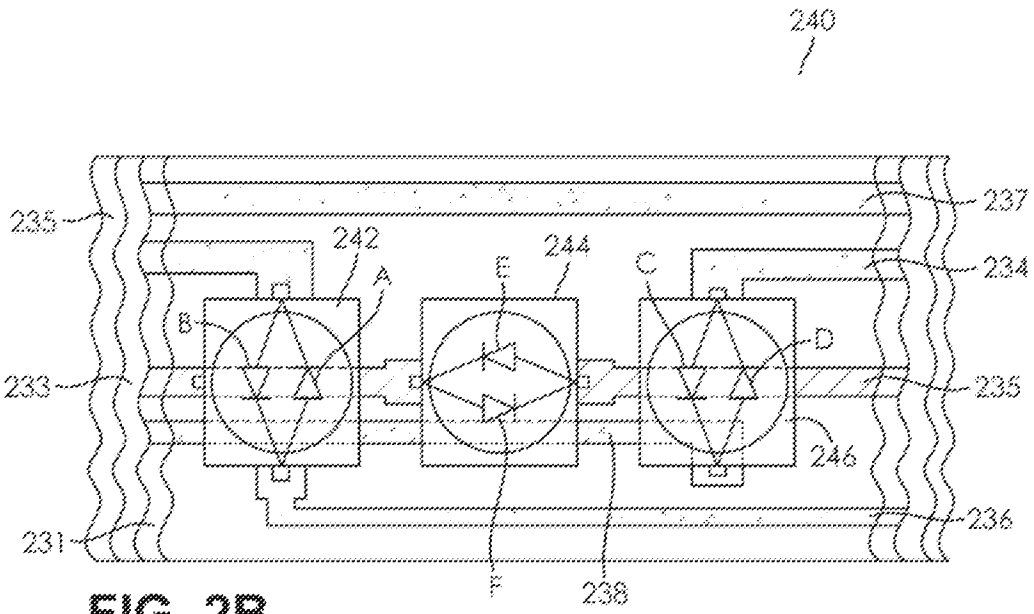
FIGS. 2B & 2C depict a top down partial cut-away view and a side cut-away view of three interconnected LED bulb housings of the flat rope light string system of FIG. 2A according to one embodiment of the present invention.

Referring now to FIG. 2B there is a top down view of a circuit layout of a portion of the circuit of FIG. 2A. The circuit layout 240 of FIG. 2B comprises sticky backing layer 235 as the outermost layer. On top of sticky backing layer 235, there is shown insulating substrate layer 233. A single layer of conductors 234, 235, 236 and 237 allows the LED pairs to be connected in a back-to-back configuration. The entire circuit layout is encapsulated at the uppermost layer with a clear insulator layer 231.

The circuit layout 240 of FIG. 2B provides unique advantages over conventional circuit layouts in a number of aspects. These aspects include, for example, circuit conductor layout and LED bulb housing arrangements, to be described as follows.

In one aspect, a key difference between the circuit construction shown in FIG. 2B and conventional circuit layouts, such as the one shown in FIG. 1G, is the placement of the single layer of conductors 234, 235, 236, 237 on the insulating substrate layer 233 to take advantage of the insulated bottom of the LED bulb housings. Specifically, the insulated housings 242 and 246 straddles the multiple conductors 234, 235, 236, 237 to allow the LEDs to be interconnected in a novel back-to-back configuration without the need for jumper wires to bridge the connection between the conductors and the LEDs.

In a further aspect, a second key difference between the circuit construction shown in FIG. 2B and conventional circuit layouts, such as the one shown in FIG. 1G, is the unique orientation of the bulb housing arrangements 242, 244, 246. Specifically, the housing arrangements shown in FIG. 2B are uniquely oriented to preclude the need for jumper wires, described below, or a second level of conductors, thereby saving manufacturing steps and costs and thereby yield a more compact footprint. Specifically, LED bulb housing 244 houses LED Pair (E/F), which is oriented at 90 degrees with respect to the adjacent housings LED housing 242 housing LED Pair (AB), to the left of LED Pair (E/F), and LED housing 246 housing LED Pair (C/D), to the right of LED Pair (E/F). By only changing the orientation of the middle LED bulb housing 244 with respect to the left and right housings 242, 246, current carrying conductors 235, 238 advantageously pass directly underneath the middle housing. Such an arrangement advantageously precludes the need for jumper wires or a second level of conductors, thereby saving manufacturing steps and costs. It should be understood that by placing all of the housings in the same orientation, as is done conventionally, jumper wires would be required because the leads would have to be in parallel making the flat rope wider and the jumper wires would have to reach over some of the conductors (leads) to attach to desired conductors. Alternatively, instead of utilizing jumper wires, the housings would be required to be much wider to accommodate different attachment points to connect to each set of parallel conductors.

Figure 2C:
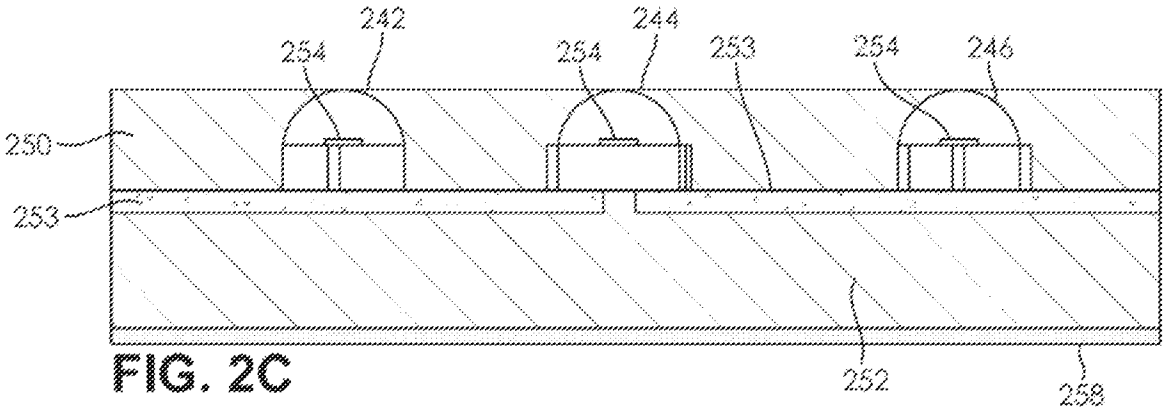

FIG. 2C is a cross sectional view of the partial circuit representation of FIG. 2B. The circuit layout of FIG. 2C comprises sticky backing adhesive layer 258 as the outermost layer. On top of sticky backing layer 258, there is shown insulating substrate layer 252. The entire circuit layout is encapsulated at the uppermost layer with a clear insulator layer 250. Embedded in the clear insulation layer 252 there is shown LEDs 254 in respective lens bulb housings 242, 244, 246. The LEDs in housing 244 being powered by power lead 253.

FIG. 2D is a color assignment/pairings chart describing the bulb color assignments and bulb color pairings in the LED bulb housings 239 of FIG. 2A. FIG. 2D will be described with respect to the first two rows of the chart.

TABLE II

| ROW | LED ID | LIGHT STRING SET ID | BULB ID | BULB COLOR | COLOR PAIRINGS |
|---|---|---|---|---|---|
| 1 | A | 231-A | BULB 1 | ORANGE | ORANGE/WHITE |
| 2 | B | 231-A | BULB 1 | WHITE | ORANGE/WHITE |

LED "A" is paired with LED "B" in a back-to-back configuration in a first bulb housing 239 of string set 231-A. LEDs "A" and "B" are pre-selected at the time of manufacture as "white" and "orange". The pre-selected color pairings allow for certain desired display patterns (e.g., Christmas, everyday events, national holidays, etc.) which illuminate in various switch positions of the light string system. The illuminations are described in detail in the color output chart of FIG. 2E.

FIG. 2E is a color output chart associated with the color assignment chart of FIG. 2D. The color output chart describes the actual color output (i.e., resulting illumination) of the circuit of FIG. 2A when cycled through its various energized states of operation via switch positions 1-12.

With reference to the color output chart of FIG. 2E, the various energized states of operation are described with reference to the switch positions 1-12. Referring to the first row of the chart, In a first switch position, selectable via controller 226, a positive polarity DC voltage (+) will be output by the controller 226 on lead 236 energizing LED "A" of bulb 1 in parallel in each of the eight string sets 231-A through 231-H. This results in an "orange" illumination pertaining to the Christmas holiday, as shown in the last column of FIG. 2E.

With reference to row 2 of the color output chart of FIG. 2E, in a second switch position selectable via controller 226, a negative polarity DC voltage (−) will be output by the controller 226 on lead 236 energizing LED "B" in in each of the eight string sets 231-A through 231-H. This results in a purely white illumination pertaining to both everyday events and the Christmas holiday, as shown in the last column of the chart of FIG. 2E.

With reference to row 3 of the color output chart of FIG. 2E, in a third switch position selectable via controller 226, a positive polarity DC voltage (+) will be output by the controller 226 on lead 234 energizing LED "C" in in each of the eight string sets 231-A through 231-H. This results in a green illumination pertaining to the Christmas holiday, as shown in the last column of the chart of FIG. 2E.

With reference to row 4 of the color output chart of FIG. 2E, in a fourth switch position selectable via controller 234, a negative polarity DC voltage (−) will be output by the controller 226 on lead 234 energizing LED "D" in in each of the eight string sets 231-A through 231-H. This results in a blue illumination pertaining to the Christmas holiday, as shown in the last column of the chart of FIG. 2E.

With reference to row 5 of the color output chart of FIG. 2E, in a fifth switch position selectable via controller 226, a polarity DC voltage (+) will be output by the controller 226 on lead 235 energizing LED "E" in in each of the eight string sets 231-A through 231-H. This results in a purple illumination pertaining to the Christmas holiday, as shown in the last column of the chart of FIG. 2E.

With reference to row 6 of the color output chart of FIG. 2E, in a sixth switch position selectable via controller 226, a negative polarity DC voltage (−) will be output by the controller 226 on lead 235 energizing LED "F" in in each of the eight string sets 231-A through 231-H. This results in a red illumination pertaining to the Christmas holiday, as shown in the last column of the chart of FIG. 2E.

With reference to row 7 of the color output chart of FIG. 2E, in a seventh switch position selectable via controller 226, a negative polarity DC voltage (−) will be output by the controller 226 on leads 234, 235, 236 energizing LEDs "B", "D", "F", in in each of the eight string sets 231-A through 231-H. This results in a red, white and blue illumination pertaining to United States National holidays, as shown in the last column of the chart of FIG. 2E.

With reference to row 8 of the color output chart of FIG. 2E, in an eighth switch position selectable via controller 226, a positive polarity DC voltage (+) will be output by the controller 226 on leads 235, 236 energizing LEDs "A", "E", in in each of the eight string sets 231-A through 231-H. This results in an orange and purple illumination pertaining to Mardi Gras and Halloween events, as shown in the last column of the chart of FIG. 2E.

With reference to row 9 of the color output chart of FIG. 2E, in a ninth switch position selectable via controller 226, a negative polarity DC voltage (−) will be output by the controller 226 on lead 236 energizing LED "B" in each of the eight string sets 231-A through 231-H. The controller 226 also provides a positive (+) DC current on lead 234 resulting illumination of LED C in each of the 8 string sets 231-A through 231-H. This results in a purely "White and Green Alternating illumination for Christmas and St. Pat's day holiday, as shown in the last column of the chart of FIG. 2E.

With reference to row 10 of the color output chart of FIG. 2E, in a tenth switch position selectable via controller 226, a negative polarity DC voltage (−) will be alternatingly output with a positive polarity DC voltage (+) by the controller 226. The negative polarity DC voltage (−) will be output on lead 236 energizing LED "A" and, in alternation with positive polarity DC voltage (+) being output on lead 235 energizing LED "C" in in each of the eight string sets 231-A through 231-H. This results in an alternating illumination of green and white pertaining to both the Christmas holiday and St. Patrick's, as shown in the last column of the chart of FIG. 2E. The rate of alternation can be varied and can be, for example, a 1 second rate of alternation.

With reference to row 11 of the color output chart of FIG. 2E, in an eleventh switch position selectable via controller 226, a negative polarity DC voltage (−) will be output by the controller 226 on lead 236 energizing LED "B" in in each of the eight string sets 231-A through 231-H. A positive polarity DC voltage (+) will be output by the controller 226 on lead 234 energizing LED "C" in in each of the eight string sets 231-A through 231-H. A negative polarity DC voltage (−) will be output by the controller 226 on lead 235 energizing LED "F" in in each of the eight string sets 231-A through 231-H. This results in a white, green and red illumination pertaining to both the Christmas holiday, and Italian and Mexican national holidays, as shown in the last column of the chart of FIG. 2E.

With reference to row 12 of the color output chart of FIG. 2E, in a twelfth switch position selectable via controller 226, a positive polarity DC voltage (+) will be output by the controller 226 on lead 236 energizing LED "A" in in each of the eight string sets 231-A through 231-H, followed by a positive polarity DC voltage (+)output by the controller 226 on lead 236 energizing LED "C" in in each of the eight string sets 231-A through 231-H, followed by a negative polarity DC voltage (−)output by the controller 226 on lead 235 energizing LED "F" in in each of the eight string sets 231-A through 231-H, followed by a negative polarity DC voltage (−)output by the controller 226 on lead 234 energizing LED "D" in in each of the eight string sets 231-A through 231-H. This sequence will repeat in alternating fashion resulting in an orange, green, red and blue illumination pertaining to the Christmas holiday, as shown in the last column of the chart of FIG. 2E.

Referring now to FIGS. 3A-3D, schematic diagrams and associated charts illustrating a flat rope light string system 300 in accordance with another embodiment of the present invention are shown.

Figure 3A:
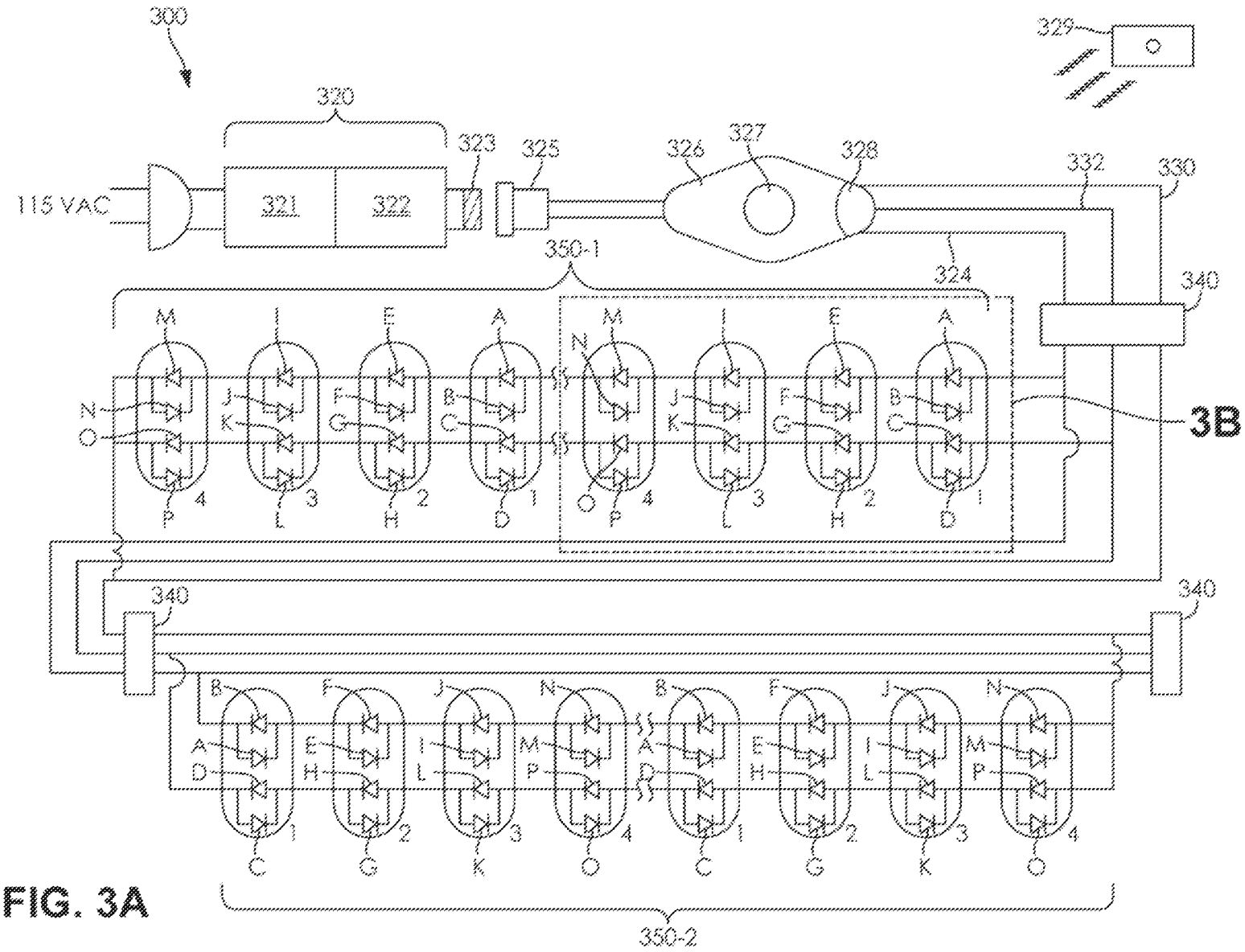
FIG. 3A depicts a circuit diagram of a flat rope light string system according to one embodiment.

Referring initially to FIG. 3A there is shown a flat rope light string system 300 including a controller 326, a high-to-low voltage conversion and rectification module 320, and light strings 350-1 and 350-2. The high-to-low voltage conversion and rectification module 320 is shown separated into two separate and discrete modules, 321, 322. A voltage conversion module 123 performs a high-to-low voltage conversion function and a rectification module 124 performs a rectification function. The high-to-low voltage conversion and rectification module 321 is connected at a first connection point to a high voltage power source 324, such as a typical 115V AC power source as found in a residence or a building. Connection 324 may be either polarized, meaning that it has only one connection orientation or un-polarized. The high-to-low voltage conversion and rectification module 322 may be composed of any known or heretofore developed commercial voltage converters such as those provided by power converters, power inverters, power adaptors or power transformers. The high-to-low voltage conversion and rectification module 322 is connected at a second connection point to a controller 326 including a manual switch 327 and a wireless receiver/transmitter head 328. Controller 326 provides various switching functions to control the various LED light strings 350-1 and 350-2.

The flat rope light string system 300 includes two LED light strings 350-1 and 350-2, where each string set comprises eight LED bub housings 353. Each LED light string 350-1 and 350-2 is wired in parallel between electrical connectors {324 and common 330} and {332 and common 330}. The LED light strings sets 350-1 and 350-2 are coupled together via a harness 340. Harnesses 340 may be comprised of any of the standard male-female mating systems typically used for making electrical connections for light strings. Further, harnesses 340 may be polarized so that only one connection orientation is possible in making the mating connection between the two light strings.

Each LED bulb housing 353 of LED light string sets 350-1 and 350-2 is comprised of 2 pairs of dual color LEDs, for a total of four LEDs per bulb housing 353. For example, LED bulb housing 1 of each string set 350-1 and 350-2 is comprised of two LED pairs. For example, in one bulb housing 353 there is shown a first LED pair (A,B) and a second LED pair (C,D).

Each of the LEDs in the respective LED pairs having a back-to-back configuration, as described above.

Although the physical construction and electrical circuit layout of FIG. 3A have been specifically disclosed, those of skill in the art will appreciate that alternative physical constructions and electrical arrangements may exist to accomplish the above-described functions without departing from the teaching of the present invention.

Figures 3B, 3C:
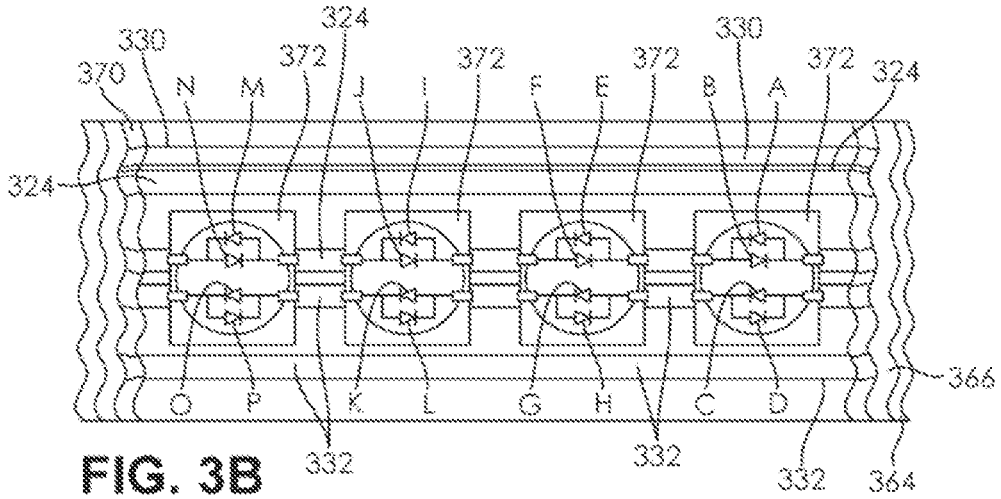
FIG. 3B depicts a top down partial cut-away view of a plurality of interconnected LED bulb housings of a flat rope light string system according to the embodiment of FIG. 3A.
FIG. 3C depicts a depicts a chart illustrating the color assignments/pairings displayed by the LED light elements of the flat rope light string system of FIG. 3A.

FIG. 3C is a color assignment/pairings chart describing the bulb color assignments and bulb color pairings in the LED bulb housings in the light strings 350-1 and 350-2. Referring to the first and second rows of the chart, as reproduced in Table III below, there is shown LEDs "A" and "B", which are paired, pre-selected as "White/Yellow". Color selection, placement and pairings of the LEDs at the time of manufacture provides the means for displaying colors associated with the various holidays and events, as shown in the color output chart of FIG. 3D.

TABLE III

| ROW | LED ID | BULB ID | BULB COLOR | COLOR PAIRINGS |
|---|---|---|---|---|
| 1 | A | BULB 1 | WHITE | WHITE/YELLOW |
| 2 | B | BULB 1 | YELLOW | WHITE/YELLOW |

With reference now to FIG. 3D, there is shown the resulting illumination states of the light strings 350-1 and 350-2 of the circuit of FIG. 3A, as the circuit is cycled through its various energized states of operation.

In operation, AC electrical power (e.g. 115 VAC) is provided to the HI/LO-AC/DC adapter 320. With push button switch 327 positioned to select a first switch position, a positive polarity DC voltage (+) is conducted through the LED light strings 350-1 and 350-2, coupled across connectors 324 and 330 (common). Each positively biased LED within each of the four bulb housings of LED light strings 350-1 and 350-2, coupled in parallel to connectors 324 and 330, will be simultaneously illuminated in this first switch position. For example, in the first switch position positively biased LEDs (A, E, I, M) of bulb housings 1-4 in each of LED light string 350-1 and 350-2 will be positively biased and will be illuminated in accordance with the positive polarity DC voltage (+).

Depressing push button switch 327 a second time results in the selection of a negative polarity DC voltage (−) conducted through the LED light strings 350-1 and 350-2, coupled across connectors 324 and 330. Each negatively biased LED coupled across connectors 324 and 330 within each bulb housing will be illuminated in this second switch position. For example, LEDs (B, F, J, N) will be negatively biased in this second switch position and will be illuminated in accordance with the negative polarity DC voltage (−).

Depressing push button switch 327 a third time results in the selection of a positive polarity DC voltage (+) conducted through the LED light strings 350-1 and 350-2, coupled across the connectors 322 and 330. Each positively biased LED within each bulb housing coupled to connectors 322 and 330 will be illuminated in this third switch position. For example, LEDs (C, G, K, O) will be positively biased and will be illuminated in accordance with the positive polarity DC voltage (+).

Depressing push button switch 327 a fourth time results in the selection of the positive polarity DC voltage (+) conducted through the LED light strings 350-1 and 350-2, coupled across connectors 322 and 330. Each positively biased LED coupled across connectors 322 and 330 within each bulb housing coupled to connectors 322 and 330 will be illuminated in this fourth switch position. For example, LEDs (D, H, L, P) will be illuminated in this fourth switch position.

Depressing push button switch 327 a fifth time results in the selection of 120 Hz AC input power. In this fifth switch setting, both sets of LEDs (A,E,I,M) and (B,F,J,N) will light alternately as biased across connectors 324 and 330, by the appropriate phase of the AC power cycle at a rate of 120 Hz. In other words, the 120 Hz AC input power simultaneously provides two different DC power components, having two different phases, to the respective sets of LEDs so that both sets of LEDs appear to illuminate simultaneously. In a practical application, the "flicker" that is taking place electrically through the alternation of the phases is likely to be imperceptible to the human eye and the light strings 350-1 and 350-2 will have the appearance of having all the LEDs, (A,E,I,M) and (B,F,J,N), on simultaneously.

Depressing push button switch 327 a sixth time results in the selection of 60 20 Hz AC input power. In this sixth switch setting, both sets of LEDs (A,E,I,M) and (B,F,J,N) will light alternately as biased across connectors 324 and 330, by the appropriate phase of the AC power cycle at a rate of less than 60 Hz, typically but not exclusively 20 Hz. In other words, the 20 Hz AC input power alternating provides two different DC current directions having two different phases, to the respective sets of LEDs so that both sets of LEDs appear to illuminate alternatingly. This is simple no power components simply positive and negative being replaced to reverse the polarity and illuminate the other LED in the back-to-back pair. In a practical application, the positive current direction is on for 1 to 2 seconds, followed by the negative current direction being on for 1 to 2 seconds in the light strings 350-1 and 350-2. In this manner, the light strings will have the appearance of having all the LEDs, (A,E,I,M) and (B,F,J,N), on in alternating fashion or flashing on and off.

Alternatively, or in addition, remote control capability may be added for switching the controller326. Wireless receiver/transmitter head 328 may be included in controller 326 for coordinating wireless communication with remote 329 having its own wireless receiver/transmitter head. A push-button switch on the remote 329 is used to switch the switch position of the controller 326 and wireless signals are exchanged between the receiver/transmitter.

FIG. 3B is a top down view of a circuit layout of the circuit of FIG. 3A. The circuit layout comprises a plurality of LED bulb housings 372, four of which are shown for convenience, the LEDs within the LED bulb housings are arranged in as pairs with 2 LED pairs per housing. All of the LEDs within the light string 350-1 are powered by conductor 324. Conductor 330 is shown and powers further light strings, for example, light string 350-2. The circuit layout further comprises common return 330 and sticky backing layer 364 as the outermost layer. On top of sticky backing layer 364, there is shown insulating substrate layer 366. The entire circuit layout is encapsulated at the uppermost layer with a clear insulator layer 370. A key feature of the circuit layout shown in FIG. 3B is the use of a single layer of foil conductors 324, 330 obviating the need for jumper conductors from the LEDs in the respective LED bulb housings 372 on one layer to conductors 324 and 330 on a different layer.

Referring now to FIGS. 4A-4E, schematic diagrams illustrating a flat rope light string system in accordance with yet another embodiment of the present invention are shown.

Figure 4A:
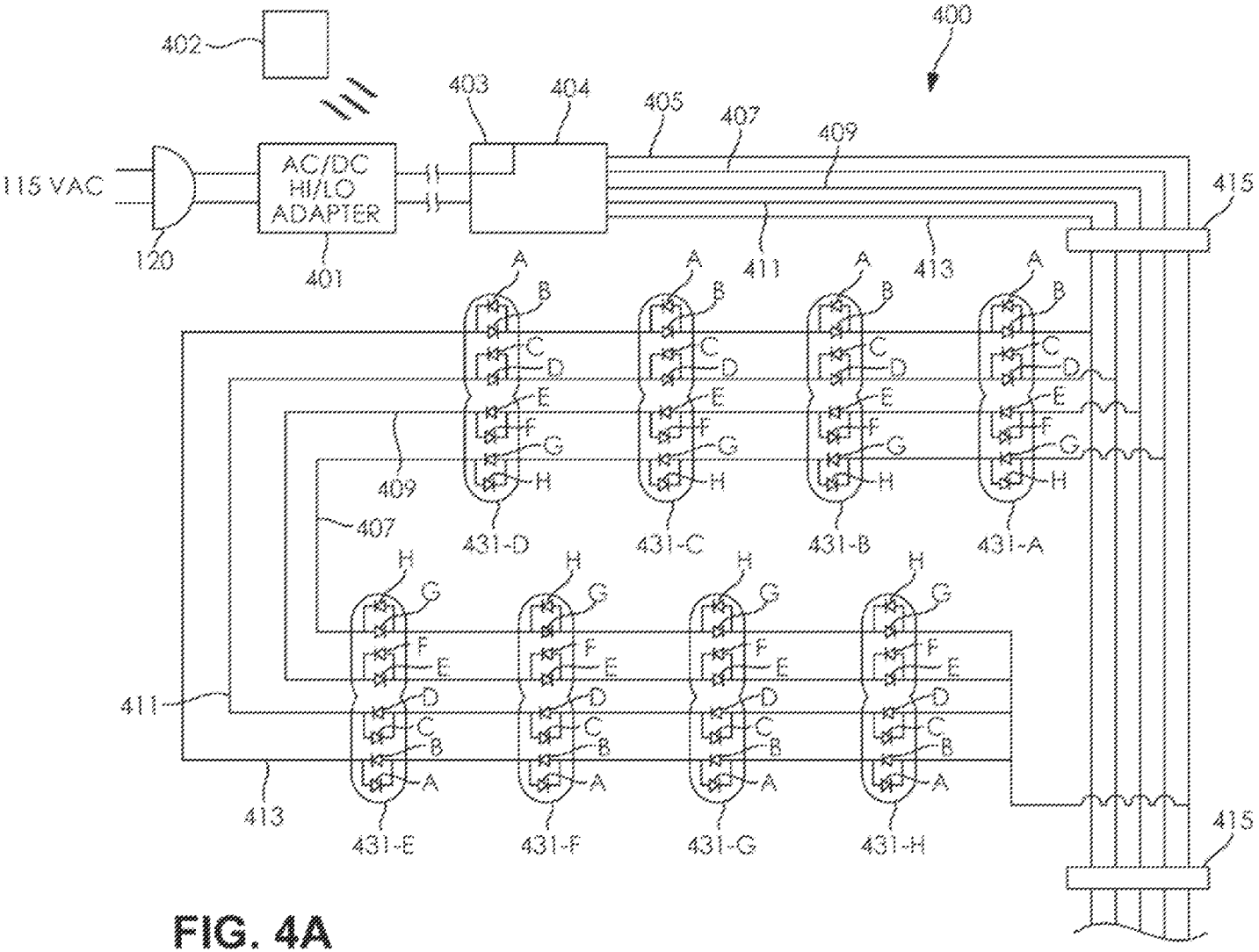
FIG. 4A depicts a circuit diagram of a flat rope light string system according to one embodiment.

FIG. 4A illustrates a flat rope LED system 400 according to a further embodiment of the invention. The flat rope LED system 400 is comprised of eight LED light strings 431-A through 431-H. Each string set is connected in parallel with controller 404. Each LED light string comprises a single bulb housing set is connected in parallel with controller 404. Each LED bulb housing is comprised of eight LEDs configured as four pairs of dual color LEDs, each pair configured in a back-to-back orientation. For example, the first LED light string 431-A is comprised of a single LED bulb housing comprised of four pairs of dual color LEDs, i.e., first LED pair (A,B), second LED pair (C,D), third LED pair (E,F), and fourth LED pair (G,H).

Although the physical construction and electrical circuit layout of FIG. 4A have been specifically disclosed, those of skill in the art will appreciate that alternative physical constructions and electrical arrangements may exist to accomplish the above-described functions without departing from the teaching of the present invention.

Figure 4B:
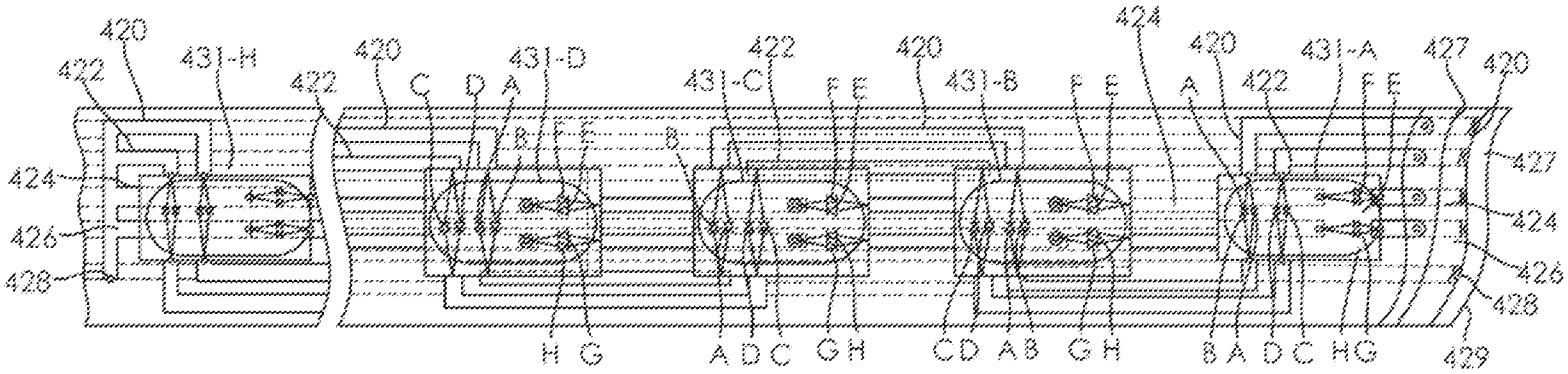
FIGS. 4B & 4C are top and side views of the light elements and sockets according to the embodiment shown in FIG. 4A.
Figure 4C:
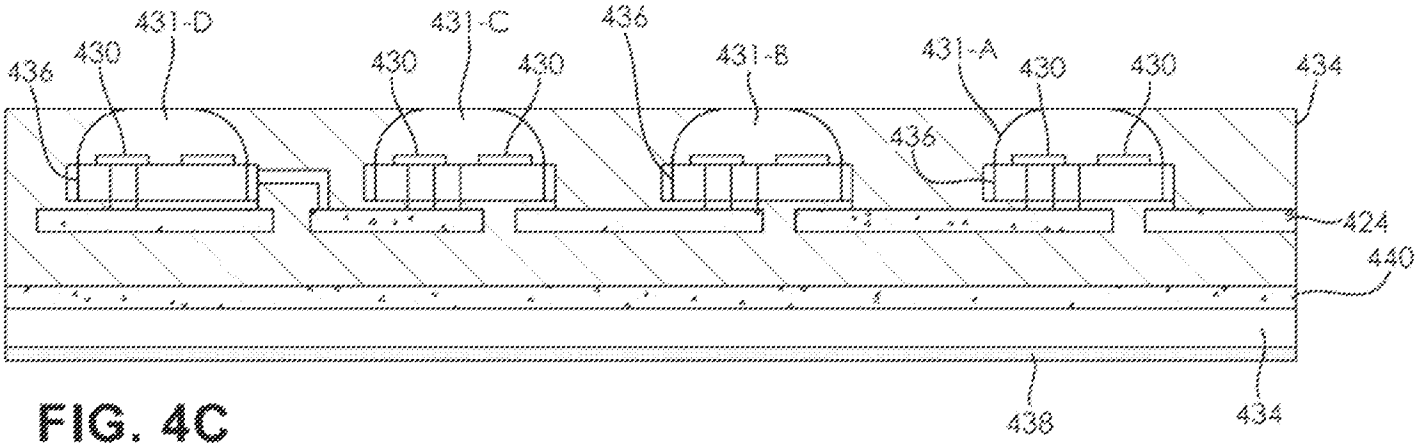

FIG. 4B is a top down view of a circuit layout of FIG. 4A. Single bulb housings 431-A through 431-D and 431-H are shown in detail. However, the description applies to all of the bulb housings 431-A through 431-H. The circuit layout is comprised of two layers. A first layer includes the bulb housings 431-A. A second layer includes 5 foil (power) conductors 420, 422, 424, 424, 426 for powering the bulb housings. Conductor 420 is configured and arranged to power additional (optional) light strings. Each of the foil (power) conductors 420, 422, 424, 426, 420 relies on a single common return 405. The circuit layout further comprises sticky backing layer 429 as the outermost layer. On top of sticky backing layer 429, there is shown insulating substrate layer 427. The entire circuit layout is encapsulated at the uppermost layer with a clear insulator layer 470.

A key feature of the circuit layout shown in FIG. 4B is the use of a single layer of foil (power) conductors 420, 422, 424, 426, 428 obviating the need for jumper conductors from the LEDs in the respective LED bulb housings 431-A through 431-D on one layer to the foil (power) conductors 424, 426, 420 on a different layer, as used in conventional layouts of the prior art.

FIG. 4D is a color assignment/pairings chart describing the bulb color assignments and bulb color pairings in the LED light strings 431-A through 431-H of the present embodiment. Referring to the first and second rows of the chart, there is shown identifying information regarding bulbs "A" and "B" of the LED light string 431-A. Bulbs "A" and "B" are configured in a back-to-back orientation with Bulb "A" being activated (energized) when it is positively biased and Bulb "B" being activated (energized) when it is negatively biased.

TABLE IV

| ROW | LED ID | SET ID | BULB ID | BULB COLOR | COLOR PAIRINGS |
|---|---|---|---|---|---|
| 1 | A | 431-A | BULB 1 | WHITE | WHITE/RED |
| 2 | B | 431-A | BULB 1 | RED | WHITE/RED |

Referring to FIG. 4A, LED "A" is shown paired with LED "B" in the single bulb housing of string set 431-A. LED "A" is factory assigned to be a "white" bulb and LED "B" is factory assigned to be an "orange" bulb.

With reference now to FIG. 4E, which describes certain aspects of the operation of the circuit of FIG. 4A, in operation, AC electrical power is provided to the high voltage power source (e.g., 115 VAC). With controller 404 programmed to select a first switch position, a positive polarity DC voltage (+) is conducted in series, through the respective bulb housings of LED light strings 431-A through 431-H, coupled across connectors 413 and connector (common) 405. Each positively biased LED within each bulb housing connected to connector 413 is activated and will therefore be illuminated in this first switch position. For example, in this first switch position all of the positively biased LEDs labeled "A" will be positively biased (activated) in this first switch position and will be illuminated in accordance with the positive polarity DC voltage (+). The resulting illumination emanating from the respective light strings 431-A through 431-H is "white" corresponding to everyday/Christmas events, as described in the last two columns of FIG. 4E.

Advancing controller 404 to the second switch position, results in the selection of a negative polarity DC voltage (−) conducted in series, through the bulb housings of LED light strings 431-A through 431-H, coupled across connector 413 and common connector 405. Each negatively biased LED coupled across connectors 413 and 405 within each bulb housing 431-A through 431-H is activated and will therefore be illuminated in this second switch position. For example, all of the LEDs labeled "B" will be negatively biased (activated) in this second switch position and will be illuminated in accordance with the negative polarity DC voltage (−). The resulting illumination emanating from the respective light strings 431-A through 431-H in this second switch position is a combination of (red, green, yellow, blue) corresponding to Christmas events, as described in the last two columns of FIG. 4E.

Advancing controller 404 to the third switch position, results in the selection of a positive polarity DC voltage (+) conducted in parallel through the bulb housings of LED light strings 431-A through 431-H coupled across the connector 411 and common connector 405. Each positively biased LED within the single bulb housing of LED string sets 431-A through 431-H coupled to connector 411 and 405 will be activated and therefore illuminated in this third switch position. For example, each LED labeled "C" will be positively biased (activated) and will be illuminated in accordance with the positive polarity DC voltage (+). The resulting illumination emanating from the respective light strings 431-A through 431-H in this third switch position is a combination of (orange, purple, green, purple) corresponding to Christmas events, as described in the last two columns of FIG. 4E.

Advancing controller 404 to the fourth switch position, results in the selection of a negative polarity DC voltage (−) conducted in series through the respective housings, of LED light strings 431-A through 431-H, coupled across connectors 411 and 405. Each negatively biased LED coupled across connectors 411 and 405 within the bulb housings of LED light strings) 431-A through 431-H coupled to connectors 411 and 405 will be activated and therefore illuminated in this fourth switch position. For example, all of the LEDs labeled "D" will be negatively biased (activated) and will be illuminated in accordance with the, negative polarity DC voltage (−). The resulting illumination emanating from the respective bulb housings of LED light strings 431-A through 431-H in this fourth switch position is a combination of (red, white, green, white) corresponding to Christmas events, Italian events, Mexican events, as described in the last two columns of FIG. 4E.

Advancing controller 404 to the fifth switch position, results in the selection of a positive polarity DC voltage (+) conducted in series through the bulb housings of LED light strings 431-A through 431-H, coupled across connectors 409 and 405. Each positively biased LED coupled across the bulb housing of string sets 431-A through 431-H coupled to connectors 409 and 405 will be illuminated in this fifth switch position. For example, each LED labeled "E" will be positively biased (activated) and will be illuminated in accordance with the positive polarity DC voltage (+). The resulting illumination emanating from the respective light strings 431-A through 431-H in this fifth switch position is a combination of (purple, orange, purple, green) corresponding to Mardi Gras events, as described in the last two columns of FIG. 4E.

Advancing controller 404 to the sixth switch position, results in the selection of a negative polarity DC voltage (−) conducted in series through the bulb housings of LED light strings 431-A through 431-H, coupled across connectors 409 and 405. Each negative biased LED coupled across connectors 409 and 405 within the bulb housings of string sets 431-A through 431-H) coupled to connectors 409 and 405 will be illuminated in this sixth position. For example, all of the LEDs labeled "F" will be negatively biased (activated) and will be illuminated in accordance with the negative polarity DC voltage (−). The resulting illumination emanating from the respective light strings 431-A through 431-H in this sixth switch position is a combination of (red, white, red, white) corresponding to Christmas events and Valentine day events, as described in the last two columns of FIG. 4E.

Advancing controller 404 to the seventh switch position, results in the selection of a positive polarity DC voltage (+) conducted in series through the bulb housings of LED light strings 431-A through 431-H, coupled across connectors 407 and 405. Each positively biased LED coupled across connectors 407 and 405 within the bulb housings of string sets 431-A through 431-H) coupled to connectors 407 and 405 will be illuminated in this sixth position. For example, all of the LEDs labeled "G" will be positively biased (activated) and will be illuminated in accordance with the positively polarity DC voltage (+). The resulting illumination emanating from the respective light strings 431-A through 431-H in this sixth switch position is a combination of (red, white, blue, white) corresponding to National events, as described in the last two columns of FIG. 4E.

Advancing controller 404 to the eighth switch position, results in the selection of a negative polarity DC voltage (−) conducted in series through the bulb housings of LED light strings 431-A through 431-H, coupled across connectors 407 and 405. Each negative biased LED coupled across connectors 407 and 405 within the bulb housings of string sets 431-A through 431-H coupled to connectors 407 and 405 will be illuminated in this eighth position. For example, all of the LEDs labeled "H" will be negatively biased (activated) and will be illuminated in accordance with the negative polarity DC voltage (−). The resulting illumination emanating from the respective light strings 431-A through 431-H in this eighth switch position is a combination of (green, red) corresponding to Christmas events, as described in the last two columns of FIG. 4E.

Advancing controller 404 to the ninth switch position, results in the selection of an alternating 120 Hz voltage input that alternates between a positive polarity DC voltage (+) and a negative polarity DC voltage (−) conducted through the LED light strings 431-A through 431-H across connectors 413 and 405. Each positively and negatively biased LED coupled across connectors 413 and 405 within the bulb housings of string sets 431-A through 431-H will be alternately illuminated (activated) in this ninth switch position. For example, each LED labeled "A" all of the LEDs labeled "B" will be alternately illuminated in this ninth switch position. The resulting illumination emanating from the respective light strings 431-A through 431-H in this ninth switch position is a combination of (pink, light green, light green, light yellow, light blue).

Figure 5:
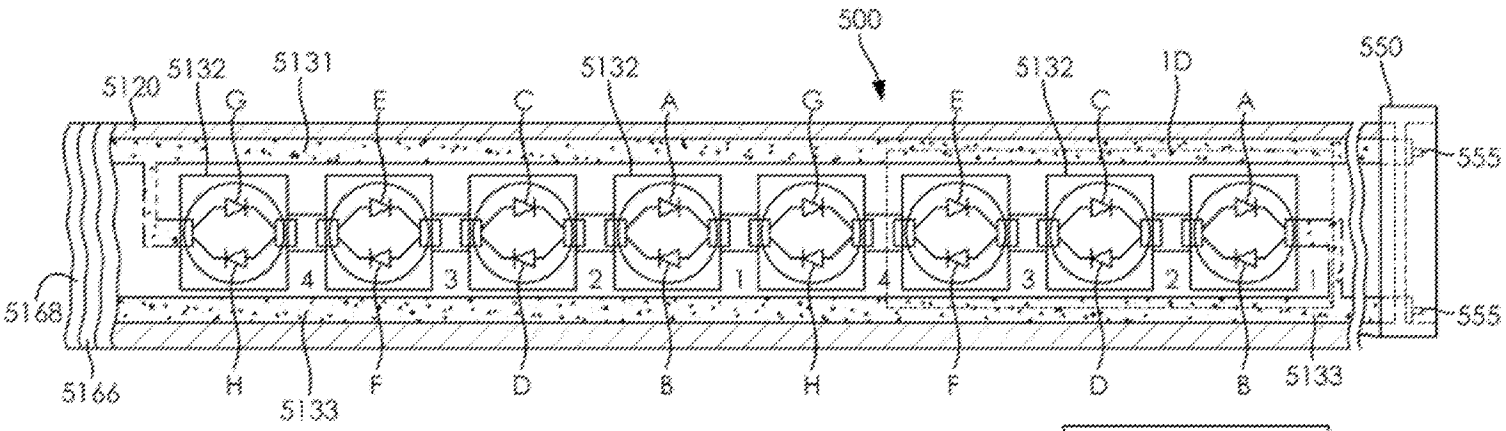
FIG. 5 depicts a top down partial cut-away view of a plurality of interconnected LED bulb housings comprising a portion of a flat rope light string system, according to an embodiment of the present invention.

FIG. 5 illustrates another exemplary embodiment of the present invention. A system 500 may include a plurality of interconnected LED bulb housings 5132 that may be similar to LED bulb housing 132. Pairs of LEDs in each housing (e.g., pairs A/B, C/D, E/F, G/H) may be coupled together in a novel back-to-back configuration, as described herein. System 500 may also include an adhesive layer 5168 that may be similar to adhesive layer 168, an insulation layer 5166 that may be similar to insulation layer 166 adjacent to the adhesive layer 5168, two primary current carrying connectors 5131 and 5133 that may be similar to primary current carrying connectors 131 and 133, and an AC wall plug connector 5120 that may be similar to AC wall plug connector 120. Similar to as discussed above regarding FIG. 1B, the exemplary disclosed back-to-back circuit construction may use the same conductors, instead of multiple separate power leads, but by reversing the polarity in operation, the individual LEDs may illuminate alternatingly.

System 500 may also include an electrical connector 550. Electrical connector 550 may be any suitable component for electrically connecting system 500 to another component or assembly (e.g., another system 500, an electrical power source, or any other suitable electrical component). Electrical connector 550 may be an electrical plug, an electrical socket, or any other suitable electrical component. For example, electrical connector 550 may include a plurality (e.g., two) of male pins 555 that may be connected to another electrical component (e.g., to a socket). Electrical connector 550 may for example be attached to an end portion of system 500 (e.g., to the end of system 500 that may be a flat rope light system). System 500 may include electrical connectors 550 that may be attached to multiple end portions of system 500 to electrically attach system 500 to a plurality of electrical components. For example, system 500 may include a plurality of electrical connectors 550 that may connect a plurality of systems 500 together to form a light assembly (e.g., a lighting mat or a mat-like assembly as described for example regarding FIGS. 17-26 and 30-33).

Figure 6:
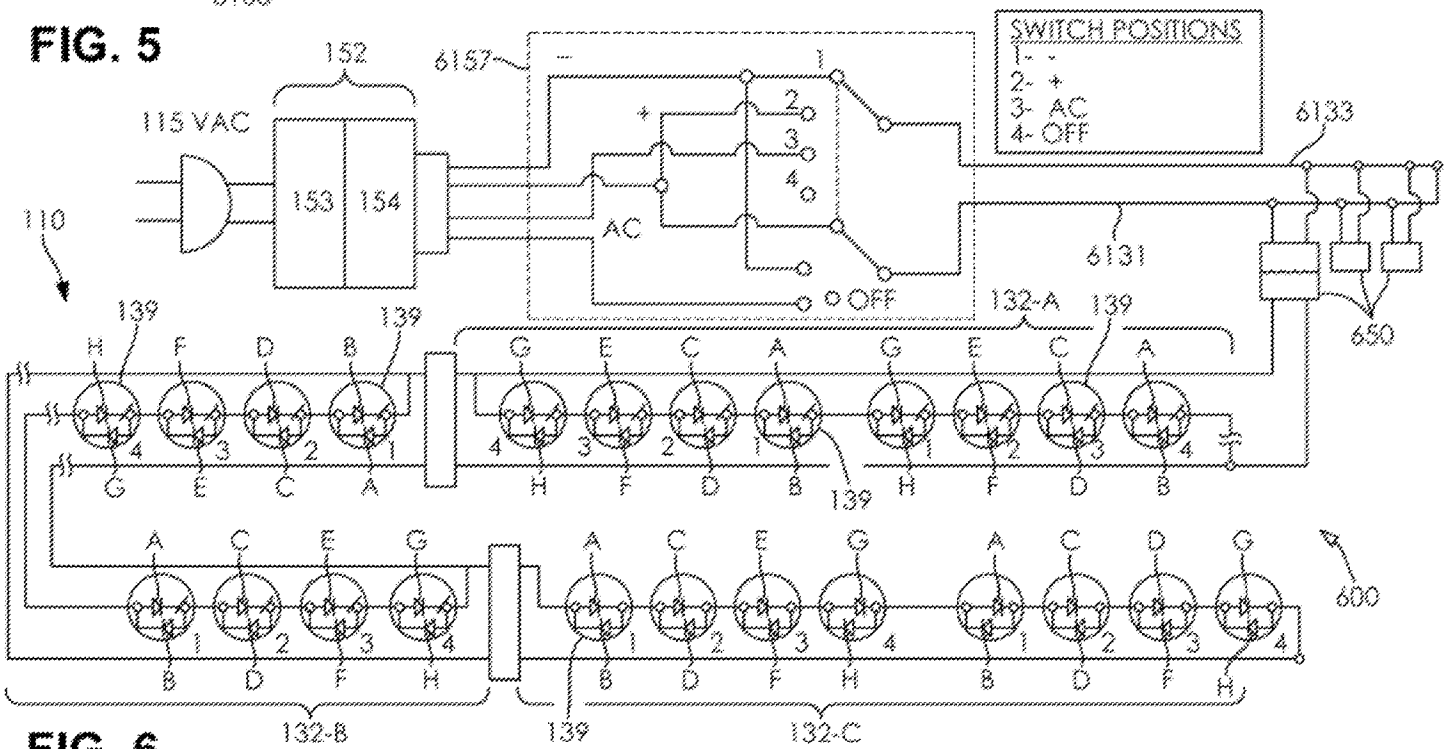
FIG. 6 is a circuit diagram of the invention according to one embodiment.

FIG. 6 illustrates another exemplary embodiment of the present invention. A system 600 may include components similar to as described above regarding FIG. 1C. System 600 may include a switch 6157 such as a four-position rotary selection switch that may be similar to switch 157. For example, sequencing through the various phases may be performed manually via four-position rotary selection switch 6157. Four-position rotary selection switch 6157 may allow a user to manually select any of the previously described phases of operation, for example, (1) positive polarity DC voltage, (2) negative polarity DC voltage, and (3) 120 Hz AC voltage, with the fourth position of selection switch 6157 being the OFF position.

System 600 may include a plurality of electrical connectors 650 that may be similar to electrical connector 550 described above. System 600 may also include an electrical connector 6131 that may be similar to electrical connector 131 and an electrical connector 6133 that may be similar to electrical connector 133. Electrical connector 6133 may be a common return lead that may be electrically connected to each of electrical connectors 650 (e.g., electrically connecting switch 6157 to each of electrical connectors 650). Electrical connector 6131 may electrically connect switch 6157 to each of electrical connectors 650.

System 600 may be electrically connected to a plurality of other electrical components (e.g., other systems 500 and/or 600, an electrical power source, or any other suitable electrical component) via electrical connectors 650. For example, electrical connectors 650 may connect a plurality of systems 500 and/or systems 600 together to form a light assembly (e.g., a lighting mat or a mat-like assembly as described for example regarding FIGS. 17-26 and 30-33).

Figure 7:
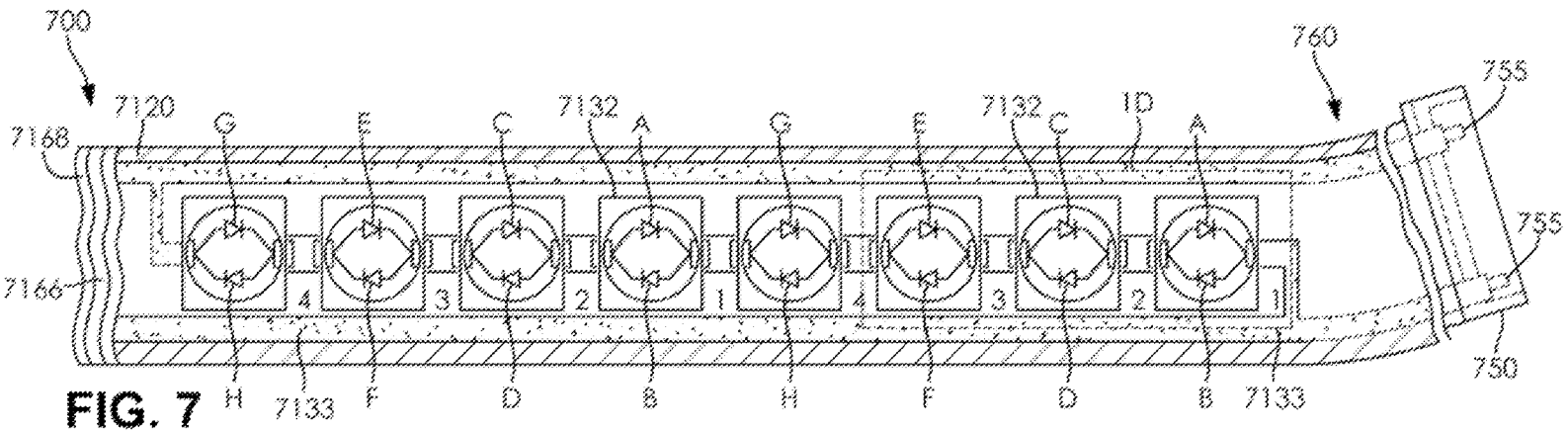
FIG. 7 depicts a top down partial cut-away view of a plurality of interconnected LED bulb housings comprising a portion of a flat rope light string system, according to an embodiment of the present invention.

FIG. 7 illustrates another exemplary embodiment of the present invention. A system 700 may include a plurality of interconnected LED bulb housings 7132 that may be similar to LED bulb housing 132. Pairs of LEDs in each housing (e.g., pairs A/B, C/D, E/F, G/H) may be coupled together in a novel back-to-back configuration, as described herein. System 700 may include any suitable number of LED bulb housings 7132 such as, for example, eight LED bulb housings 7132. System 700 may also include an adhesive layer 7168 that may be similar to adhesive layer 168, an insulation layer 7166 that may be similar to insulation layer 166 adjacent to the adhesive layer 7168, two primary current carrying connectors 7131 and 7133 that may be similar to primary current carrying connectors 131 and 133, and an AC connector 7120 that may be similar to AC connector 120. Similar to as discussed above regarding FIG. 1B, the exemplary disclosed back-to-back circuit construction may use the same conductors, instead of multiple separate power leads, but by reversing the polarity in operation, the individual LEDs may illuminate alternatingly.

System 700 may also include one or more electrical connectors 750 that may be similar to electrical connector 550. Electrical connector 750 may connect system 700 to another component or assembly (e.g., system 500, system 600, another system 700, an electrical power source, or any other suitable electrical component). Electrical connector 750 may include a plurality (e.g., two) of male pins 755 that may be similar to male pins 555. System 700 may be connected via one or more electrical connectors 750 to other exemplary electrical components as described for example herein to form a light assembly (e.g., a lighting mat or a mat-like assembly as described for example regarding FIGS. 17-26 and 30-33). System 700 may include a bent portion 760. Bent portion 760 may be a bend in system 700 that may be a flat rope for use in a desired display (e.g., a lighting mat or a mat-like assembly as described for example regarding FIGS. 17-26 and 30-33). For example, one or more bent portions 760 of one or more systems 700 may be used to configure system 700 (e.g., along with any other suitable exemplary systems described herein) to provide any desired configuration or assembly of lighting elements. System 700 may be a rigid assembly including bent portion 760 (e.g., and the exemplary systems described below regarding FIGS. 8 and 9 may also be rigid assemblies having bent portions).

Figure 8:
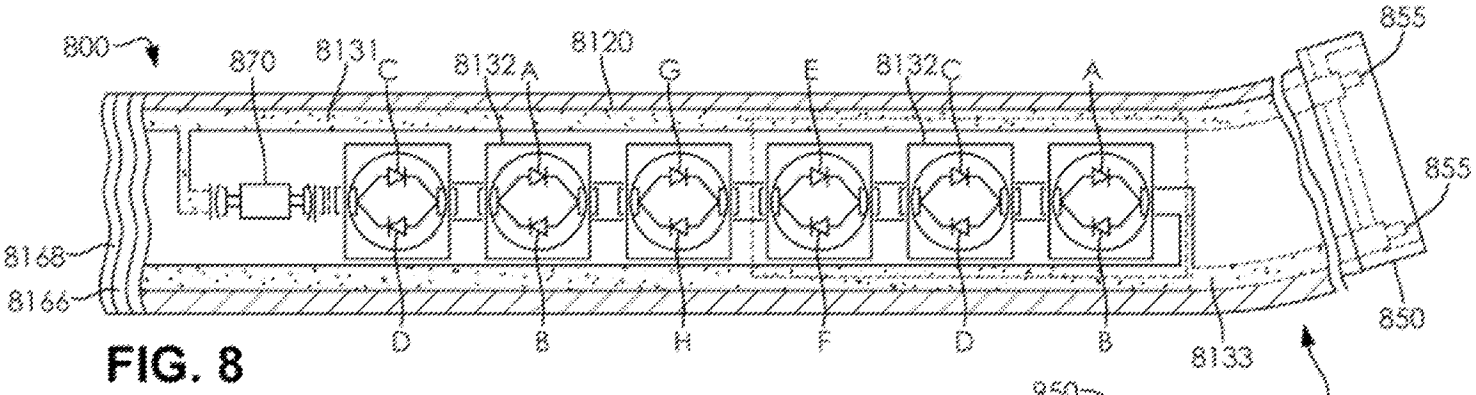
FIG. 8 depicts a top down partial cut-away view of a plurality of interconnected LED bulb housings comprising a portion of a flat rope light string system, according to an embodiment of the present invention.

FIG. 8 illustrates another exemplary embodiment of the present invention. A system 800 may include a plurality of interconnected LED bulb housings 8132 that may be similar to LED bulb housing 132. Pairs of LEDs in each housing (e.g., pairs A/B, C/D, E/F, G/H) may be coupled together in a novel back-to-back configuration, as described herein. System 800 may include any suitable number of LED bulb housings 8132 such as, for example, six LED bulb housings 8132. System 800 may also include an adhesive layer 8168 that may be similar to adhesive layer 168, an insulation layer 8166 that may be similar to insulation layer 166 adjacent to the adhesive layer 8168, two primary current carrying connectors 8131 and 8133 that may be similar to primary current carrying connectors 131 and 133, and an AC connector 8120 that may be similar to AC connector 120. Similar to as discussed above regarding FIG. 1B, the exemplary disclosed back-to-back circuit construction may use the same conductors, instead of multiple separate power leads, but by reversing the polarity in operation, the individual LEDs may illuminate alternatingly.

System 800 may also include one or more electrical connectors 850 that may be similar to electrical connector 550. Electrical connector 850 may connect system 800 to another component or assembly (e.g., system 500, system 600, system 700, another system 800, an electrical power source, or any other suitable electrical component). Electrical connector 850 may include a plurality (e.g., two) of male pins 855 that may be similar to male pins 555. System 800 may be connected via one or more electrical connectors 850 to other exemplary electrical components as described for example herein to form a light assembly (e.g., a lighting mat or a mat-like assembly as described for example regarding FIGS. 17-26 and 30-33). System 800 may include a bent portion 860. Bent portion 860 may be a bend in system 800 that may be a flat rope for use in a desired display (e.g., a lighting mat or a mat-like assembly as described for example regarding FIGS. 17-26 and 30-33). For example, one or more bent portions 860 of one or more systems 800 may be used to configure system 800 (e.g., along with any other suitable exemplary systems described herein) to provide any desired configuration or assembly of lighting elements. System 800 may also include a resistor 870. Resistor 870 may be a compensating resistor. Resistor 870 may operate to match a resistance of the exemplary 6 LED arrangement illustrated in FIG. 8. For example, resistor 870 may compensate for two missing LEDs that may be missing from an 8 LED series load that results in the 6 LED series load illustrated in FIG. 8.

Figure 9:
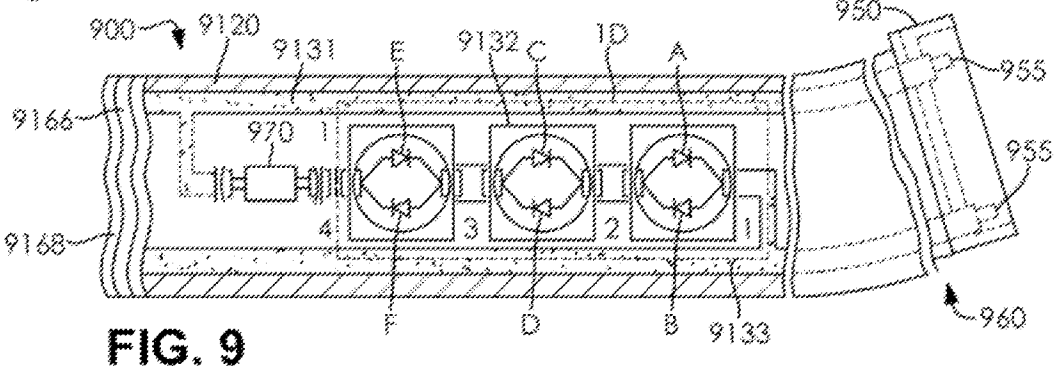
FIG. 9 depicts a top down partial cut-away view of a plurality of interconnected LED bulb housings comprising a portion of a flat rope light string system, according to an embodiment of the present invention.

FIG. 9 illustrates another exemplary embodiment of the present invention. A system 900 may include a plurality of interconnected LED bulb housings 9132 that may be similar to LED bulb housing 132. Pairs of LEDs in each housing (e.g., pairs A/B, C/D, E/F, G/H) may be coupled together in a novel back-to-back configuration, as described herein. System 900 may include any suitable number of LED bulb housings 9132 such as, for example, four LED bulb housings 9132. System 900 may also include an adhesive layer 9168 that may be similar to adhesive layer 168, an insulation layer 9166 that may be similar to insulation layer 166 adjacent to the adhesive layer 9168, two primary current carrying connectors 9131 and 9133 that may be similar to primary current carrying connectors 131 and 133, and an AC connector 9120 that may be similar to AC connector 120. Similar to as discussed above regarding FIG. 1B, the exemplary disclosed back-to-back circuit construction may use the same conductors, instead of multiple separate power leads, but by reversing the polarity in operation, the individual LEDs may illuminate alternatingly.

System 900 may also include one or more electrical connectors 950 that may be similar to electrical connector 550. Electrical connector 950 may connect system 900 to another component or assembly (e.g., system 500, system 600, system 700, system 800, another system 900, an electrical power source, or any other suitable electrical component). Electrical connector 950 may include a plurality (e.g., two) of male pins 955 that may be similar to male pins 555. System 900 may be connected via one or more electrical connectors 950 to other exemplary electrical components as described for example herein to form a light assembly (e.g., a lighting mat or a mat-like assembly as described for example regarding FIGS. 17-26 and 30-33). System 900 may include a bent portion 960. Bent portion 960 may be a bend in system 900 that may be a flat rope for use in a desired display (e.g., a lighting mat or a mat-like assembly as described for example regarding FIGS. 17-26 and 30-33). For example, one or more bent portions 960 of one or more systems 900 may be used to configure system 900 (e.g., along with any other suitable exemplary systems described herein) to provide any desired configuration or assembly of lighting elements. System 900 may also include a resistor 970. Resistor 970 may be a compensating resistor. Resistor 970 may operate to match a resistance of the exemplary 4 LED arrangement illustrated in FIG. 9. For example, resistor 970 may compensate for four missing LEDs that may be missing from an 8 LED series load that results in the 4 LED series load (e.g., a half segment) illustrated in FIG. 9.

Figure 10:
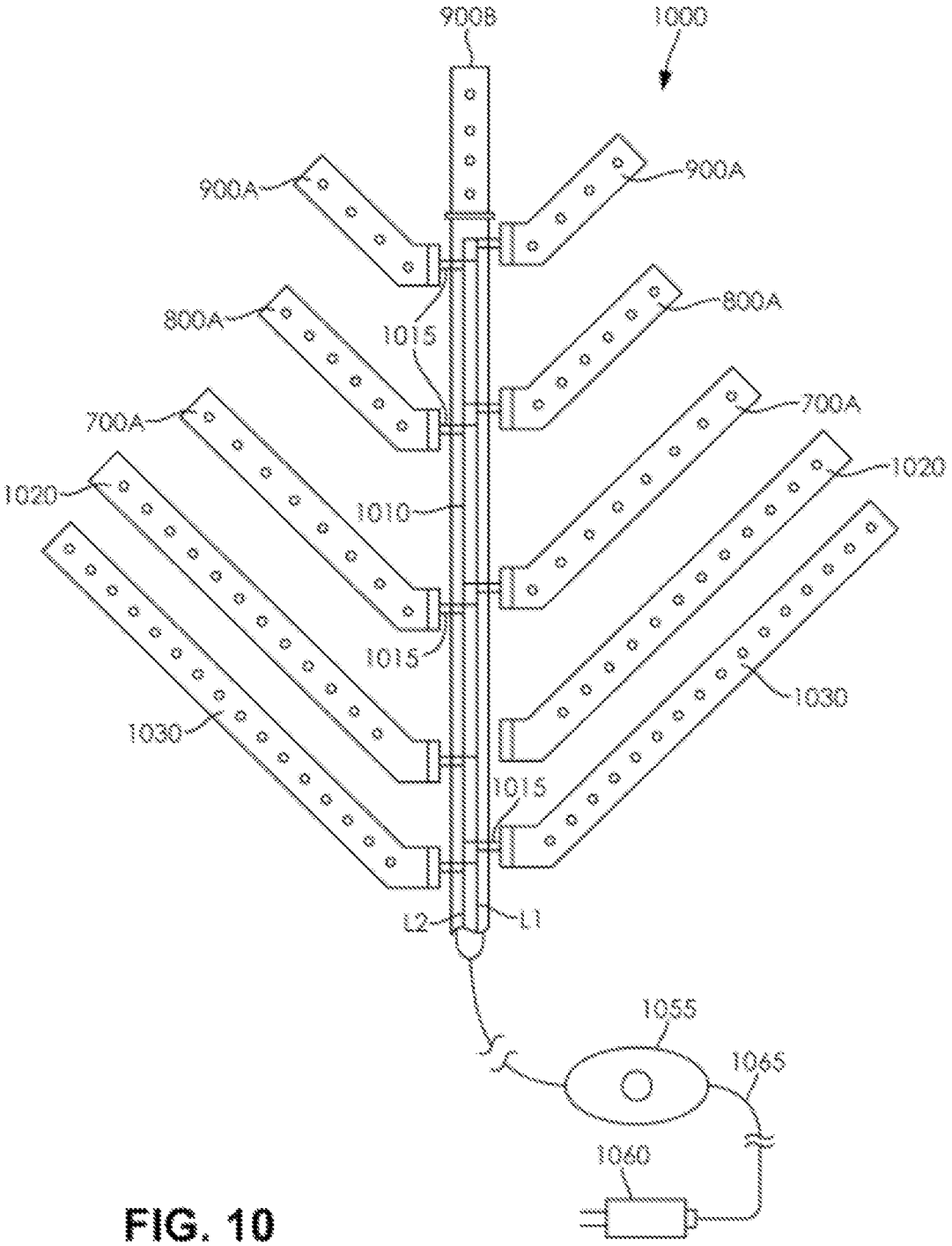
FIG. 10 is a schematic illustration of a light system according to one embodiment of the present invention.

FIG. 10 illustrates another exemplary embodiment of the present invention. A system 1000 may be any desired type of decorative assembly such as, for example, a Christmas tree decoration, a Hanukkah menorah or candelabra, or any other desired decoration. System 1000 may include a structural member 1010 that may include electrical connectors and any other suitable components for supporting and/or powering decorations attached to structural member 1010. For example, structural member 1010 may include a plurality of electrical connectors 1015 (e.g., plugs and/or sockets) for being electrically connected to electrical connectors of the exemplary components illustrated in FIG. 10.

As illustrated in FIG. 10, one or more systems 900A and 900B that may be similar to system 900, one or more systems 800A that may be similar to system 800, one or more systems 700A that may be similar to system 700, one or more systems 1020, and/or one or more systems 1030 may be removably attached to structural member 1010 via electrical connection between electrical connectors 1015 of structural member 1010 and respective exemplary disclosed electrical connectors described above (e.g., electrical connectors 750, 850, 950, and/or any other suitable electrical connector) that may be removably attachable to electrical connectors 1015. Any suitable electrical component described herein may be removably electrically attached to electrical connectors 1015.

Systems 1020 and 1030 may be generally similar to systems 700, 800, and 900. In at least some exemplary embodiments, system 1020 may include 12 LED bulb housings that may be similar to LED bulb housing 132. System 1020 may include system 700 (e.g., including 8 LED bulb housings) attached to system 900 (e.g., including 4 LED bulb housings). In at least some exemplary embodiments, system 1030 may include 16 LED bulb housings that may be similar to LED bulb housing 132. System 1030 may include two systems 700 (e.g., each including 8 LED bulb housings) attached to each other.

System 1000 may also include an electrical component 1055 (e.g., a controller) and an electrical component 1060 (e.g., an electrical plug that may be connected to an electrical power source such as a wall socket). Electrical component 1055 may be any suitable component for controlling an operation of system 1000 such as, for example, a housing including switches that may be actuated by a user. For example, electrical component 1055 may be a foot pedal including push-button switches. Electrical component 1060 may provide any desired current and voltage to system 1000 such as any desired current and voltage of AC and/or DC electricity. In at least some exemplary embodiments, electrical component 1060 may be an AC/DC, HI/LO adapter. System 1000 may also include a remote control components that may remotely control an operation of system 100. Electrical components 1055 and 1060 may be electrically connected to structural member 1010 via a power connector 1065. Power connector 1065 may be any suitable component for transferring AC/DC electricity of any suitable level such as, for example, an electrical wire, an electrical cord, an electrical cable, a light string, and/or any other suitable member for transferring electricity.

Figure 11A:
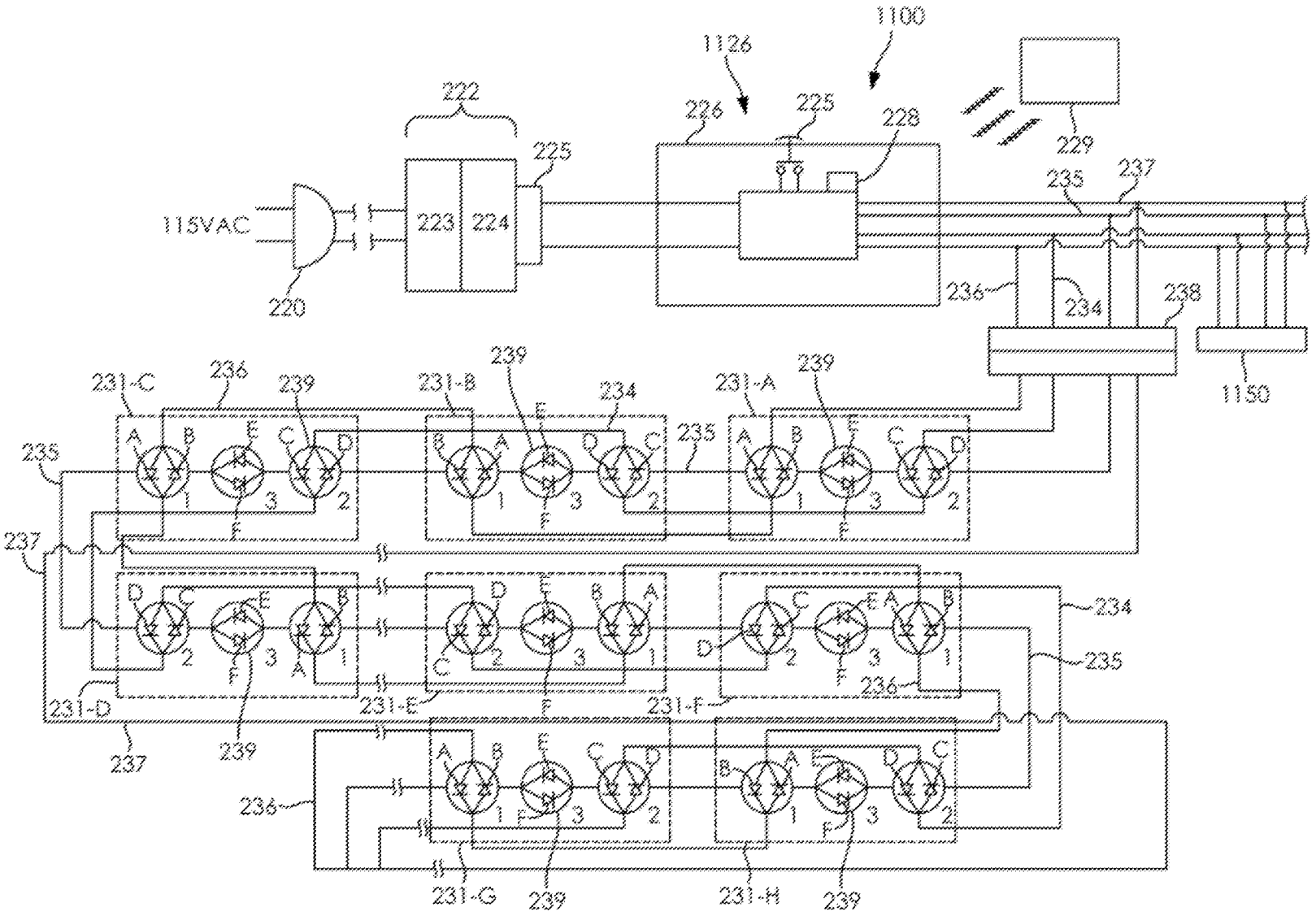
FIG. 11A depicts a circuit diagram of a flat rope light string system according to one embodiment of the present invention.

FIG. 11A illustrates another exemplary embodiment of the present invention. A system 1100 may include components similar to as described above regarding FIG. 2A. System 1100 may include a controller 1126 that may be similar to controller 226 described above. System 1100 may be a flat rope light string system including eight light strings 231A-H, each comprising 3 LED bulb housings 239. By providing 3 LED pairs per bulb housing in the present embodiment, a relatively wide variety of lighting combinations can be provided.

As illustrated in FIG. 11A, system 1100 may include an electrical connector 1150 that may be similar to electrical connector 650. Electrical connector 1150 may be connected to conductors 234, 235, 236 and 237 similarly as electrical connector 238 illustrated in FIG. 11A. Any desired number of electrical connectors 1150 may be connected to system 1100. Electrical components may be attached to system 1100 by electrical connection to electrical connectors 1150. For example, electrical connectors 1150 may connect system 1100 to another component or assembly (e.g., system 500, system 600, system 700, system 800, system 900, another system similar to as illustrated in FIG. 11A, or any other suitable electrical component). In at least some exemplary embodiments, a plurality of flat rope segments may be added via electrical connectors 1150. For example, electrical connectors 1150 may connect a plurality of exemplary disclosed systems to form a light assembly (e.g., a lighting mat or a mat-like assembly as described for example regarding FIGS. 17-26 and 30-33).

Figure 11B:
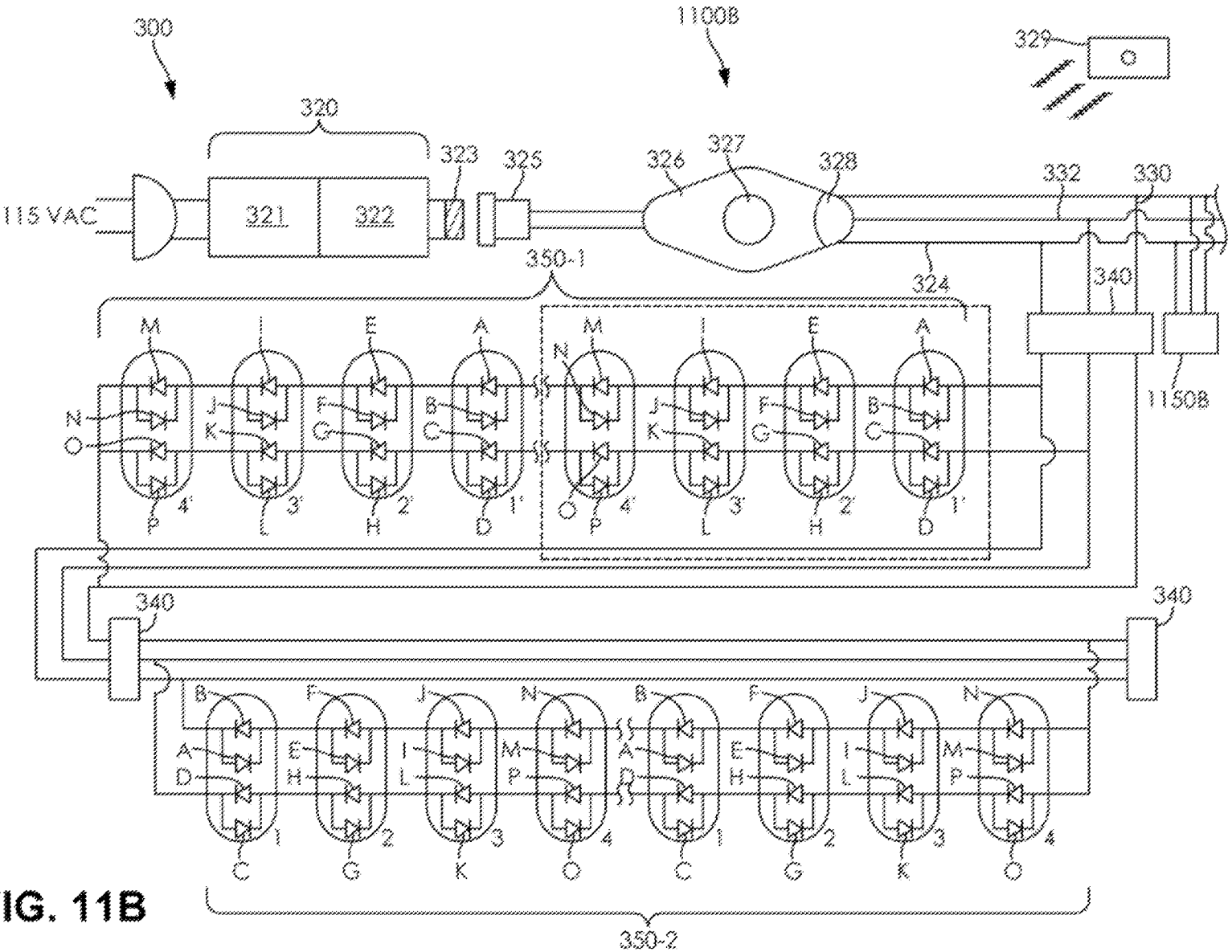
FIG. 11B depicts a circuit diagram of a flat rope light string system according to one embodiment of the present invention.

FIG. 11B illustrates another exemplary embodiment of the present invention. A system 1100B may include components similar to as described above regarding FIG. 3A. System 1100B may be a flat rope light string system including light strings 350-1 and 350-2.

As illustrated in FIG. 11B, system 1100B may include an electrical connector 1150B that may be similar to electrical connector 650. Electrical connector 1150B may be connected to connectors 324, 330, and 332 similarly as electrical connector 340 illustrated in FIG. 11B. Any desired number of electrical connectors 1150B may be connected to system 1100B. Electrical components may be attached to system 1100B by electrical connection to electrical connectors 1150B. For example, electrical connectors 1150B may connect system 1100B to another component or assembly (e.g., system 500, system 600, system 700, system 800, system 900, system 1100, another system similar to as illustrated in FIG. 11B, or any other suitable electrical component). In at least some exemplary embodiments, a plurality of flat rope segments may be added via electrical connectors 1150B. For example, electrical connectors 1150B may connect a plurality of exemplary disclosed systems to form a light assembly (e.g., a lighting mat or a mat-like assembly as described for example regarding FIGS. 17-26 and 30-33).

Figure 12:
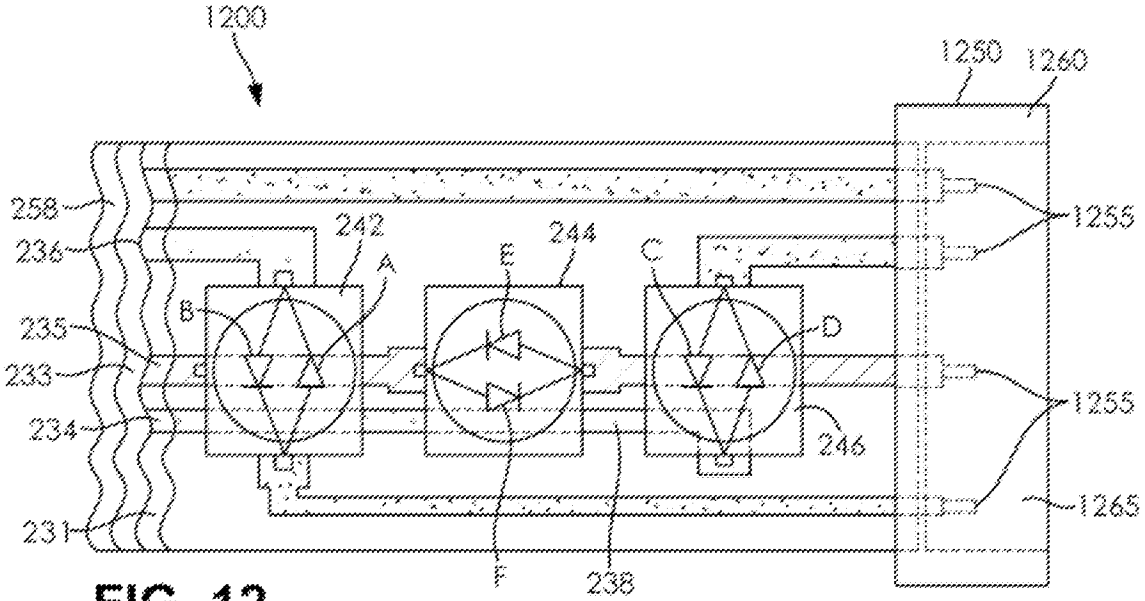
FIG. 12 depicts a top down partial cut-away view and a side cut-away view of three interconnected LED bulb housings of a flat rope light string system according to one embodiment of the present invention.

FIG. 12 illustrates another exemplary embodiment of the present invention. A system 1200 may include components similar to as described above regarding FIG. 2B. System 1200 may include an electrical connector 1250 that may be similar to electrical connector 650. Electrical connector 1250 may connect system 1200 to another component or assembly (e.g., system 500, system 600, system 700, system 800, system 900, system 1000, system 1100, another system 1200, an electrical power source, or any other suitable electrical component). Electrical connector 1250 may include a plurality (e.g., four) of male pins 1255 that may be similar to male pins 555. System 1200 may be connected via one or more electrical connectors 1250 to other exemplary electrical components as described for example herein to form a light assembly (e.g., a lighting mat or a mat-like assembly as described for example regarding FIGS. 17-26 and 30-33). Electrical connector 1250 may include one or more connector walls 1260 that may form a connector cavity 1265 for receiving a plug or socket of another electrical component.

Figure 13:
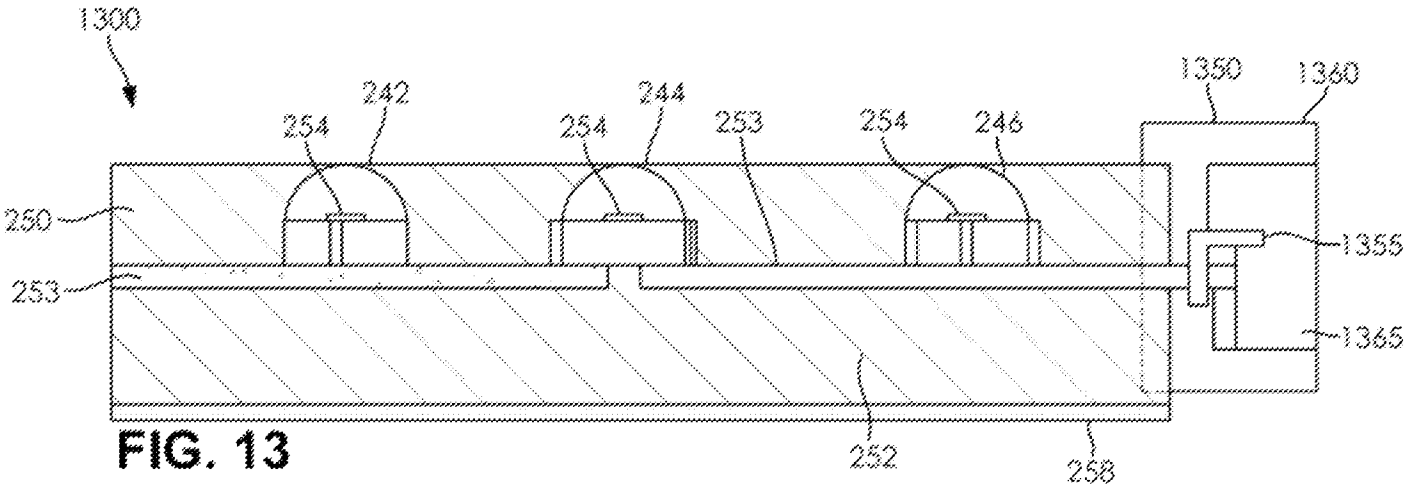
FIG. 13 depicts a top down partial cut-away view and a side cut-away view of three interconnected LED bulb housings of a flat rope light string system according to one embodiment of the present invention.

FIG. 13 illustrates another exemplary embodiment of the present invention. A system 1300 may include components similar to as described above regarding FIG. 2C. System 1300 may include an electrical connector 1350 that may be similar to electrical connector 650. Electrical connector 1350 may connect system 1300 to another component or assembly (e.g., system 500, system 600, system 700, system 800, system 900, system 1000, system 1100, system 1200, another system 1300, an electrical power source, or any other suitable electrical component). Electrical connector 1350 may include one or more male pins 1355 that may be similar to male pins 555. System 1300 may be connected via one or more electrical connectors 1350 to other exemplary electrical components as described for example herein to form a light assembly (e.g., a lighting mat or a mat-like assembly as described for example regarding FIGS. 17-26 and 30-33). Electrical connector 1350 may include one or more connector walls 1360 that may form a connector cavity 1365 for receiving a plug or socket of another electrical component.

Figure 14:
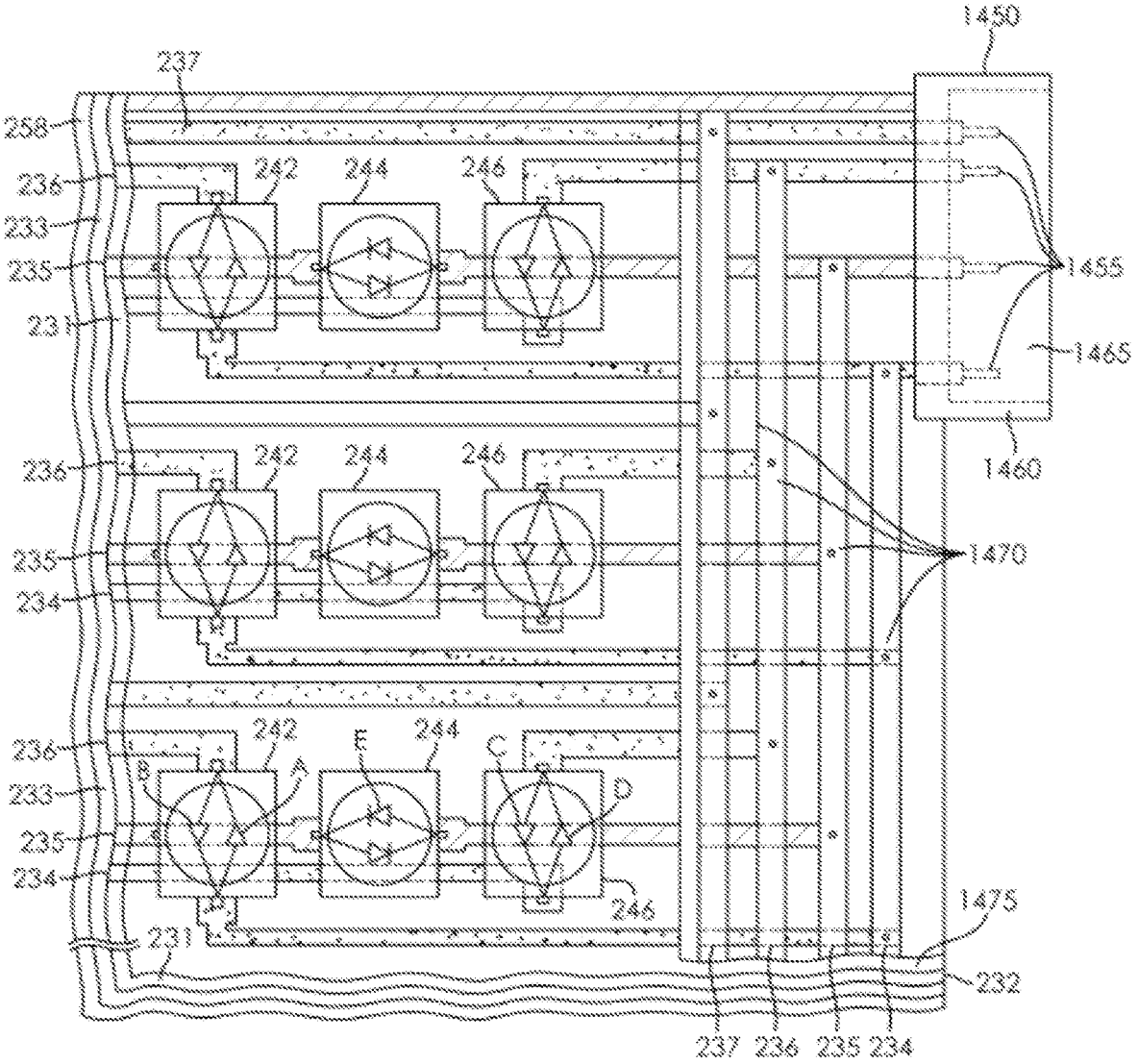
FIG. 14 depicts a top down partial cut-away view and a side cut-away view of three interconnected LED bulb housings of a flat rope light string system according to one embodiment of the present invention.

FIG. 14 illustrates another exemplary embodiment of the present invention. A system 1400 may include components similar to as described above regarding FIG. 12. System 1400 may include a plurality of components that may each be similar to system 1200. In at least some exemplary components, system 1400 may form a "mat" type configuration that may include an electrical connector 1450, which may be similar to electrical connector 1250, and multiple flat ropes (e.g., each similar to system 1200) that may be connected. Electrical connector 1450 may connect system 1400 to another component or assembly (e.g., system 500, system 600, system 700, system 800, system 900, system 1000, system 1100, system 1200, system 1300, another system 1400, an electrical power source, or any other suitable electrical component). Electrical connector 1450 may include a plurality (e.g., four) of male pins 1455 that may be similar to male pins 555. System 1400 may be connected via one or more electrical connectors 1450 to other exemplary electrical components as described for example herein to form a light assembly (e.g., a lighting mat or a mat-like assembly as described for example regarding FIGS. 17-26 and 30-33). Electrical connector 1450 may include one or more connector walls 1260 that may form a connector cavity 1465 for receiving a plug or socket of another electrical component.

System 1400 may include a plurality of electrical connections 1470. As illustrated in FIG. 14, electrical connections 1470 may connect upper conductors of system 1400 to LED conductors. Also as illustrated in FIG. 14, system 1400 may include an insulating layer 1475. In at least some exemplary embodiments, insulating layer 1475 may be an opaque layer (e.g., opaque insulating layer).

Figure 15:
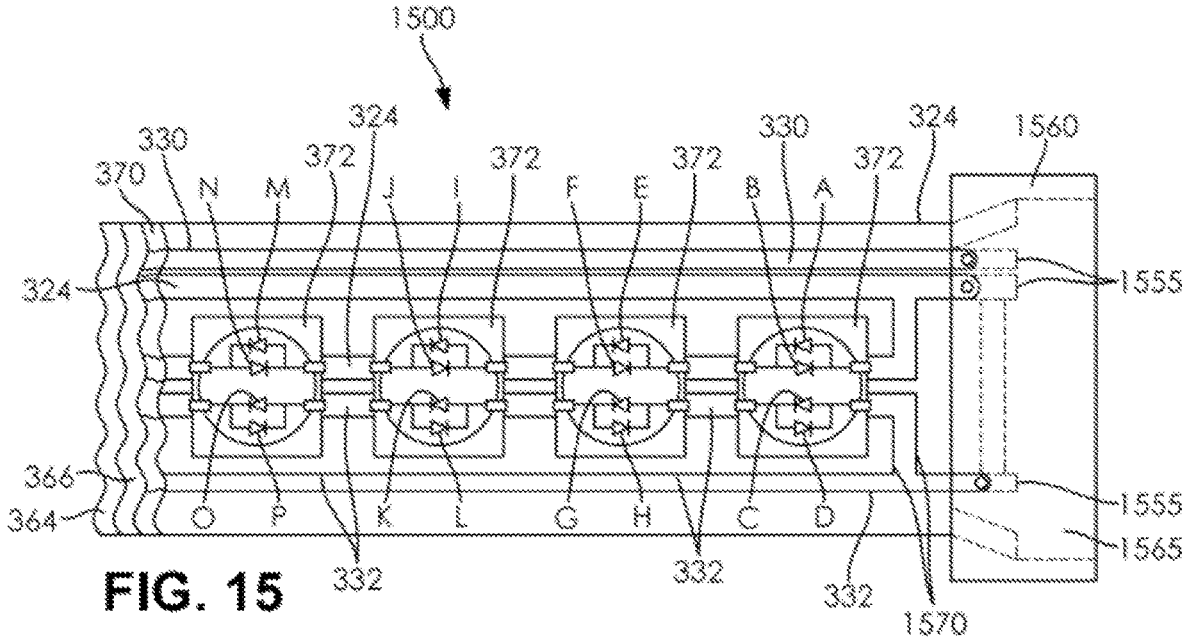
FIG. 15 depicts a top down partial cut-away view of a plurality of interconnected LED bulb housings of a flat rope light string system according to one embodiment of the present invention.

FIG. 15 illustrates another exemplary embodiment of the present invention. A system 1500 may include components similar to as described above regarding FIG. 3B. System 1500 may include an electrical connector 1550 that may be similar to electrical connector 650. Electrical connector 1550 may connect system 1500 to another component or assembly (e.g., system 500, system 600, system 700, system 800, system 900, system 1000, system 1100, system 1200, system 1300, system 1400, another system 1500, an electrical power source, or any other suitable electrical component). Electrical connector 1550 may include a plurality (e.g., four) of male pins 1555 that may be similar to male pins 555. System 1500 may be connected via one or more electrical connectors 1550 to other exemplary electrical components as described for example herein to form a light assembly (e.g., a lighting mat or a mat-like assembly as described for example regarding FIGS. 17-26 and 30-33). Electrical connector 1550 may include one or more connector walls 1560 that may form a connector cavity 1565 for receiving a plug or socket of another electrical component. As illustrated in FIG. 15, a plurality of electrical connectors 1570 (e.g., conductors or leads) may be electrically connected to electrical connector 1550, serve as return lines, and/or provide any other suitable electrical connection.

Figure 16:
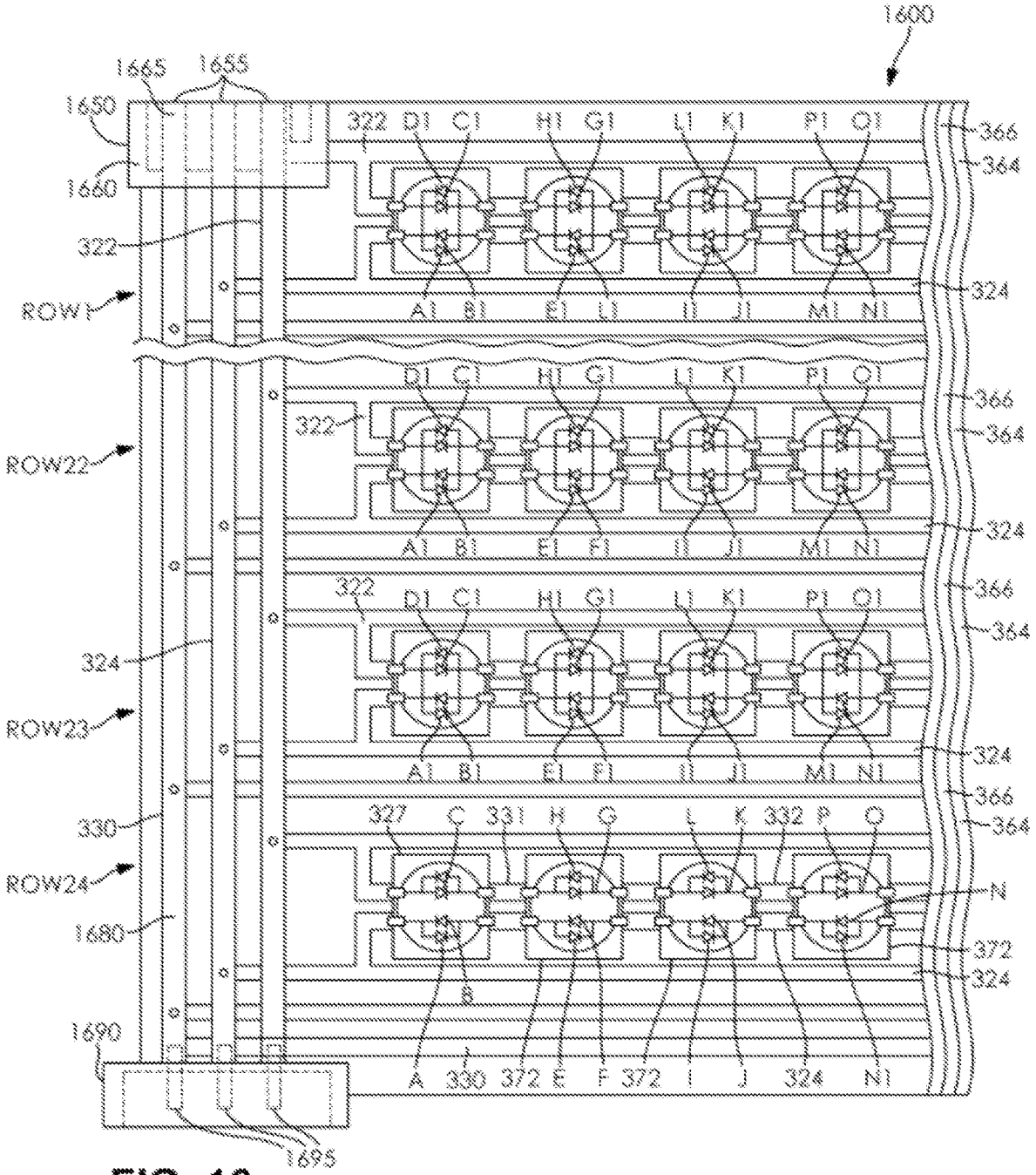
FIG. 16 depicts a top down partial cut-away view of a plurality of interconnected LED bulb housings of a flat rope light string system according to one embodiment of the present invention.

FIG. 16 illustrates another exemplary embodiment of the present invention. A system 1600 may include components similar to as described above regarding FIG. 15. System 1600 may include a plurality of components that may each be similar to system 1500. In at least some exemplary components, system 1600 may form a "mat" type configuration that may include an electrical connector 1650, which may be generally similar to electrical connector 1250, and multiple flat ropes (e.g., each similar to system 1500) that may be connected. Electrical connector 1650 may connect system 1500 to another component or assembly (e.g., system 500, system 600, system 700, system 800, system 900, system 1000, system 1100, system 1200, system 1300, system 1400, system 1500, another system 1600, an electrical power source, or any other suitable electrical component). Electrical connector 1650 may include a plurality (e.g., three) of female pins 1655 that may be configured to receive and/or electrically connect to male pins similar to male pins 555. System 1600 may be connected via one or more electrical connectors 1650 to other exemplary electrical components as described for example herein to form a light assembly (e.g., a lighting mat or a mat-like assembly as described for example regarding FIGS. 17-26 and 30-33). Electrical connector 1650 may include one or more connector walls 1660 that may form a connector cavity 1665 for receiving a plug or socket of another electrical component. System 1600 may also include an electrical connector 1690 that may be a male connector similar to electrical connector 550 and electrical connector 750. For example, electrical connector 1690 may include a plurality of male pins 1695 that may be similar to male pins 555. Electrical connector 1690 may connect system 1600 to other electrical components similar to as described above regarding electrical connector 1650.

System 1600 may include any desired number of rows. For example as illustrated in FIG. 16, system 1600 may include 24 rows (e.g., "Row 1" . . . "Row 22," "Row 23," and "Row 24") or any other desired number of rows. The exemplary rows (e.g., "Row 1" . . . "Row 22," "Row 23," and "Row 24") of system 1600 may correspond to any suitable exemplary arrangement such as the arrangements (e.g., having 24 rows or any other desired number of rows) depicted in FIGS. 17-26 and 30-33. System 1600 may also include an electrical connector 1680 such as a common return lead for example as illustrated in FIG. 16.

Figure 17:
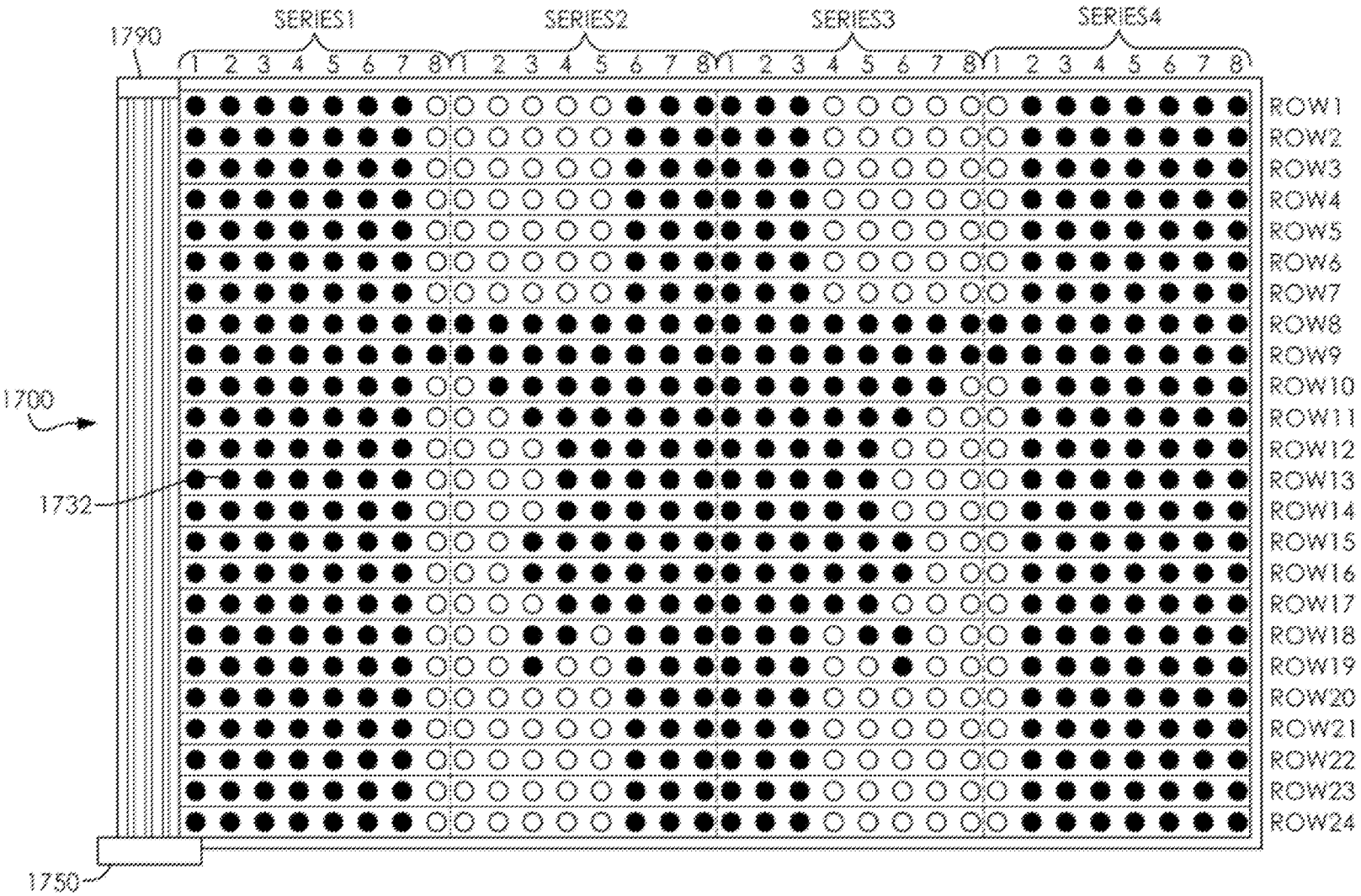
FIG. 17 is a schematic illustration of a flat rope light string system according to one embodiment of the present invention.

FIG. 17 illustrates another exemplary embodiment of the present invention. A system 1700 may be formed from any suitable exemplary embodiments described herein such as, for example, the exemplary embodiments described in FIGS. 5-9, 11-16, 27, 28, and/or 29. As illustrated in FIG. 17, system 1700 may include an electrical connector 1750 that may be a male connector similar to electrical connector 550 and electrical connector 750, and an electrical connector 1790 that may be a female electrical connector similar to electrical connector 1650. System 1700 may be a "mat" type configuration or grid including multiple exemplary disclosed flat ropes. System 1700 may include any desired number of rows and columns. For example, system 1700 may include any desired number of series (e.g., Series 1, 2, 3, and 4) of any desired length or configuration (e.g., such as described herein regarding FIGS. 5, 7-9, 12, 15, 28, and/or 29). System 1700 may also include "mat" type arrangements such as for example described herein regarding FIGS. 6, 11, 14, 16, and/or 27. For example, system 1700 may be formed from any desired combination of exemplary embodiments described for example herein. System 1700 may thereby form a grid of lighting elements 1732 similar to LED bulb housing 132. Any desired image, pattern, or shape may be displayed using the grid of lighting elements 1732. For example as illustrated in FIG. 17, system 1700 may display a pattern of stars and stripes (e.g., 3 red vertical stripes and two vertical white stripes with a blue star in the center). For example, system 1700 may display a $4^{th}$ of July patriotic pattern.

FIGS. 34A, 34B, and 34C depict an exemplary lighting pattern of lighting elements 1732 for displaying the exemplary embodiment of system 1700 described above. As illustrated in the chart of FIGS. 34A, 34B, and 34C, exemplary display colors are provided by row, series, and bulb.

Figure 18:
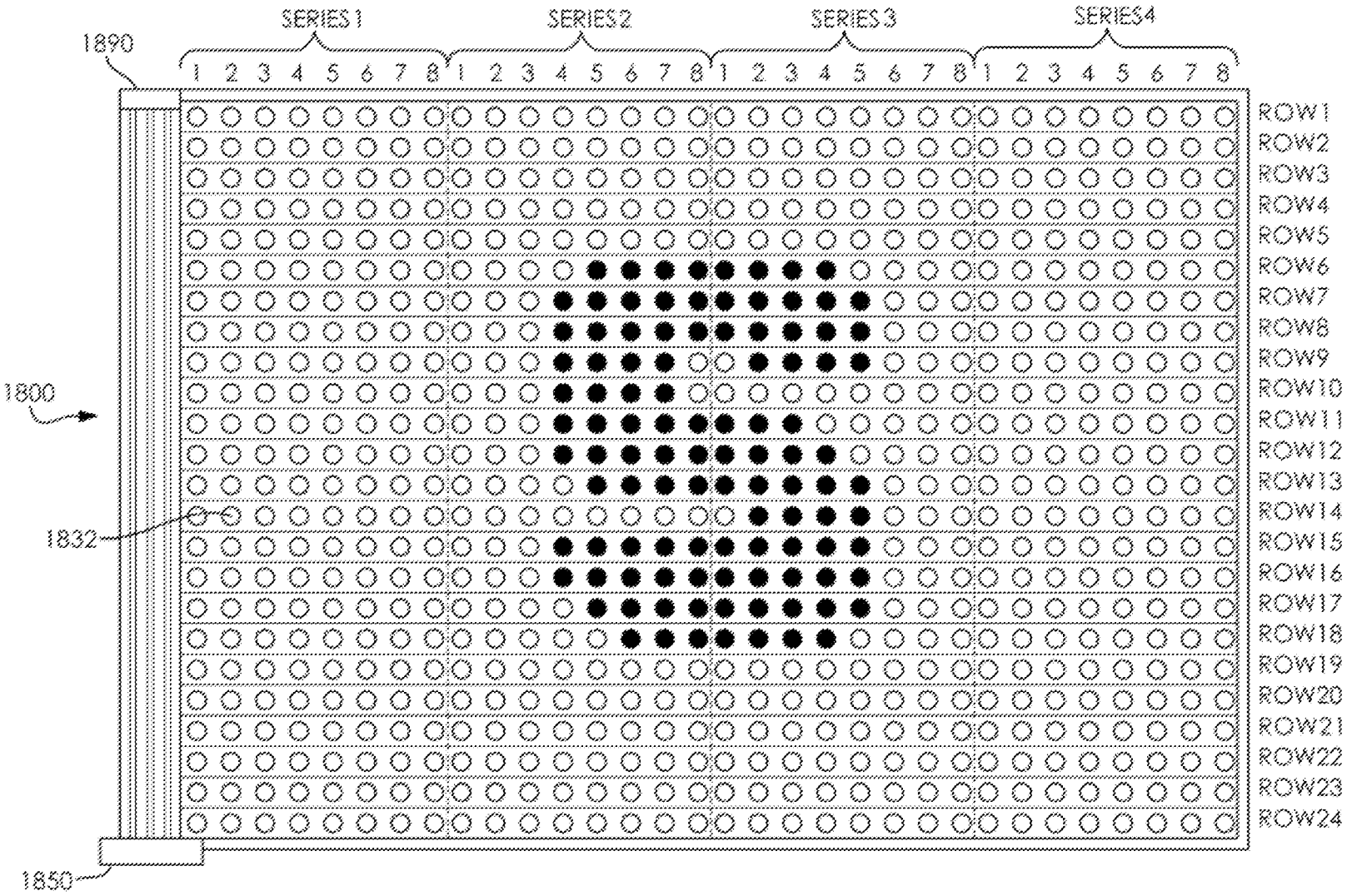
FIG. 18 is a schematic illustration of a flat rope light string system according to one embodiment of the present invention.

FIG. 18 illustrates another exemplary embodiment of the present invention. A system 1800 may be formed from any suitable exemplary embodiments described herein such as, for example, the exemplary embodiments described in FIGS. 5-9, 11-16, 27, 28, and/or 29. As illustrated in FIG. 18, system 1800 may include an electrical connector 1850 that may be a male connector similar to electrical connector 550 and electrical connector 750, and an electrical connector 1890 that may be a female electrical connector similar to electrical connector 1650. System 1800 may be a "mat" type configuration or grid including multiple exemplary disclosed flat ropes. System 1800 may include any desired number of rows and columns. For example, system 1800 may include any desired number of series (e.g., Series 1, 2, 3, and 4) of any desired length or configuration (e.g., such as described herein regarding FIGS. 5, 7-9, 12, 15, 28, and/or 29). System 1800 may also include "mat" type arrangements such as for example described herein regarding FIGS. 6, 11, 14, 16, and/or 27. For example, system 1800 may be formed from any desired combination of exemplary embodiments described for example herein. System 1800 may thereby form a grid of lighting elements 1832 similar to LED bulb housing 132. Any desired image, pattern, or shape may be displayed using the grid of lighting elements 1832. For example as illustrated in FIG. 18, system 1800 may display a symbol or logo associated with a school, college or university, or military branch or unit. For example, system 1800 may display a Michigan State display (e.g., college flag) having a white "S" on a green field.

FIGS. 35A and 35B depict an exemplary lighting pattern of lighting elements 1832 for displaying the exemplary embodiment of system 1800 described above. As illustrated in the chart of FIGS. 35A and 35B, exemplary display colors are provided by row, series, and bulb.

Figure 19:
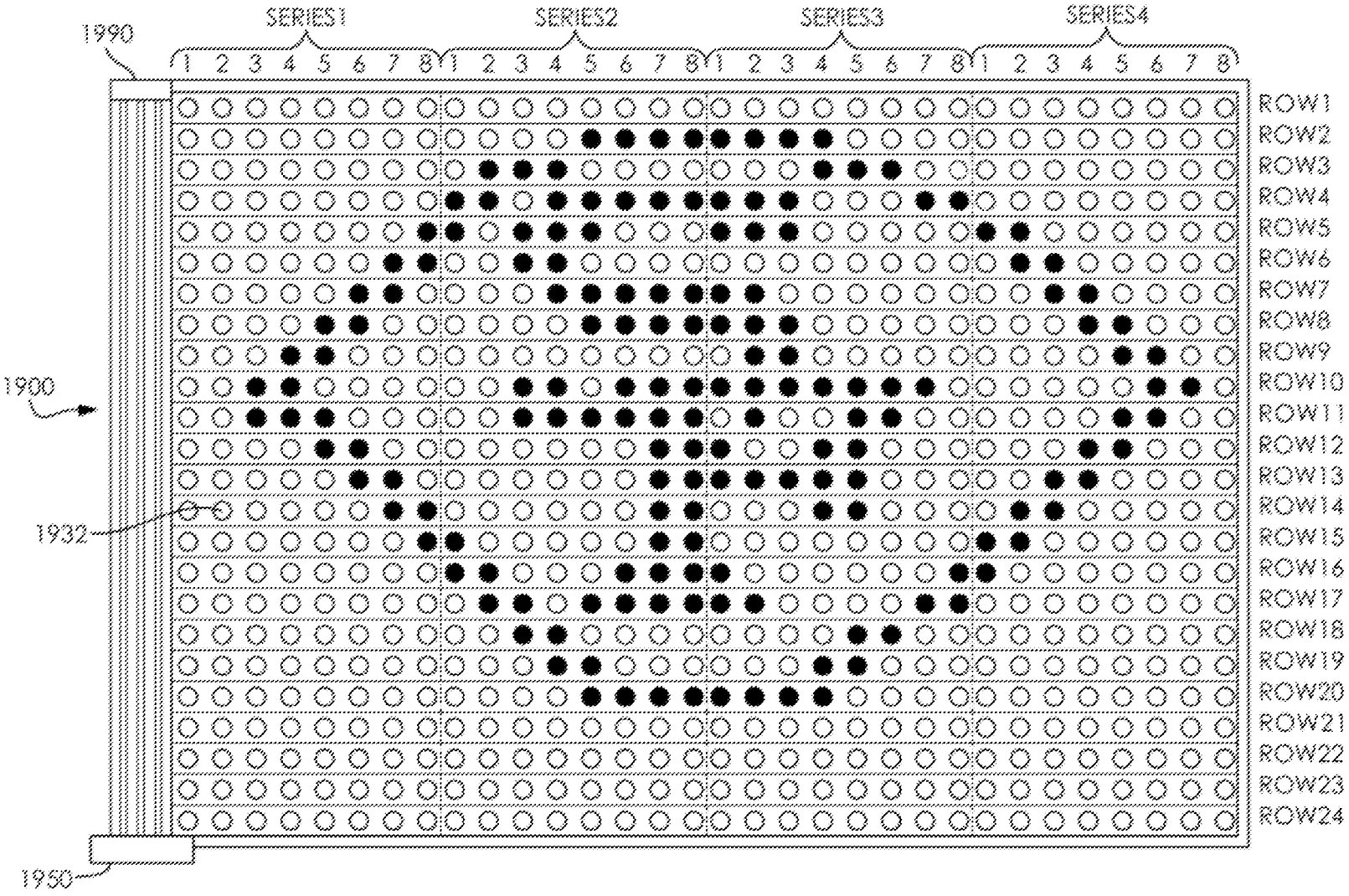
FIG. 19 is a schematic illustration of a flat rope light string system according to one embodiment of the present invention.

FIG. 19 illustrates another exemplary embodiment of the present invention. A system 1900 may be formed from any suitable exemplary embodiments described herein such as, for example, the exemplary embodiments described in FIGS. 5-9, 11-16, 27, 28, and/or 29. As illustrated in FIG. 19, system 1900 may include an electrical connector 1950 that may be a male connector similar to electrical connector 550 and electrical connector 750, and an electrical connector 1990 that may be a female electrical connector similar to electrical connector 1650. System 1900 may be a "mat" type configuration or grid including multiple exemplary disclosed flat ropes. System 1900 may include any desired number of rows and columns. For example, system 1900 may include any desired number of series (e.g., Series 1, 2, 3, and 4) of any desired length or configuration (e.g., such as described herein regarding FIGS. 5, 7-9, 12, 15, 28, and/or 29). System 1900 may also include "mat" type arrangements such as for example described herein regarding FIGS. 6, 11, 14, 16, and/or 27. For example, system 1900 may be formed from any desired combination of exemplary embodiments described for example herein. System 1900 may thereby form a grid of lighting elements 1932 similar to LED bulb housing 132. Any desired image, pattern, or shape may be displayed using the grid of lighting elements 1932. For example as illustrated in FIG. 19, system 1900 may display a symbol or logo associated with a sports team such as a professional sports team. For example, system 1900 may display a professional football logo (team flag) having a red background, white letters, and gold ring (e.g., San Francisco 49ers team logo).

FIGS. 36A, 36B, and 36C depict an exemplary lighting pattern of lighting elements 1932 for displaying the exemplary embodiment of system 1900 described above. As illustrated in the chart of FIGS. 36A, 36B, and 36C, exemplary display colors are provided by row, series, and bulb.

Figure 20:
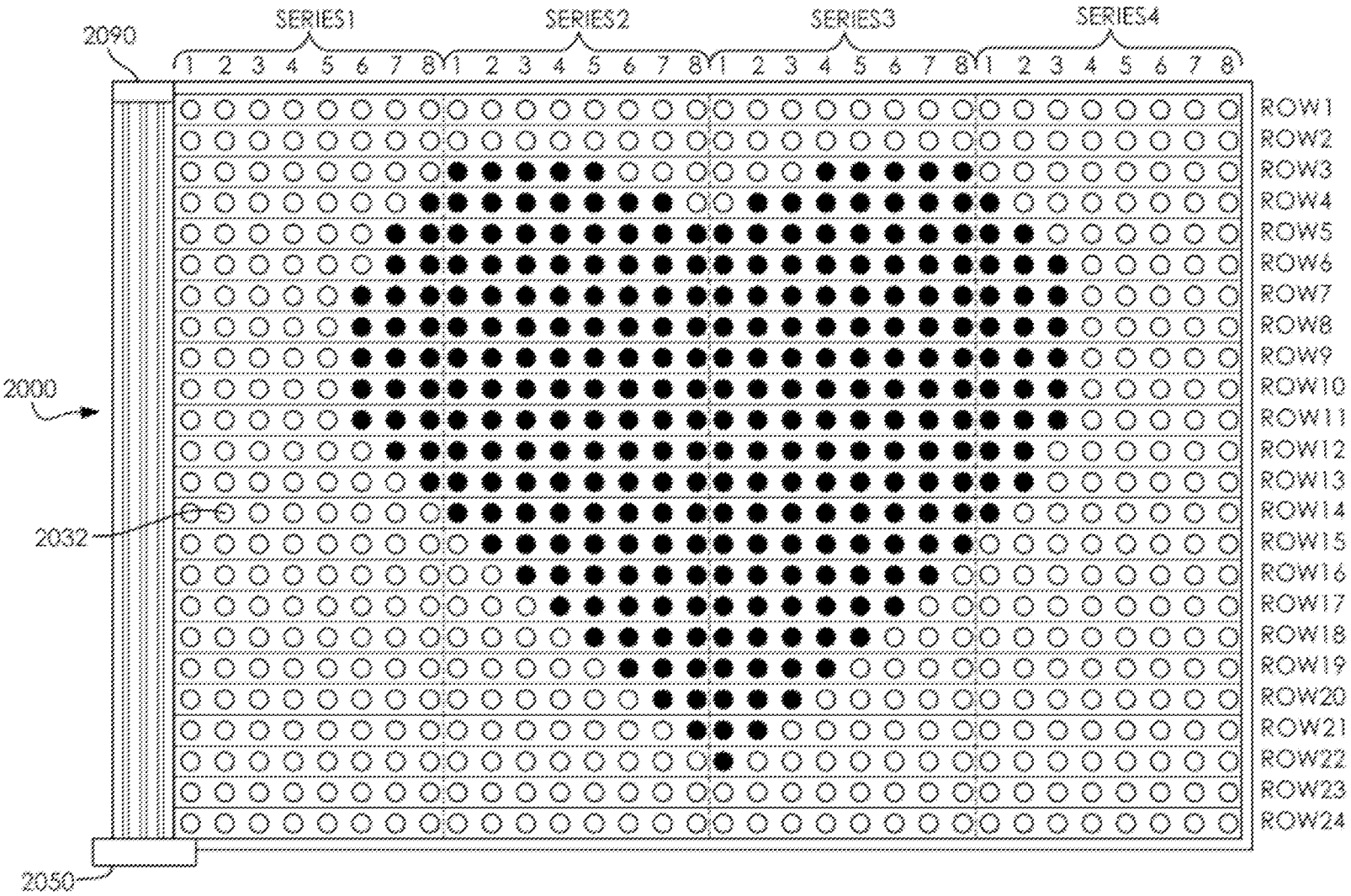
FIG. 20 is a schematic illustration of a flat rope light string system according to one embodiment of the present invention.

FIG. 20 illustrates another exemplary embodiment of the present invention. A system 2000 may be formed from any suitable exemplary embodiments described herein such as, for example, the exemplary embodiments described in FIGS. 5-9, 11-16, 27, 28, and/or 29. As illustrated in FIG. 20, system 2000 may include an electrical connector 2050 that may be a male connector similar to electrical connector 550 and electrical connector 750, and an electrical connector 2090 that may be a female electrical connector similar to electrical connector 1650. System 2000 may be a "mat" type configuration or grid including multiple exemplary disclosed flat ropes. System 2000 may include any desired number of rows and columns. For example, system 2000 may include any desired number of series (e.g., Series 1, 2, 3, and 4) of any desired length or configuration (e.g., such as described herein regarding FIGS. 5, 7-9, 12, 15, 28, and/or 29). System 2000 may also include "mat" type arrangements such as for example described herein regarding FIGS. 6, 11, 14, 16, and/or 27. For example, system 2000 may be formed from any desired combination of exemplary embodiments described for example herein. System 2000 may thereby form a grid of lighting elements 2032 similar to LED bulb housing 132. Any desired image, pattern, or shape may be displayed using the grid of lighting elements 2032. For example as illustrated in FIG. 20, system 2000 may display a symbol or design associated with a holiday. For example, system 2000 may display a Valentine's red heart on a white background.

FIGS. 37A and 37B depict an exemplary lighting pattern of lighting elements 2032 for displaying the exemplary embodiment of system 2000 described above. As illustrated in the chart of FIGS. 37A and 37B, exemplary display colors are provided by row, series, and bulb.

Figure 21:
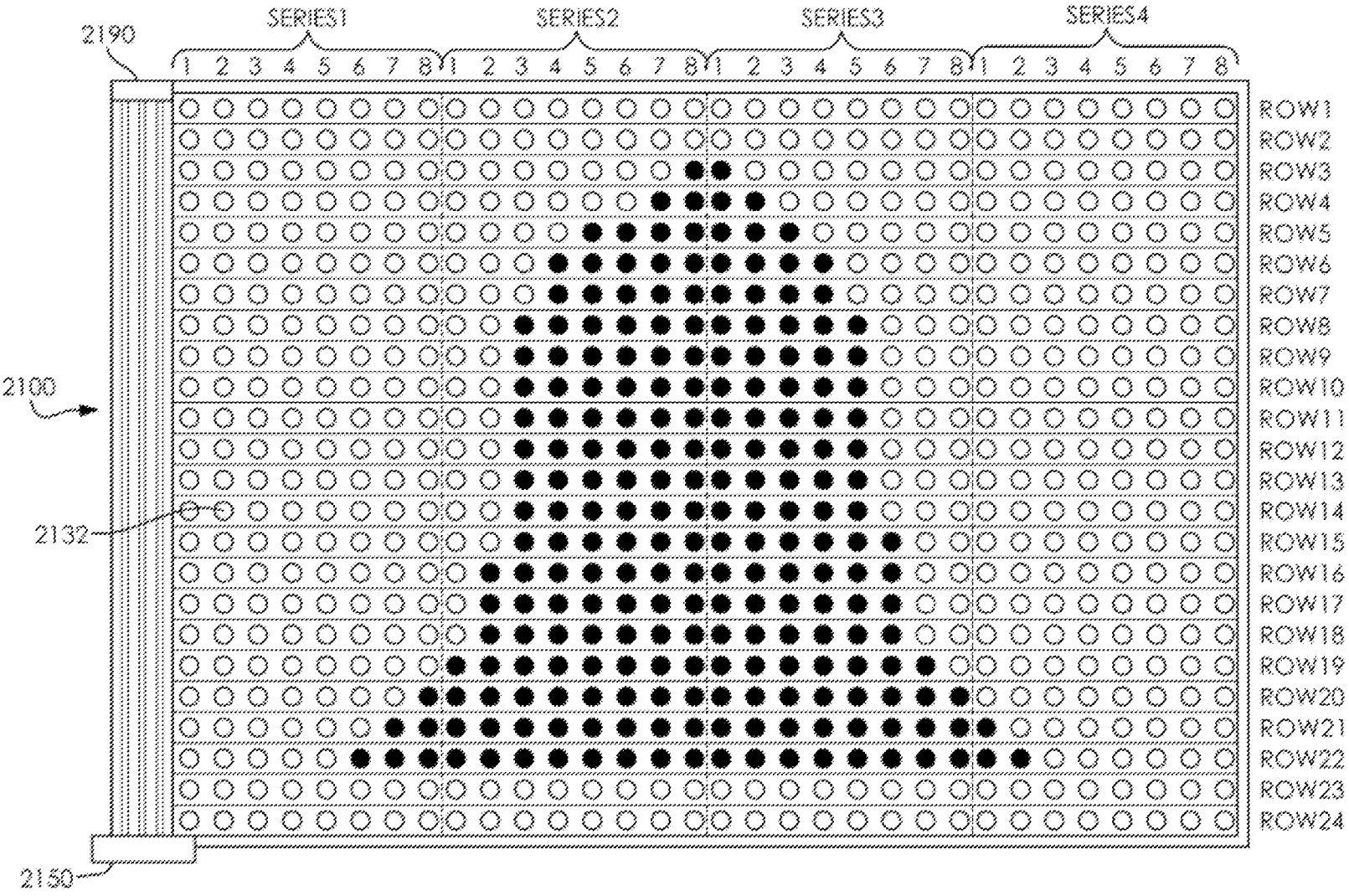
FIG. 21 is a schematic illustration of a flat rope light string system according to one embodiment of the present invention.

FIG. 21 illustrates another exemplary embodiment of the present invention. A system 2100 may be formed from any suitable exemplary embodiments described herein such as, for example, the exemplary embodiments described in FIGS. 5-9, 11-16, 27, 28, and/or 29. As illustrated in FIG. 21, system 2100 may include an electrical connector 2150 that may be a male connector similar to electrical connector 550 and electrical connector 750, and an electrical connector 2190 that may be a female electrical connector similar to electrical connector 1650. System 2100 may be a "mat" type configuration or grid including multiple exemplary disclosed flat ropes. System 2100 may include any desired number of rows and columns. For example, system 2100 may include any desired number of series (e.g., Series 1, 2, 3, and 4) of any desired length or configuration (e.g., such as described herein regarding FIGS. 5, 7-9, 12, 15, 28, and/or 29). System 2100 may also include "mat" type arrangements such as for example described herein regarding FIGS. 6, 11, 14, 16, and/or 27. For example, system 2100 may be formed from any desired combination of exemplary embodiments described for example herein. System 2100 may thereby form a grid of lighting elements 2132 similar to LED bulb housing 132. Any desired image, pattern, or shape may be displayed using the grid of lighting elements 2132. For example as illustrated in FIG. 21, system 2100 may display a moving or dynamic symbol or design associated with a holiday. Any of the exemplary disclosed embodiments of FIGS. 17-26 and 30-33 may be moving or dynamic displays. For example, system 2100 may display a yellow Christmas Bell with a red clapper on a green background. For example, system 2100 may be a flat rope "mat" display that provides an appearance of movement. For example, the yellow bell of system 2100 may appear to move slightly to the right or left based on lighting elements 2132 changing color (e.g., based on the exemplary switch positions described herein). System 2100 may thereby display (e.g., based on the exemplary disclosed switching) a bell swinging back and forth, giving the appearance of movement.

FIGS. 38A and 38B depict an exemplary lighting pattern of lighting elements 2132 for displaying the exemplary embodiment of system 2100 described above. As illustrated in the chart of FIGS. 38A and 38B, exemplary display colors are provided by row, series, and bulb.

Figure 22:
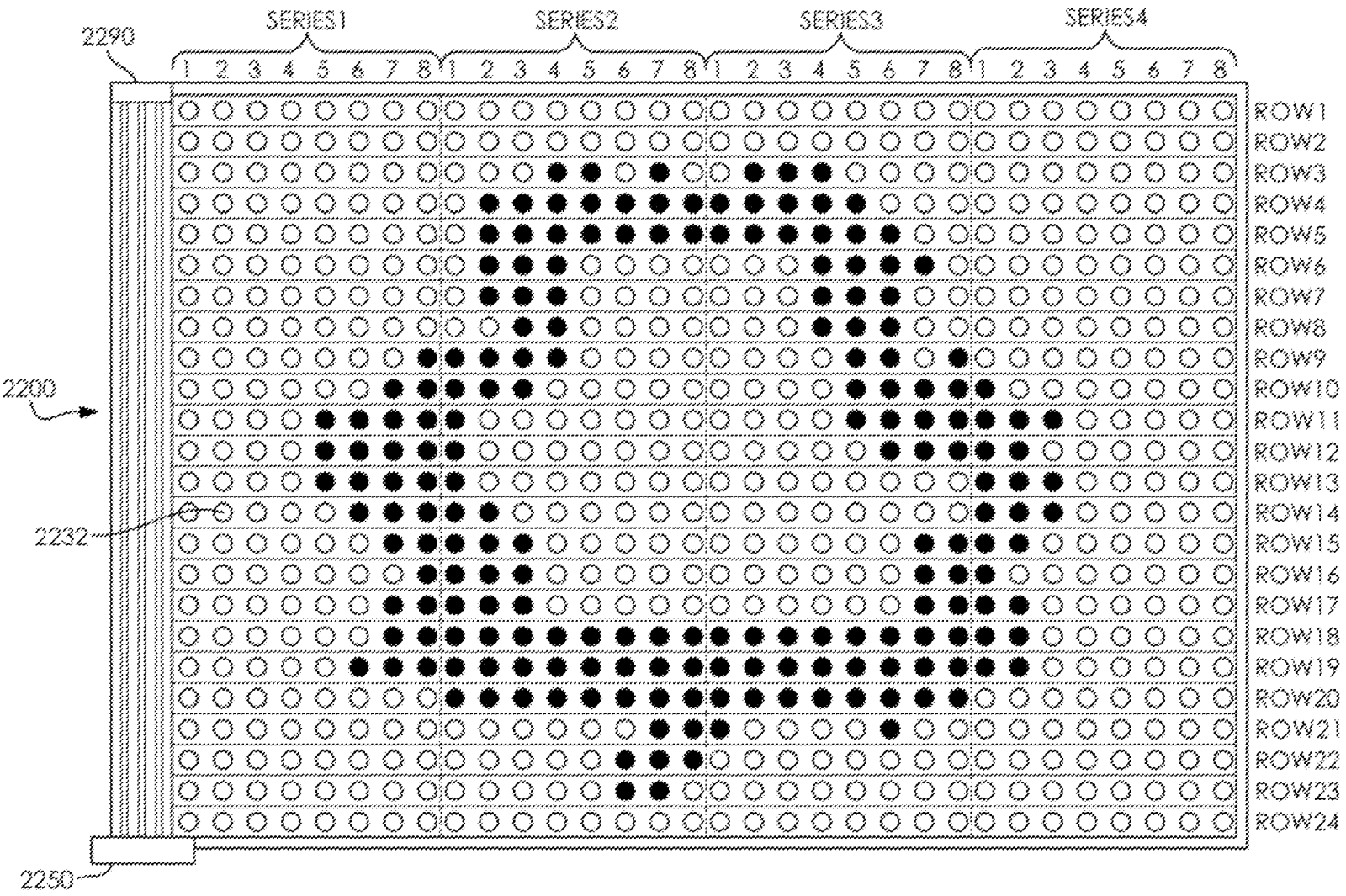
FIG. 22 is a schematic illustration of a flat rope light string system according to one embodiment of the present invention.

FIG. 22 illustrates another exemplary embodiment of the present invention. A system 2200 may be formed from any suitable exemplary embodiments described herein such as, for example, the exemplary embodiments described in FIGS. 5-9, 11-16, 27, 28, and/or 29. As illustrated in FIG. 20, system 2200 may include an electrical connector 2250 that may be a male connector similar to electrical connector 550 and electrical connector 750, and an electrical connector 2290 that may be a female electrical connector similar to electrical connector 1650. System 2200 may be a "mat" type configuration or grid including multiple exemplary disclosed flat ropes. System 2200 may include any desired number of rows and columns. For example, system 2200 may include any desired number of series (e.g., Series 1, 2, 3, and 4) of any desired length or configuration (e.g., such as described herein regarding FIGS. 5, 7-9, 12, 15, 28, and/or 29). System 2200 may also include "mat" type arrangements such as for example described herein regarding FIGS. 6, 11, 14, 16, and/or 27. For example, system 2200 may be formed from any desired combination of exemplary embodiments described for example herein. System 2200 may thereby form a grid of lighting elements 2232 similar to LED bulb housing 132. Any desired image, pattern, or shape may be displayed using the grid of lighting elements 2232. For example as illustrated in FIG. 22, system 2200 may display a symbol or design associated with a holiday. For example, system 2200 may display a white shamrock on a green background (e.g., a St. Patrick's Day design).

FIGS. 39A and 39B depict an exemplary lighting pattern of lighting elements 2232 for displaying the exemplary embodiment of system 2200 described above. As illustrated in the chart of FIGS. 39A and 39B, exemplary display colors are provided by row, series, and bulb.

Figure 23:
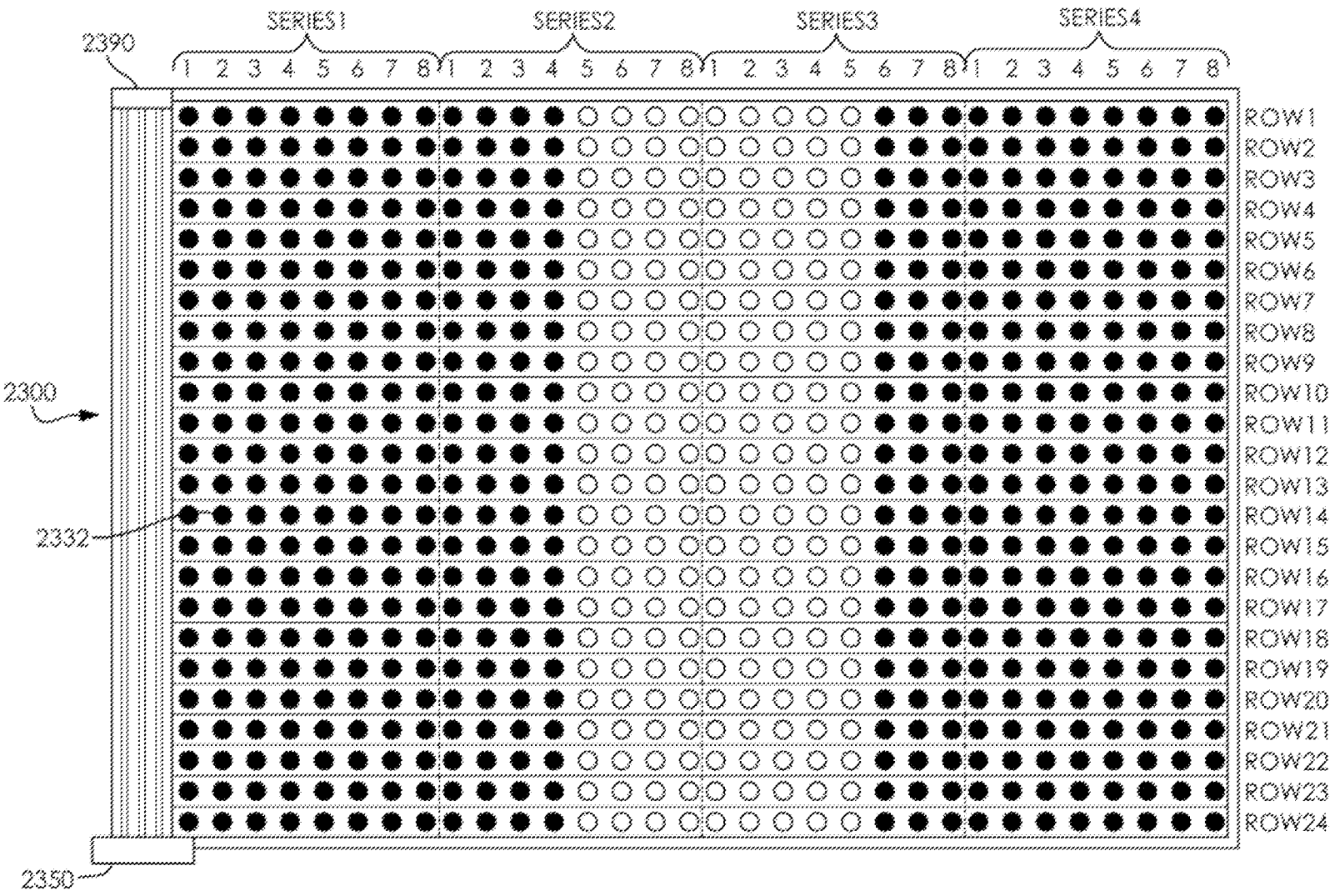
FIG. 23 is a schematic illustration of a flat rope light string system according to one embodiment of the present invention.
Figure 24:
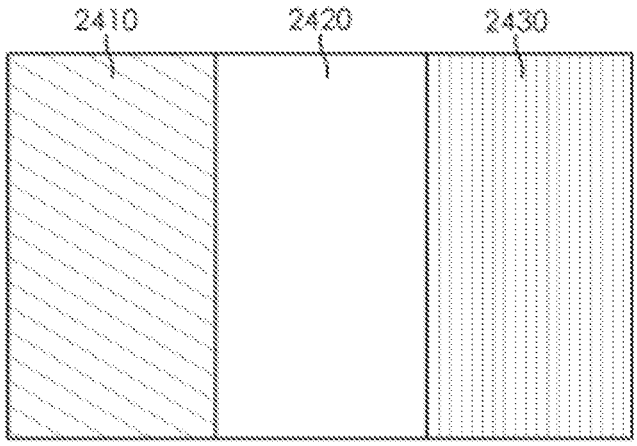
FIG. 24 is a schematic illustration of a flat rope light string system according to one embodiment of the present invention.
Figure 25:
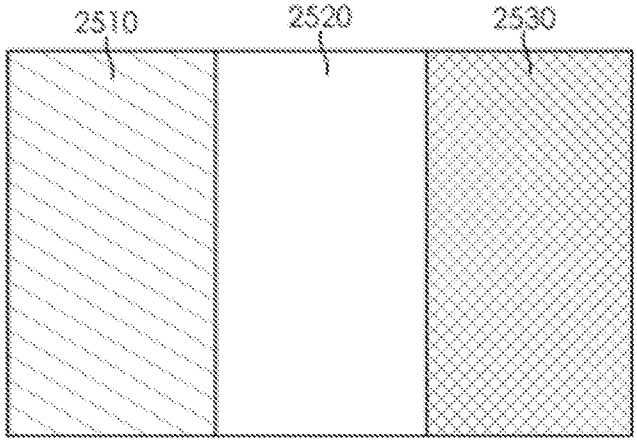
FIG. 25 is a schematic illustration of a flat rope light string system according to one embodiment of the present invention.
Figure 26:
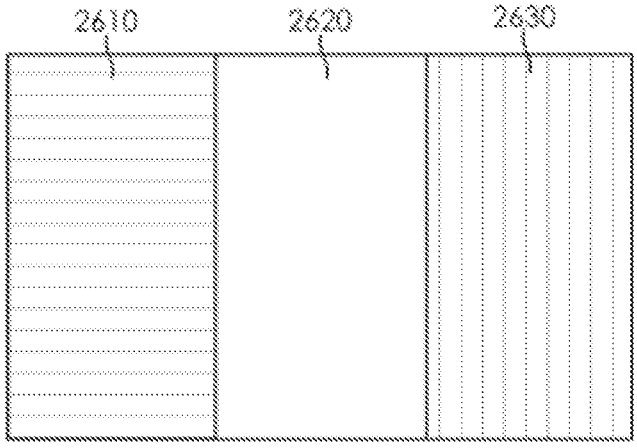
FIG. 26 is a schematic illustration of a flat rope light string system according to one embodiment of the present invention.

FIG. 23 illustrates another exemplary embodiment of the present invention. A system 2300 may be formed from any suitable exemplary embodiments described herein such as, for example, the exemplary embodiments described in FIGS. 5-9, 11-16, 27, 28, and/or 29. As illustrated in FIG. 23, system 2300 may include an electrical connector 2350 that may be a male connector similar to electrical connector 550 and electrical connector 750, and an electrical connector 2390 that may be a female electrical connector similar to electrical connector 1650. System 2300 may be a "mat" type configuration or grid including multiple exemplary disclosed flat ropes. System 2300 may include any desired number of rows and columns. For example, system 2300 may include any desired number of series (e.g., Series 1, 2, 3, and 4) of any desired length or configuration (e.g., such as described herein regarding FIGS. 5, 7-9, 12, 15, 28, and/or 29). System 2300 may also include "mat" type arrangements such as for example described herein regarding FIGS. 6, 11, 14, 16, and/or 27. For example, system 2300 may be formed from any desired combination of exemplary embodiments described for example herein. System 2300 may thereby form a grid of lighting elements 2332 similar to LED bulb housing 132. Any desired image, pattern, or shape may be displayed using the grid of lighting elements 2332. For example as illustrated in FIG. 23, system 2300 may display a flag design associated with a country, state, city, or other desired territory or organization. For example, system 2300 may display a tri-color flag (e.g., including three vertical bands of two or three different colors) and/or flag having any other desired design. For example as illustrated in FIG. 24, lighting elements 2332 of system 2300 may display a first band 2410 of green light, a second band 2420 of white light, and a third band 2430 of red light that may for example represent a Mexican or Italian flag. For example as illustrated in FIG. 25, lighting elements 2332 of system 2300 may display a first band 2510 of green light, a second band 2520 of white light, and a third band 2530 of orange light that may for example represent an Irish flag. For example as illustrated in FIG. 26, lighting elements 2332 of system 2300 may display a first band 2610 of blue light, a second band 2620 of white light, and a third band 2630 of red light that may for example represent a French flag.

FIGS. 40A and 40B depict an exemplary lighting pattern of lighting elements 2332 for displaying the exemplary embodiment of an Italian Flag of FIG. 24 described above. As illustrated in the chart of FIGS. 40A and 40B, exemplary display colors are provided by row, series, and bulb.

FIGS. 41A and 41B depict an exemplary lighting pattern of lighting elements 2332 for displaying the exemplary embodiment of a Mexican Flag of FIG. 24 described above. As illustrated in the chart of FIGS. 41A and 41B, exemplary display colors are provided by row, series, and bulb.

FIGS. 42A and 42B depict an exemplary lighting pattern of lighting elements 2332 for displaying the exemplary embodiment of an Irish Flag of FIG. 25 described above. As illustrated in the chart of FIGS. 42A and 42B, exemplary display colors are provided by row, series, and bulb.

FIGS. 43A and 43B depict an exemplary lighting pattern of lighting elements 2332 for displaying the exemplary embodiment of a French Flag of FIG. 26 described above. As illustrated in the chart of FIGS. 43A and 43B, exemplary display colors are provided by row, series, and bulb.

Figure 27:
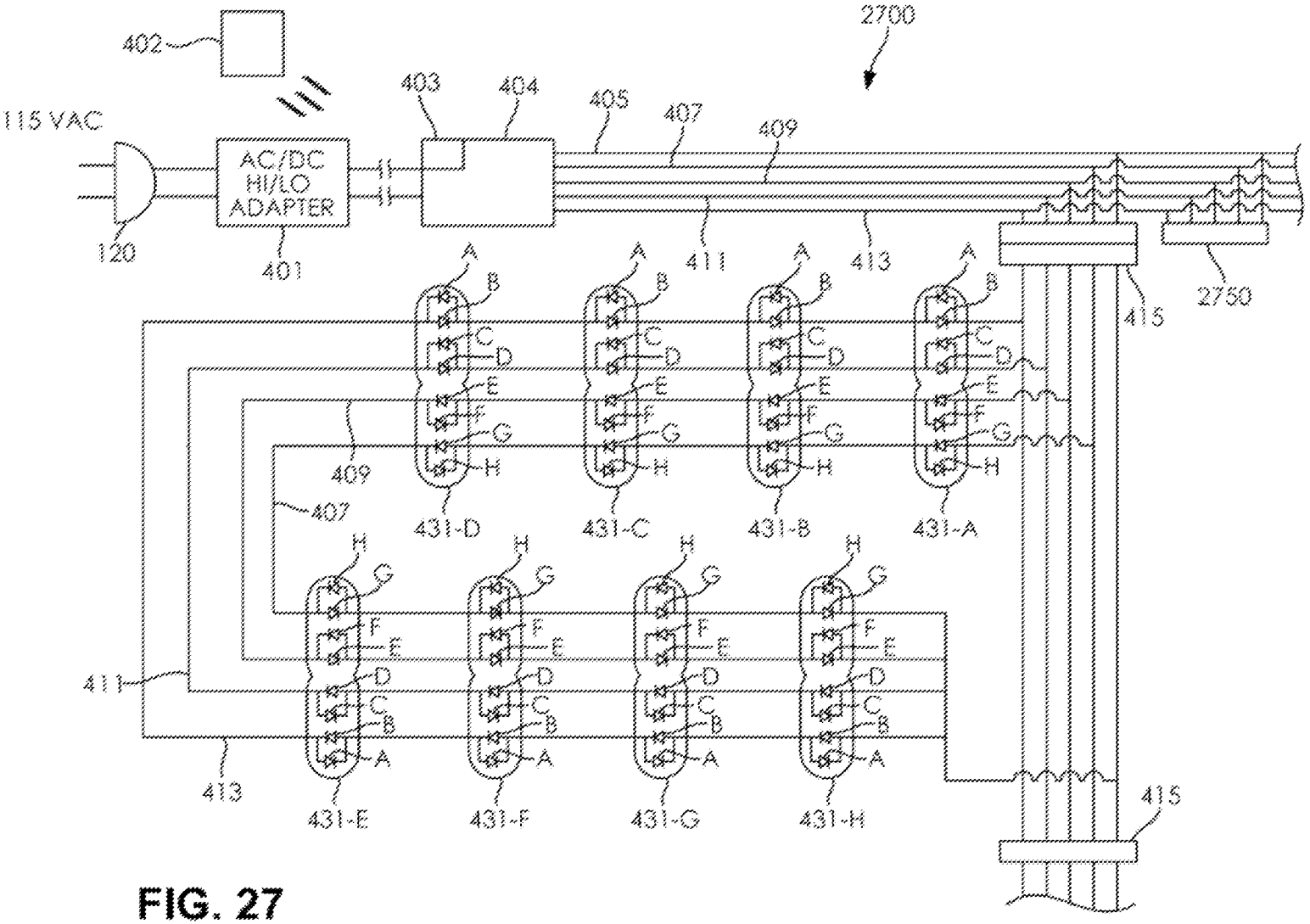
FIG. 27 depicts a circuit diagram of a flat rope light string system according to one embodiment of the present invention.

FIG. 27 illustrates another exemplary embodiment of the present invention. A system 2700 may include components similar to as described above regarding FIG. 4A. System 2700 may be a flat rope light string system including eight light strings 431A-H. As illustrated in FIG. 27, system 2700 may include an electrical connector 2750 that may be similar to electrical connector 650. Electrical connector 2750 may be connected to conductors 405, 407, 409, 411, and 413 similarly as electrical connector 415 illustrated in FIG. 27. Any desired number of electrical connectors 2750 may be connected to system 2700. Electrical components may be attached to system 2700 by electrical connection to electrical connectors 2750. For example, electrical connectors 2750 may connect system 2700 to another component or assembly (e.g., one or more of the exemplary systems described for example herein and/or any other suitable electrical component). In at least some exemplary embodiments, a plurality of flat rope segments may be added via electrical connectors 2750. For example, electrical connectors 2750 may connect a plurality of exemplary disclosed systems to form a light assembly (e.g., a lighting mat or a mat-like assembly as described for example regarding FIGS. 17-26 and 30-33).

Figure 28:
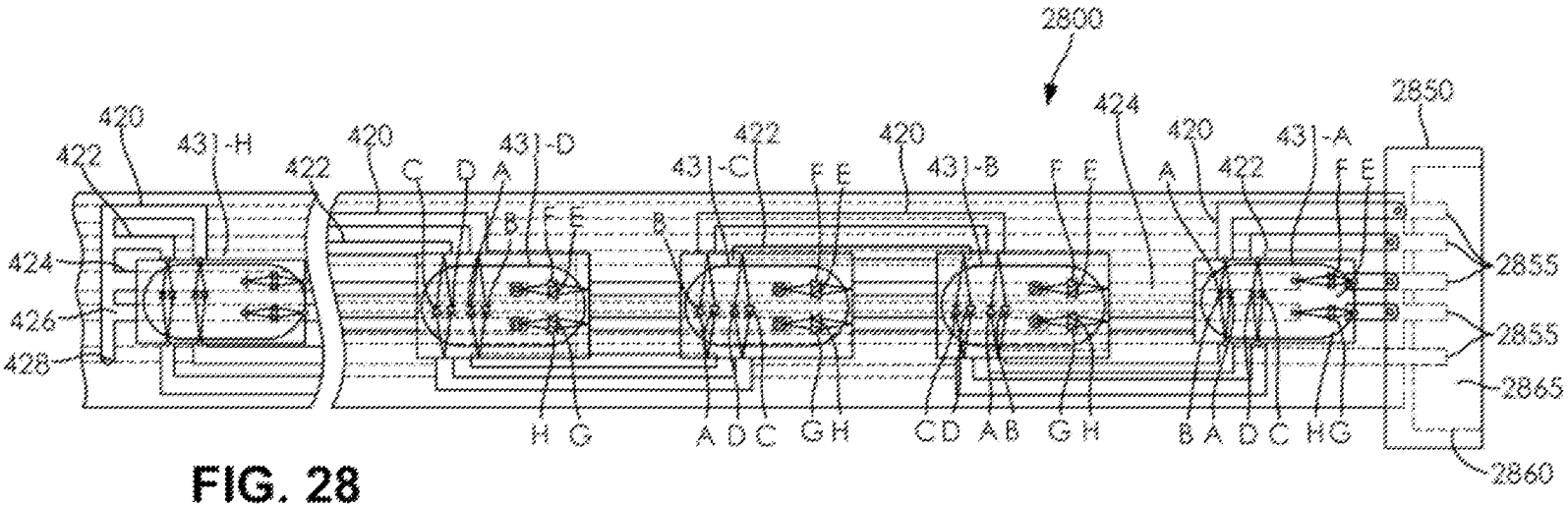
FIG. 28 is a top view of the light elements and sockets according to one embodiment of the present invention.

FIG. 28 illustrates another exemplary embodiment of the present invention. A system 2800 may include components similar to as described above regarding FIG. 4B. System 2800 may include an electrical connector 2850 that may be similar to electrical connector 650. Electrical connector 2850 may connect system 2800 to another component or assembly (e.g., one or more of the exemplary systems described for example herein and/or any other suitable electrical component). Electrical connector 2850 may include a plurality (e.g., five) of male pins 2855 that may be similar to male pins 555. System 2800 may be connected via one or more electrical connectors 2850 to other exemplary electrical components as described for example herein to form a light assembly (e.g., a lighting mat or a mat-like assembly as described for example regarding FIGS. 17-26 and 30-33). Electrical connector 2850 may include one or more connector walls 2860 that may form a connector cavity 2865 for receiving a plug or socket of another electrical component.

Figure 29:
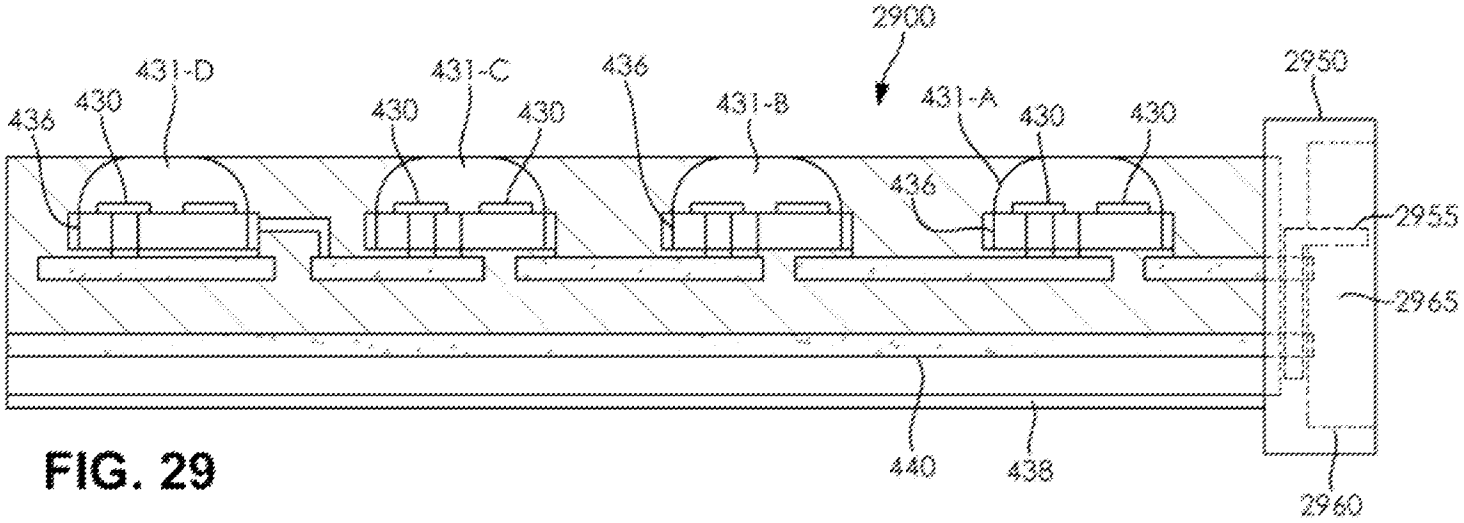
FIG. 29 is a side view of the light elements and sockets according to one embodiment of the present invention.

FIG. 29 illustrates another exemplary embodiment of the present invention. A system 2900 may include components similar to as described above regarding FIG. 4C. System 2900 may include an electrical connector 2950 that may be similar to electrical connector 650. Electrical connector 2950 may connect system 2900 to another component or assembly (e.g., one or more of the exemplary systems described for example herein and/or any other suitable electrical component). Electrical connector 2950 may include one or more male pins 2955 that may be similar to male pins 555. System 2900 may be connected via one or more electrical connectors 2950 to other exemplary electrical components as described for example herein to form a light assembly (e.g., a lighting mat or a mat-like assembly as described for example regarding FIGS. 17-26 and 30-33). Electrical connector 2950 may include one or more connector walls 2960 that may form a connector cavity 2965 for receiving a plug or socket of another electrical component.

Figure 30:
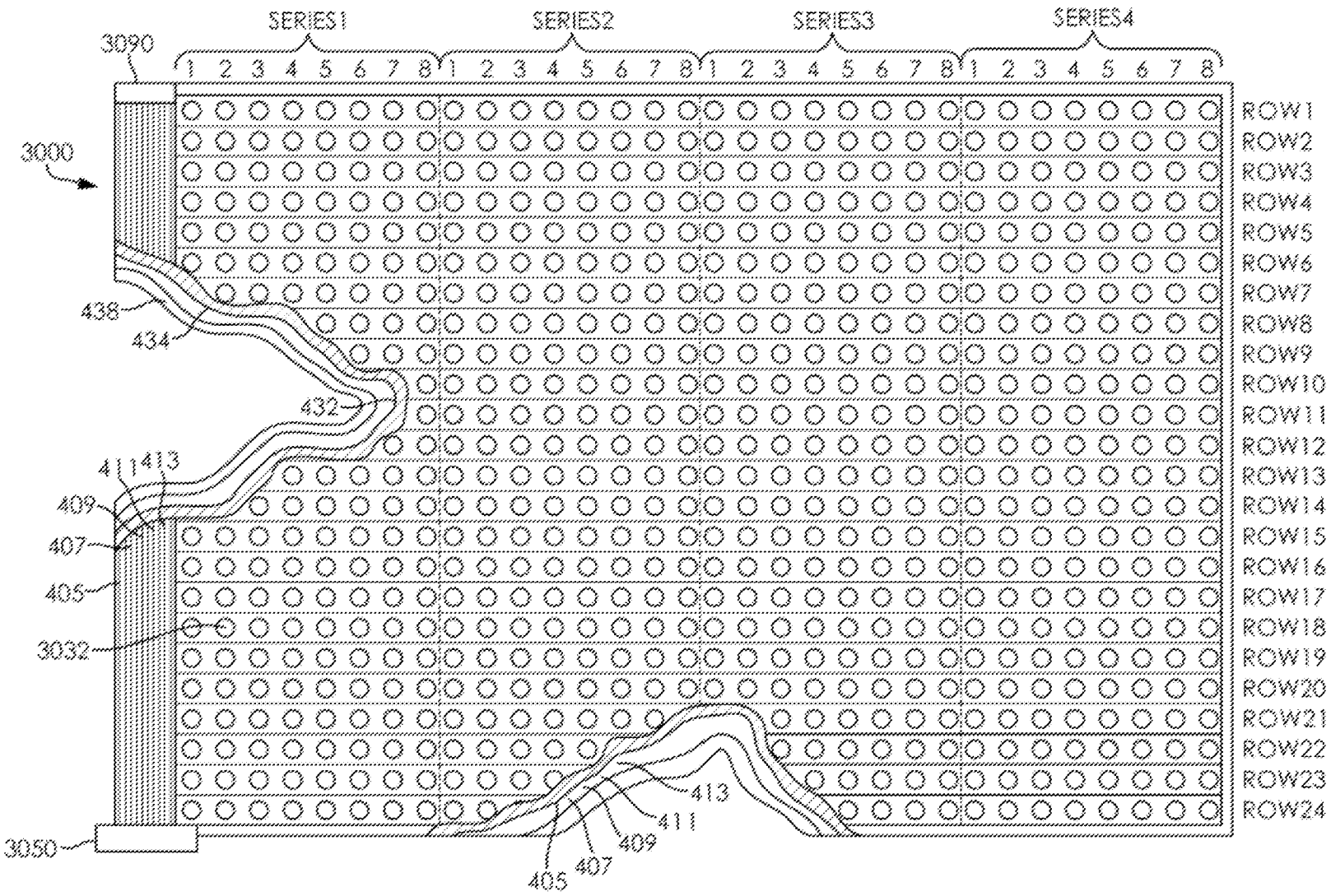
FIG. 30 depicts a top down partial cut-away view of a plurality of a flat rope light string system according to one embodiment of the present invention.

FIG. 30 illustrates another exemplary embodiment of the present invention. A system 3000 may be formed from any suitable exemplary embodiments described herein such as, for example, the exemplary embodiments described in FIGS. 5-9, 11-16, 27, 28, and/or 29. As illustrated in FIG. 30, system 3000 may include an electrical connector 3050 that may be a male connector similar to electrical connector 550 and electrical connector 750, and an electrical connector 3090 that may be a female electrical connector similar to electrical connector 1650. System 3000 may be a "mat" type configuration or grid including multiple exemplary disclosed flat ropes. System 3000 may include any desired number of rows and columns. For example, system 3000 may include any desired number of series (e.g., Series 1, 2, 3, and 4) of any desired length or configuration (e.g., such as described herein regarding FIGS. 5, 7-9, 12, 15, 28, and/or 29). System 3000 may also include "mat" type arrangements such as for example described herein regarding FIGS. 6, 11, 14, 16, and/or 27. For example, system 3000 may be formed from any desired combination of exemplary embodiments described for example herein. System 3000 may thereby form a grid of lighting elements 3032 similar to LED bulb housing 132. Any desired image, pattern, or shape may be displayed using the grid of lighting elements 3032. As illustrated in the partial cut-away view of FIG. 30, system 3000 may include conductors 405, 407, 409, 411, and 413, and conductors 432, 434, and 438 (e.g., and/or insulating layers).

Figure 31:
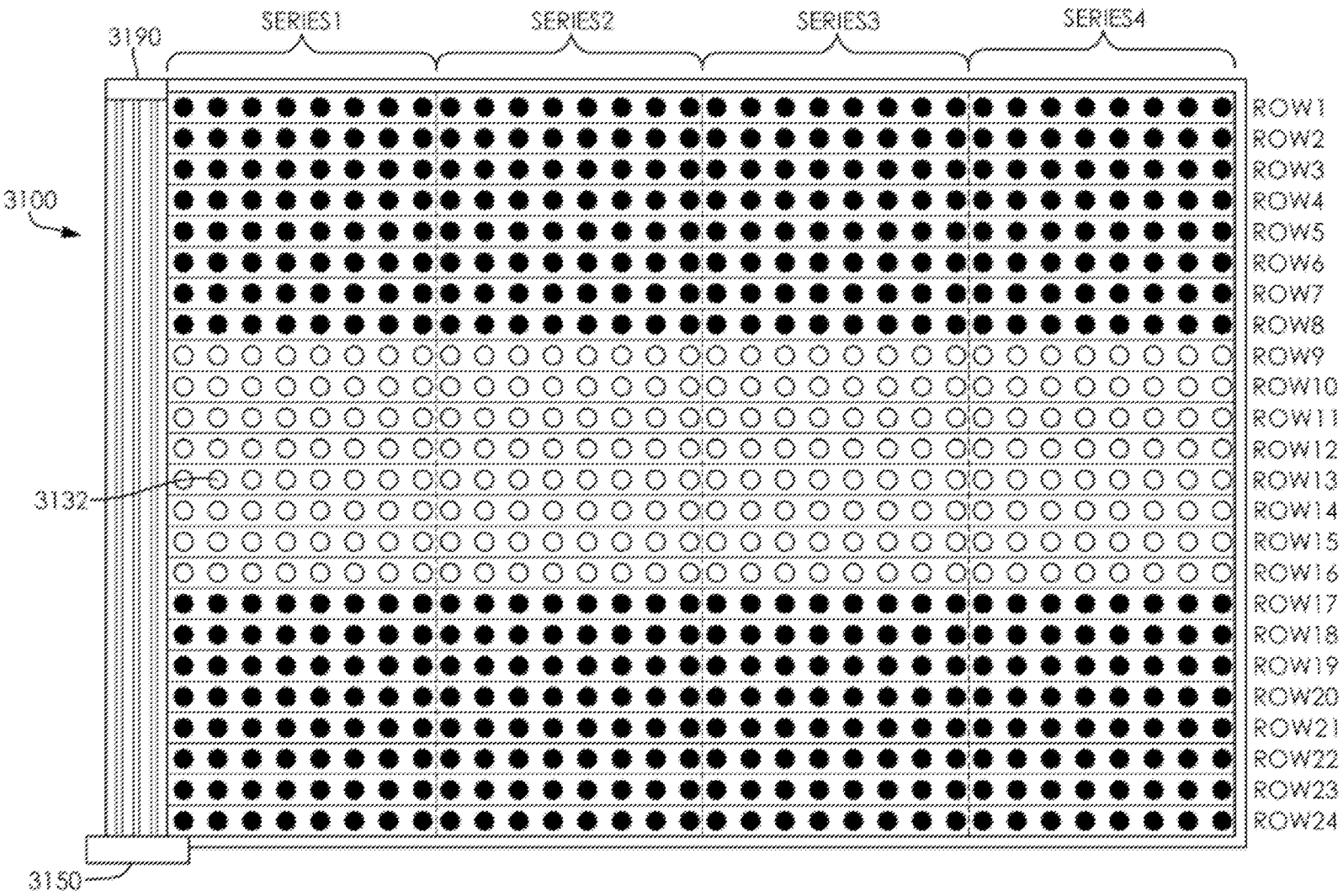
FIG. 31 is a schematic illustration of a flat rope light string system according to one embodiment of the present invention.

FIG. 31 illustrates another exemplary embodiment of the present invention. A system 3100 may be formed from any suitable exemplary embodiments described herein such as, for example, the exemplary embodiments described in FIGS. 5-9, 11-16, 27, 28, and/or 29. As illustrated in FIG. 31, system 3100 may include an electrical connector 3150 that may be a male connector similar to electrical connector 550 and electrical connector 750, and an electrical connector 3190 that may be a female electrical connector similar to electrical connector 1650. System 3100 may be a "mat" type configuration or grid including multiple exemplary disclosed flat ropes. System 3100 may include any desired number of rows and columns. For example, system 3100 may include any desired number of series (e.g., Series 1, 2, 3, and 4) of any desired length or configuration (e.g., such as described herein regarding FIGS. 5, 7-9, 12, 15, 28, and/or 29). System 3100 may also include "mat" type arrangements such as for example described herein regarding FIGS. 6, 11, 14, 16, and/or 27. For example, system 3100 may be formed from any desired combination of exemplary embodiments described for example herein. System 3100 may thereby form a grid of lighting elements 3132 similar to LED bulb housing 132. Any desired image, pattern, or shape may be displayed using the grid of lighting elements 3132. For example as illustrated in FIG. 31, system 3100 may display a pattern having horizontal bands or stripes. For example, system 3100 may display a Mardi Gras flag (e.g., flag matrix). For example as illustrated in FIG. 32, lighting elements 3132 of system 3100 may display a first band 3210 of green light, a second band 3220 of yellow light, and a third band 3230 of purple light that may for example represent a Mardi Gras flag.

Figure 32:
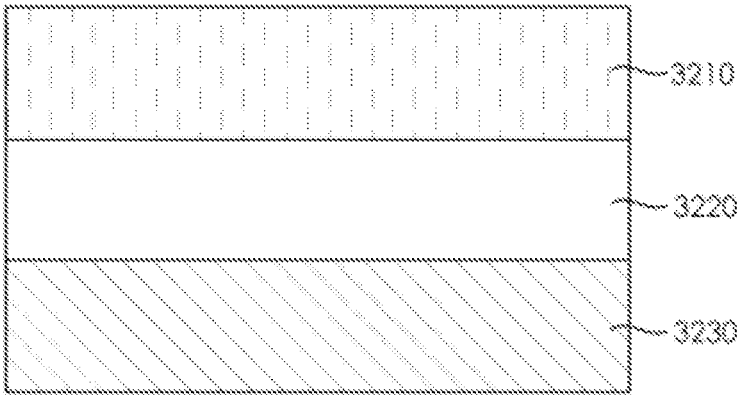
FIG. 32 is a schematic illustration of a flat rope light string system according to one embodiment of the present invention.

FIGS. 44A and 44B depict an exemplary lighting pattern of lighting elements 3132 for displaying the exemplary embodiment of system 3100 described above (e.g., as illustrated in FIG. 32). As illustrated in the chart of FIGS. 44A and 44B, exemplary display colors are provided by row, series, and bulb.

Figure 33:
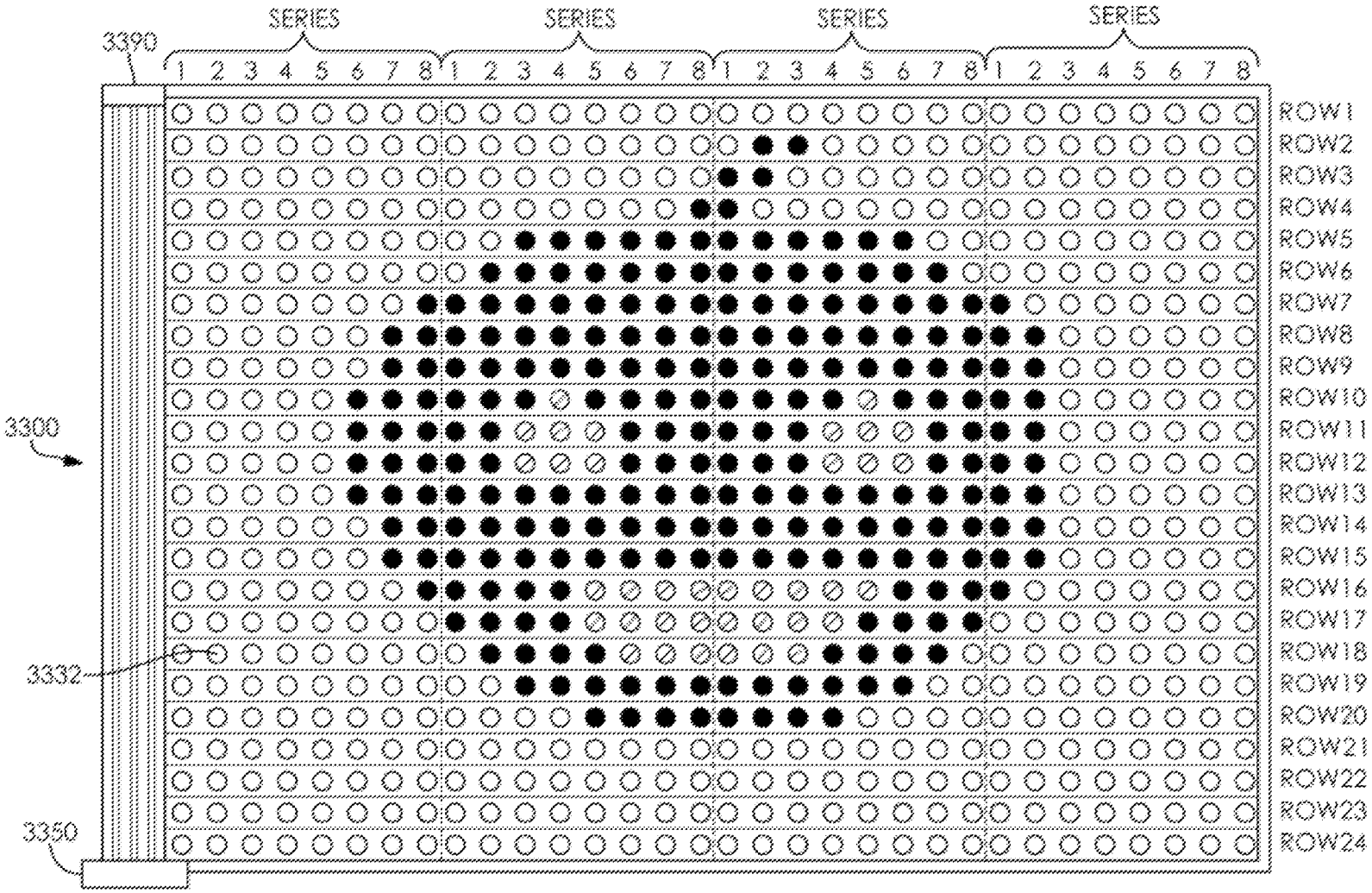
FIG. 33 is a schematic illustration of a flat rope light string system according to one embodiment of the present invention.

FIG. 33 illustrates another exemplary embodiment of the present invention. A system 3300 may be formed from any suitable exemplary embodiments described herein such as, for example, the exemplary embodiments described in FIGS. 5-9, 11-16, 27, 28, and/or 29. As illustrated in FIG. 33, system 3300 may include an electrical connector 3350 that may be a male connector similar to electrical connector 550 and electrical connector 750, and an electrical connector 3390 that may be a female electrical connector similar to electrical connector 1650. System 3300 may be a "mat" type configuration or grid including multiple exemplary disclosed flat ropes. System 3300 may include any desired number of rows and columns. For example, system 3300 may include any desired number of series (e.g., Series 1, 2, 3, and 4) of any desired length or configuration (e.g., such as described herein regarding FIGS. 5, 7-9, 12, 15, 28, and/or 29). System 3300 may also include "mat" type arrangements such as for example described herein regarding FIGS. 6, 11, 14, 16, and/or 27. For example, system 3300 may be formed from any desired combination of exemplary embodiments described for example herein. System 3300 may thereby form a grid of lighting elements 3332 similar to LED bulb housing 132. Any desired image, pattern, or shape may be displayed using the grid of lighting elements 3332. For example as illustrated in FIG. 33, system 3300 may display any desired shape, symbol, logo, or other design. For example, system 3300 may display a pumpkin including orange, green, black, or other suitable colors (e.g., Halloween decoration).

FIGS. 45A and 45B depict an exemplary lighting pattern of lighting elements 3332 for displaying the exemplary embodiment of system 3300 described above. As illustrated in the chart of FIGS. 45A and 45B, exemplary display colors are provided by row, series, and bulb.

In at least some exemplary embodiments, a single strand of LEDs may be extended in a straight-line method so that a variety of interconnected LED strings may form a mat, grid, or "mat"-like assembly that may display a desired design or figure (e.g., as illustrated in FIGS. 16 through 33). Each bulb in the "mat" may be identified by the exemplary disclosed system to provide a variety of designs for example as described above.

In at least some exemplary embodiments, the exemplary disclosed system may include a plurality of flat rope light strings, and a controller coupled to a power source at a first connection and at least one of the plurality of flat rope light strings at a second connection, said second connection including a plurality of connection leads, said second connection being polarized such that said plurality of flat rope light strings is capable of one connection orientation at said second connection, each of said plurality of flat rope light strings including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity. Said controller may have a switch with a plurality of switch positions including: a first switch position for providing electrical power at said second connection to said plurality of flat rope light strings by applying said first voltage polarity on a first connection lead, said first voltage polarity biasing said first light in each of said plurality of pairs of different colored lights within each of said plurality of lighting elements; a second switch position for providing electrical power at said second connection to said plurality of flat rope light strings by applying said second voltage polarity on said first connection lead, said second voltage polarity biasing said second light in each of said plurality of pairs of different colored lights within each of said plurality of lighting elements; a third switch position for providing electrical power at said second connection to said plurality of flat rope light strings by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of flat rope light strings by applying said second voltage polarity on said second connection lead, said second voltage polarity biasing said second light in each of said plurality of pairs of different colored lights within each of said plurality of lighting elements. Said plurality of lighting elements of said plurality of flat rope light strings form a grid. Said plurality of lighting elements of said plurality of flat rope light strings forming the grid includes a plurality of rows of flat rope strings, each of the plurality of rows of flat rope strings including a plurality of flat rope strings that are connected to each other. The plurality of rows of flat rope strings may include 24 rows, and each of the 24 rows includes four flat rope strings connected to each other, each of the four flat rope strings including eight lighting elements. The exemplary disclosed system may further include a voltage conversion module for converting a high voltage AC electric power source to a low voltage AC electric power source, and a rectifier for accepting an input electrical power source to provide an output DC electrical power to the at least one flat rope light string. The plurality of lighting elements of the grid may display a color pattern of a design selected from the group consisting of a holiday design, a sports team design, a sports team design, and a national flag. The plurality of lighting elements of the grid may display a color pattern of a design selected from the group consisting of a $4^{th}$ of July design including a star, a college flag, a football team flag, a Valentine's heart, a Christmas bell, a shamrock, an Italian flag, a Mexican flag, an Irish flag, a French flag, a Mardi Gras flag, and a Halloween pumpkin. Each of the plurality of flat rope light strings may be a rigid assembly including a bent portion. The plurality of rigid assemblies may include bent portions are connected together to form a decorative assembly shaped as a Christmas tree. Each of said plurality of flat rope light strings may include a plurality of plugs or sockets. Said plurality of flat rope light strings may be connected to each other via the plurality of plugs or sockets and form the grid.

In at least some exemplary embodiments, the exemplary disclosed system may include a plurality of flat rope light strings; and a controller coupled to a power source at a first connection and at least one of the plurality of flat rope light strings at a second connection, said second connection including three connection leads, said second connection being polarized such that said plurality of flat rope light strings is capable of only one connection orientation at said second connection, each of said plurality of flat rope light strings including a plurality of lighting elements, each of said lighting elements including three pairs of different colored lights, each of said three pairs including a first light and a second light, said first light of said light pair activated via a first voltage polarity and said second light of said light pair activated via a second voltage polarity. Said controller may have a switch with a plurality of switch positions including: a first switch position for providing electrical power at said second connection to said plurality of flat rope light strings by applying said first voltage polarity on a first connection lead, said first voltage polarity biasing said first light in each of said three pairs of different colored lights within each of said plurality of lighting elements; a second switch position for providing electrical power at said second connection to said plurality of flat rope light strings by applying said second voltage polarity on said first connection lead, said second voltage polarity biasing said second light in each of said three pairs of different colored lights within each of said plurality of lighting elements; a third switch position for providing electrical power at said second connection to said plurality of flat rope light strings by applying said first voltage polarity on a second connection lead, said first voltage polarity biasing said first light in each of said three pairs of different colored lights within each of said plurality of lighting elements; a fourth switch position for providing electrical power at said second connection to said plurality of flat rope light strings by applying said second voltage polarity on said second connection lead, said second voltage polarity biasing said second light in each of said three pairs of different colored lights within each of said plurality of lighting elements; a fifth switch position for providing electrical power at said second connection to said plurality of flat rope light strings by applying said first voltage polarity on a third connection lead, said first voltage polarity biasing said first light in each of said three pairs of different colored lights within each of said plurality of lighting elements; and a sixth switch position for providing electrical power at said second connection to said plurality of flat rope light strings by applying said second voltage polarity on said third connection lead, said second voltage polarity biasing said second light in each of said three pairs of different colored lights within each of said plurality of lighting elements. Said plurality of lighting elements of said plurality of flat rope light strings may form a mat; and said plurality of lighting elements of said plurality of flat rope light strings forming the mat may include a plurality of rows of flat rope strings. Each of the plurality of rows of flat rope strings may include a plurality of flat rope strings that are connected to each other. The plurality of lighting elements of the mat may display a color pattern of a design selected from the group consisting of a holiday design, a sports team design, a sports team design, and a national flag. The exemplary disclosed system may further include a seventh switch position for providing electrical power at said second connection to said plurality of flat rope light strings by simultaneously applying said second voltage polarity on said first, second and third connection leads, said second voltage polarity biasing said second light in each of said three pairs of different colored lights within each of said plurality of lighting elements; an eighth switch position for providing electrical power at said second connection to said plurality of flat rope light strings by applying said first voltage polarity on said first and third connection leads, said first voltage polarity biasing said first light in each of said three pairs of different colored lights within each of said plurality of lighting elements; a ninth switch position for providing electrical power at said second connection to said plurality of flat rope light strings applying said second voltage polarity on said first and third connection leads, said second voltage polarity biasing said second light in each of said three pairs of different colored lights within each of said plurality of lighting elements; a tenth switch position for providing electrical power at said second connection to said plurality of flat rope light strings by alternatingly applying said first voltage polarity on said first connection lead and said second voltage polarity on said third connection lead, said first voltage polarity biasing said first light in each of said of said three pairs of different colored lights within each of said plurality of lighting elements, and said second voltage polarity biasing said second light in each of said pairs of different colored lights within each of said plurality of lighting elements; and an eleventh switch position for providing electrical power at said second connection to said plurality of flat rope light strings by simultaneously applying: said second voltage polarity on said first and third connection leads, biasing said first light in each of said three pairs of different colored lights within each of said plurality of lighting elements, and said first voltage polarity on said second connection lead biasing said first light in each of said three pairs of different colored lights within each of said plurality of lighting elements; a twelfth switch position for providing electrical power at said second connection to said plurality of flat rope light strings by alternatingly applying: said first voltage polarity on said first connection lead, biasing said first light in each of said pairs of different colored lights within each of said plurality of lighting elements, said first voltage polarity on said second connection lead biasing said first light in each of said three pairs of different colored lights within each of said plurality of lighting elements, said second voltage polarity on said third connection lead, biasing said second light in each of said three pairs of different colored lights within each of said plurality of lighting elements, and said second voltage polarity on said second connection lead biasing said second light in each of said three pairs of different colored lights within each of said plurality of lighting elements. The exemplary disclosed system may further include a voltage conversion module for converting a high voltage AC electric power source to a low voltage AC electric power source; and a rectifier for accepting an input electrical power source to provide an output DC electrical power to the at least one flat rope light string.

In at least some exemplary embodiments, the exemplary disclosed system may include a plurality of flat rope light strings; and a controller coupled to a power source at a first connection and a plurality of flat rope light strings at a second connection, said second connection including at least two connection leads, said second connection being polarized such that said plurality of flat rope light strings is capable of only one connection orientation at said second connection, each of said plurality of flat rope light strings including a plurality of lighting elements, each of said plurality of lighting elements including one or more electrically coupled pairs of different colored lights, each of said one or more electrically coupled pairs including a first light activated via a first voltage polarity and a second light activated via a second voltage polarity. Said controller may have a switch with a plurality of switch positions including: a first switch position for providing electrical power at said second connection to said plurality of flat rope light strings by applying said first voltage polarity on a first connection lead, said first voltage polarity biasing said first light in each of said two electrically coupled pairs of different colored lights within each of said plurality of lighting elements; a second switch position for providing electrical power at said second connection to said plurality of flat rope light strings by applying said second voltage polarity on said first connection lead, said first voltage polarity biasing said first light in each of said two electrically coupled pairs of different colored lights within each of said pairs of different colored lights within each of said plurality of lighting elements; a third switch position for providing electrical power at said second connection to said plurality of flat rope light strings by applying said first voltage polarity on a second connection lead, said first voltage polarity biasing said first light in each of said two electrically coupled pairs of different colored lights within each of said plurality of lighting elements; and a fourth switch position for providing electrical power at said second connection to said plurality of flat rope light strings by applying said first voltage polarity on said second connection lead, said first voltage polarity biasing said first light in each of said two electrically coupled pairs of different colored lights within each of said plurality of lighting elements. Said plurality of lighting elements of said plurality of flat rope light strings form a grid that includes a plurality of rows of flat rope strings, each of the plurality of rows of flat rope strings including a plurality of flat rope strings that are connected to each other. The plurality of rows of flat rope strings may include 24 rows, and each of the 24 rows includes four flat rope strings connected to each other, each of the four flat rope strings including eight lighting elements. Said plurality of different colored lights may be multicolored LEDs and said lighting element is a bulb containing said multicolored LEDs. The exemplary disclosed system may further include a fifth switch position for providing electrical power at said second connection to said plurality of flat rope light string by alternatingly applying: said first voltage polarity on said first connection lead, said first voltage polarity biasing said first light in each of said two electrically coupled pairs of different colored lights within each of said plurality of lighting elements; said second voltage polarity on said first connection lead, said second voltage polarity biasing said second light in each of said two electrically coupled pairs of different colored lights within each of said plurality of lighting elements; and a sixth switch position for providing electrical power at said second connection to said plurality of flat rope light string by alternatingly applying: said second voltage polarity on said third connection lead, said first voltage polarity biasing said first light in each of said two electrically coupled pairs of different colored lights within each of said plurality of lighting elements; and said second voltage polarity on said third connection lead said first voltage polarity biasing said first light in each of said two electrically coupled pairs of different colored lights within each of said plurality of lighting elements. The exemplary disclosed system may further include a voltage conversion module for converting a high voltage AC electric power source to a low voltage AC electric power source, and a rectifier for accepting an input electrical power source to provide an output DC electrical power to the at least one flat rope light string.

FIGS. 46 through 54B illustrate additional exemplary embodiments of the exemplary disclosed system, apparatus, and method, which may provide flexibility in the display of light patterns (e.g., flexible control of multi-color rope lighting). In at least some exemplary embodiments, flexibility may be allowed by providing controllers (e.g., individual added light string controllers) that may respond to transmitted signals transferred to the individual added controllers for example as described below. For example, a master (e.g., primary) controller may provide multi-color flat rope leads with current direction and therefore planned display patterns, while also allowing independent operation of selected light strings. For example, selected light strings may either follow a primary set of signals or may vary from those signals by changing their output currents as directed by a transmitter that may address the primary controller and each of a plurality of added controllers.

Figure 46:
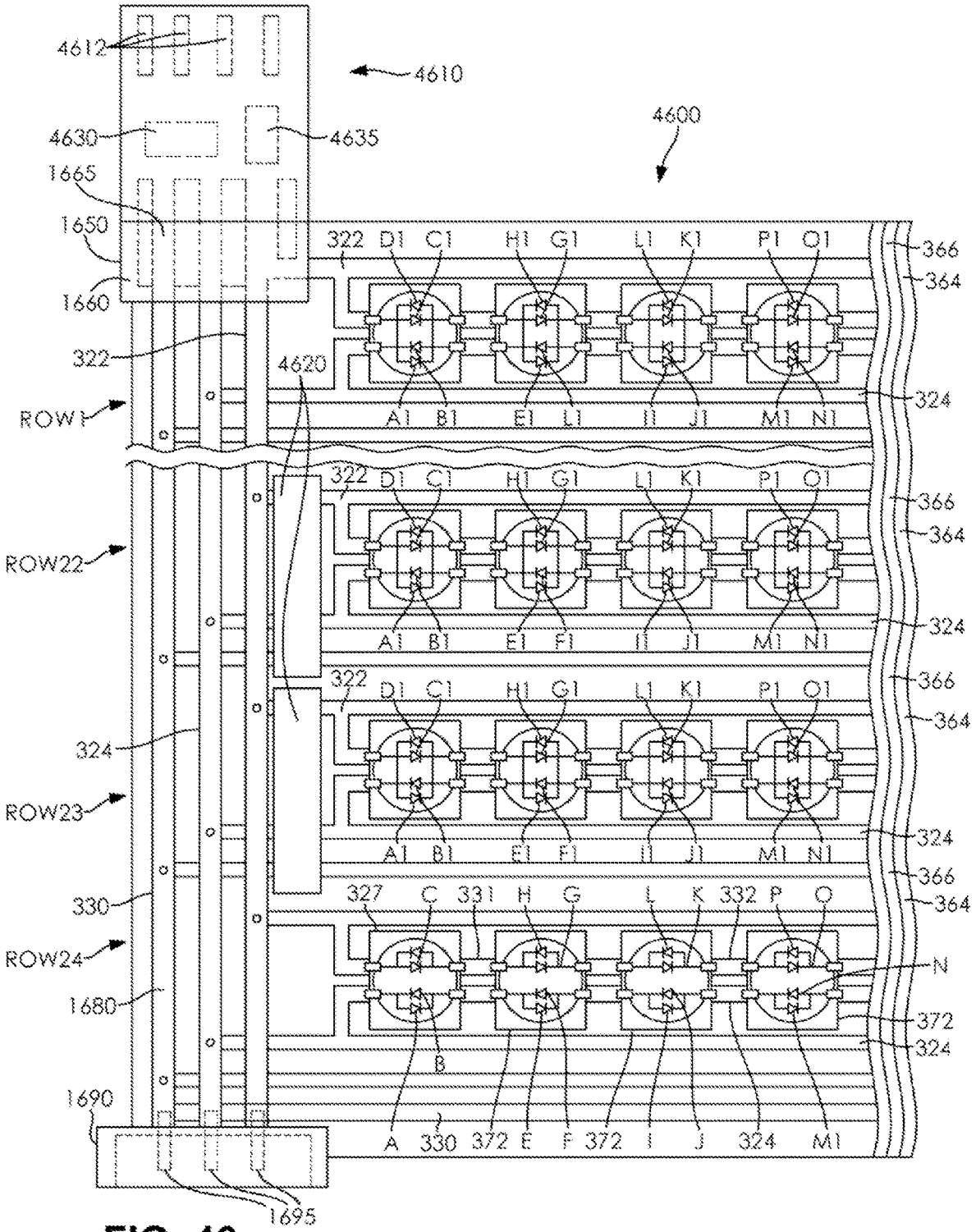
FIG. 46 depicts a top down partial cut-away view of a plurality of interconnected LED bulb housings of a flat rope light string system according to one embodiment of the present invention.

FIG. 46 illustrates another exemplary embodiment of the present invention. A system 4600 may include components similar to as described above regarding FIG. 16. System 4600 may also include a control assembly 4610 and a plurality of remote controllers 4620. Control assembly 4610 and the plurality of remote controllers 4620 may operate together to control system 4600.

Control assembly 4610 may include a control adapter box and a plurality of connectors 4612. Control assembly 4610 may include a primary controller 4630 and a communication device 4635. Primary controller 4630 may be generally similar to the exemplary disclosed controllers described herein such as, for example, controller 126. Communication device 4635 may be any suitable communication device for transmitting and/or receiving data and signals such as, for example, a transmitter, a receiver, or a transceiver. For example, communication device 4635 may serve as a remote receiver. Primary controller 4630 and communication device 4635 may be integrally formed in a single control assembly 4610. Primary controller 4630 and/or communication device 4635 may also be separate components.

Remote controllers 4620 may be built-on controls (e.g., built on the exemplary disclosed light strings) that may include remote receivers that may communicate with and/or receive data and/or signals from communication device 4635. As illustrated in FIG. 46, remote controllers 4620 may be added to a plurality (e.g., two) of the exemplary disclosed lighting assemblies (e.g., multi-color flat rope light strings) of a multi-string layout. Remote controllers 4620 may be individual added controllers that may be built on the exemplary disclosed flat rope behind (e.g., just behind) the exemplary disclosed connectors (e.g., electrical connector 1680). For example, remote controllers 4620 may be mounted on the exemplary disclosed lighting assemblies (e.g., multi-color flat rope). Any suitable number of remote controllers 4620 and lighting assemblies (e.g., multi-color flat rope) may be provided. For example, the number of similar strings (e.g., including remote controllers 4620) may be a few or may be many for example based on a desired number of displays to be provided.

Remote controllers 4620 may respond to signals transmitted by communication device 4635 that may address (e.g., individually address) each remote controller 4620. Control assembly 4610 (e.g., primary controller 4630) may provide system 460) (e.g., substantially all multi-color flat rope leads) with the current direction and thereby the planned display patterns, while also controlling individual remote controllers 4620 (e.g., via communication device 4635). Primary controller 4630 may thereby allow selected light strings to either follow a primary set of signals or vary from those signals by changing their output currents as directed by communication device 4635 (e.g., via signals transferred by communication device 4635 to respective remote controllers 4620). The signals provided by communication device 4635 may for example address primary controller 4630 and/or each, some, or all remote controllers 4620.

Figure 47:
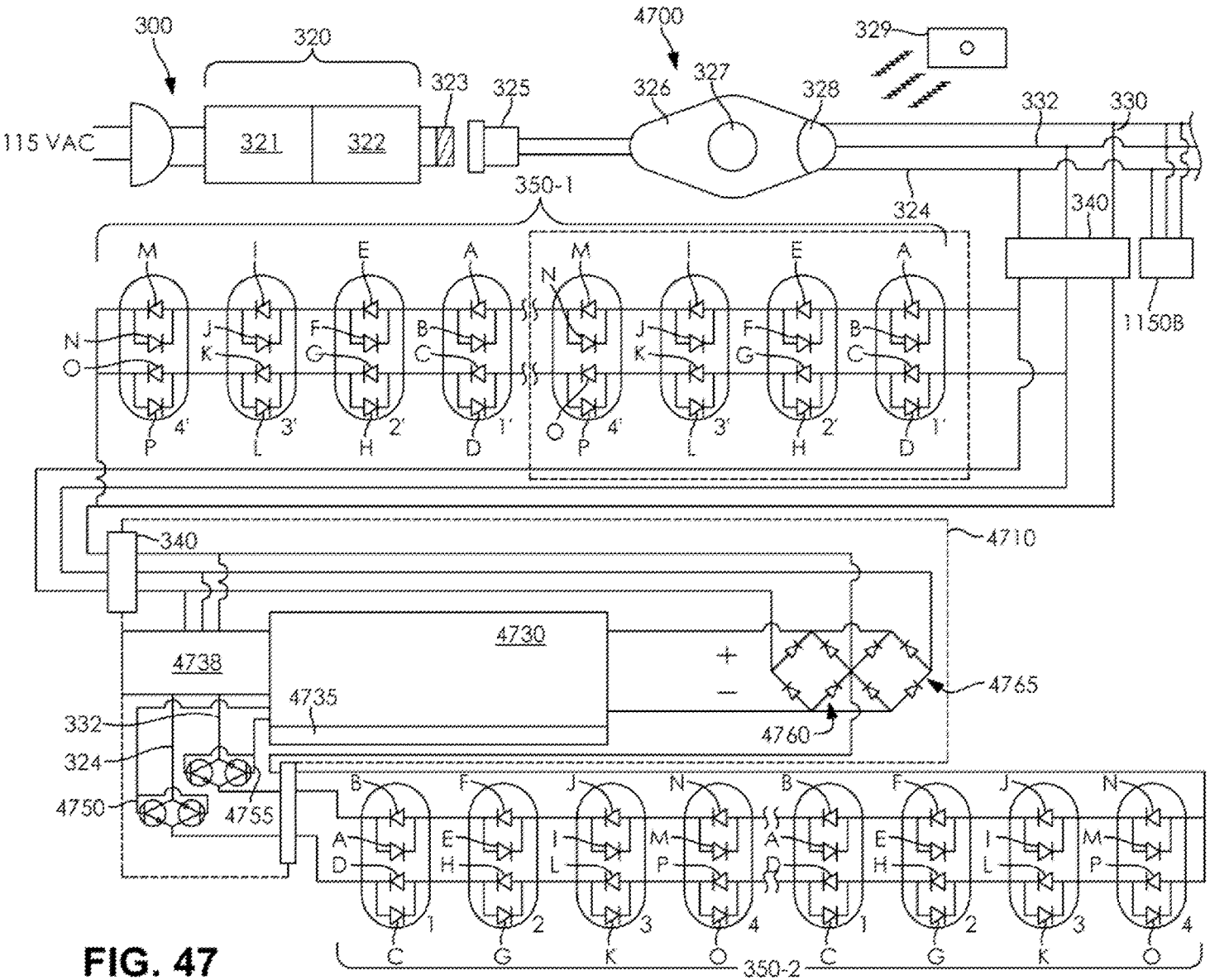
FIG. 47 depicts a circuit diagram of a flat rope light string system according to one embodiment of the present invention.

FIG. 47 illustrates another exemplary embodiment of the present invention. A system 4700 may include components similar to as described above regarding FIG. 11B. An adapter box 4710 may be disposed at a connection of the connector of the exemplary disclosed lighting assembly (e.g., a light string) to the exemplary disclosed incoming primary power source. Adapter box 4710 may include components similar to control assembly 4610 and/or remote controller 4620. For example, adapter box 4710 may include a controller 4730 (e.g., a control section) that may be similar to primary controller 4630 or remote controller 4620, and a receiver 4735 (e.g., receiver section) and a signal sensing section 4738 that may include components similar to components of communication device 4635. Adapter box 4710 may for example include control components interconnected with receiver components.

FIG. 47 illustrates an exemplary partial circuit layout disposed within a remotely controlled adapter controller (e.g., adapter box 4710). In at least some exemplary embodiments, the circuit layout may be similar (e.g., the same) for the exemplary disclosed controller located on the multi-color rope light string (e.g., as described above regarding FIG. 46). System 4700 (e.g., adapter box 4710) may also include a plurality of output devices (e.g., output device 4750 and output device 4755). Output devices 4750 and 4755 may for example form an output section. Output devices 4750 and 4755 may be output semiconductors. System 4700 (e.g., adapter box 4710) may also include a plurality of bridges (e.g., wave square bridges) such as bridge 4760 and bridge 4765. Bridges 4760 and 4765 may form a power section of system 4700 (e.g., of adapter box 4710). Incoming current on the exemplary disclosed signal leads may be converted to DC by bridges 4760 and 4765 (e.g., square wave bridges). Output devices 4750 and 4755 may be electrically connected to bridges 4760 and 4765 via electrical connectors 324 and 332. Bridge 4760 may be a full wave bridge connected to electrical connector 324 and output device 4750. Bridge 4765 may be a full wave bridge connected to electrical connector 332 and output device 4755. For example, there may be one bridge for each signal lead and the common lead. For example, a 1-, 2-, 3- or more signal lead multi-color flat rope assembly may have a matching number of bridges (e.g., bridges 4760 and 4765 such as square wave bridges). Accordingly for example, some or substantially all incoming current may be converted to DC power to power the exemplary disclosed remote controller (e.g., of adapter box 4710). Controller 4730 may determine the output signal that may be transferred or transmitted to output devices 4750 and 4755. The outputs may for example be the same as that of the incoming currents as determined by signal sensing section 4738 of adapter box 4710 (e.g., which may be a remote-controlled, adapter controller). The outputs may be provided (e.g., determined) by biasing output devices 4750 and 4755 (e.g., output semiconductors) to match the incoming signals or to be varied to form a different set of output signals (e.g., and thereby different displays).

Figure 48:
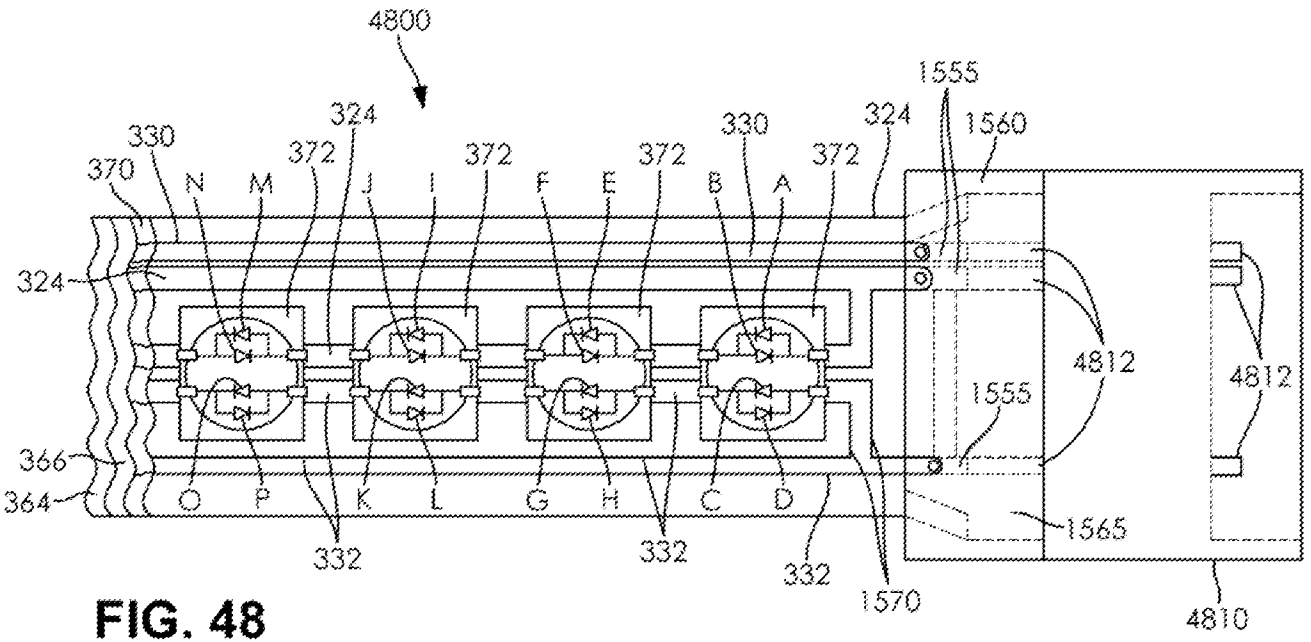
FIG. 48 depicts a top down partial cut-away view of a plurality of interconnected LED bulb housings of a flat rope light string system according to one embodiment of the present invention.

FIG. 48 illustrates another exemplary embodiment of the present invention. A system 4800 may include components similar to as described above regarding FIG. 15. System 4800 may also include components similar to system 4700. System 4800 may include an adapter box 4810 that may be similar to adapter box 4710. For example, adapter box 4810 may be a control-interconnect adapter box including similar components as adapter box 4710. Adapter box 4810 may include controls including a remote receiver for example as described above regarding FIGS. 46 and 47. Adapter box 4810 may be connected to the exemplary disclosed lighting assembly via a plurality of electrical connectors 4812.

Adapter box 4810 may include one or more individual added controllers (e.g., similar to remote controller 4620 and/or the exemplary disclosed components of adapter box 4710) that may be disposed at a connection of a connector of the exemplary disclosed lighting assembly (e.g., light string as described above in FIG. 15) to an incoming primary power source as illustrated in FIG. 48. As illustrated in FIG. 48, adapter box 4810 may be an adapter-type controller that may plug into a lighting assembly (e.g., a multi-color flat rope light string) between primary signal leads connector and into the exemplary disclosed multi-color flat rope light string. Adapter boxes 4810 (e.g., adapter-type controllers) may be disposed in any suitable locations (e.g., a number of suitable locations) of a large display (e.g., to control an operation of system 4800 similarly to as described above regarding FIGS. 46 and 47).

Figure 49:
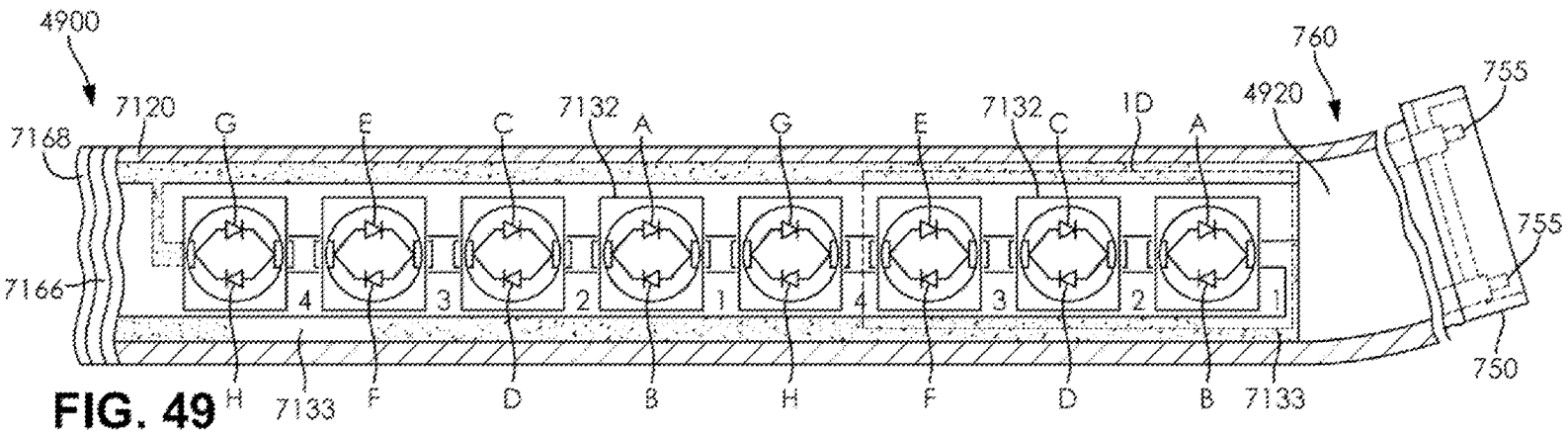
FIG. 49 depicts a top down partial cut-away view of a plurality of interconnected LED bulb housings comprising a portion of a flat rope light string system, according to an embodiment of the present invention.
Figure 50:
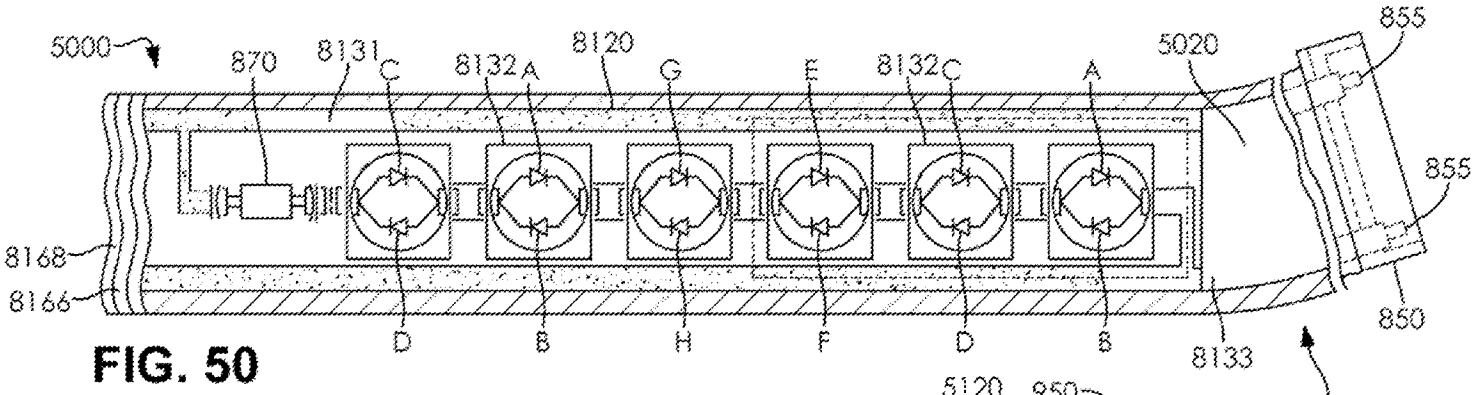
FIG. 50 depicts a top down partial cut-away view of a plurality of interconnected LED bulb housings comprising a portion of a flat rope light string system, according to an embodiment of the present invention.
Figure 51:
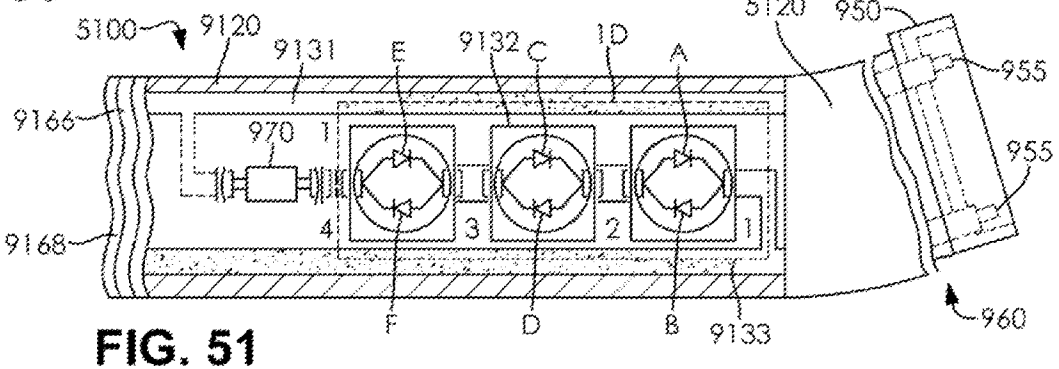
FIG. 51 depicts a top down partial cut-away view of a plurality of interconnected LED bulb housings comprising a portion of a flat rope light string system, according to an embodiment of the present invention.

FIGS. 49, 50, and 51 illustrate another exemplary embodiment of the present invention. A system 4900 may include components similar to as described above regarding FIG. 7, a system 5000 may include components similar to as described above regarding FIG. 8, and a system 5100 may include components similar to as described above regarding FIG. 9. Systems 4900, 5000, and 5100 may also include components similar to system 4600.

System 4900 may include a remote controller 4920 that may be similar to remote controller 4620. System 5000 may include a remote controller 5020 that may be similar to remote controller 4620. System 5100 may include a remote controller 5120 that may be similar to remote controller 4620. Remote controllers 4920, 5020, and 5120 may be built-on controls having a receiver. For example as illustrated in FIGS. 49, 50, and 51, remote controllers 4920, 5020, and 5120 may be disposed (e.g., added) on the surface of the exemplary disclosed lighting assemblies (e.g., multi-color flat rope light strings). For example as illustrated in FIGS. 49, 50, and 51, remote controllers 4920, 5020, and 5120 may be built on the flat rope behind (e.g., just behind) the exemplary disclosed connector.

Figure 52:
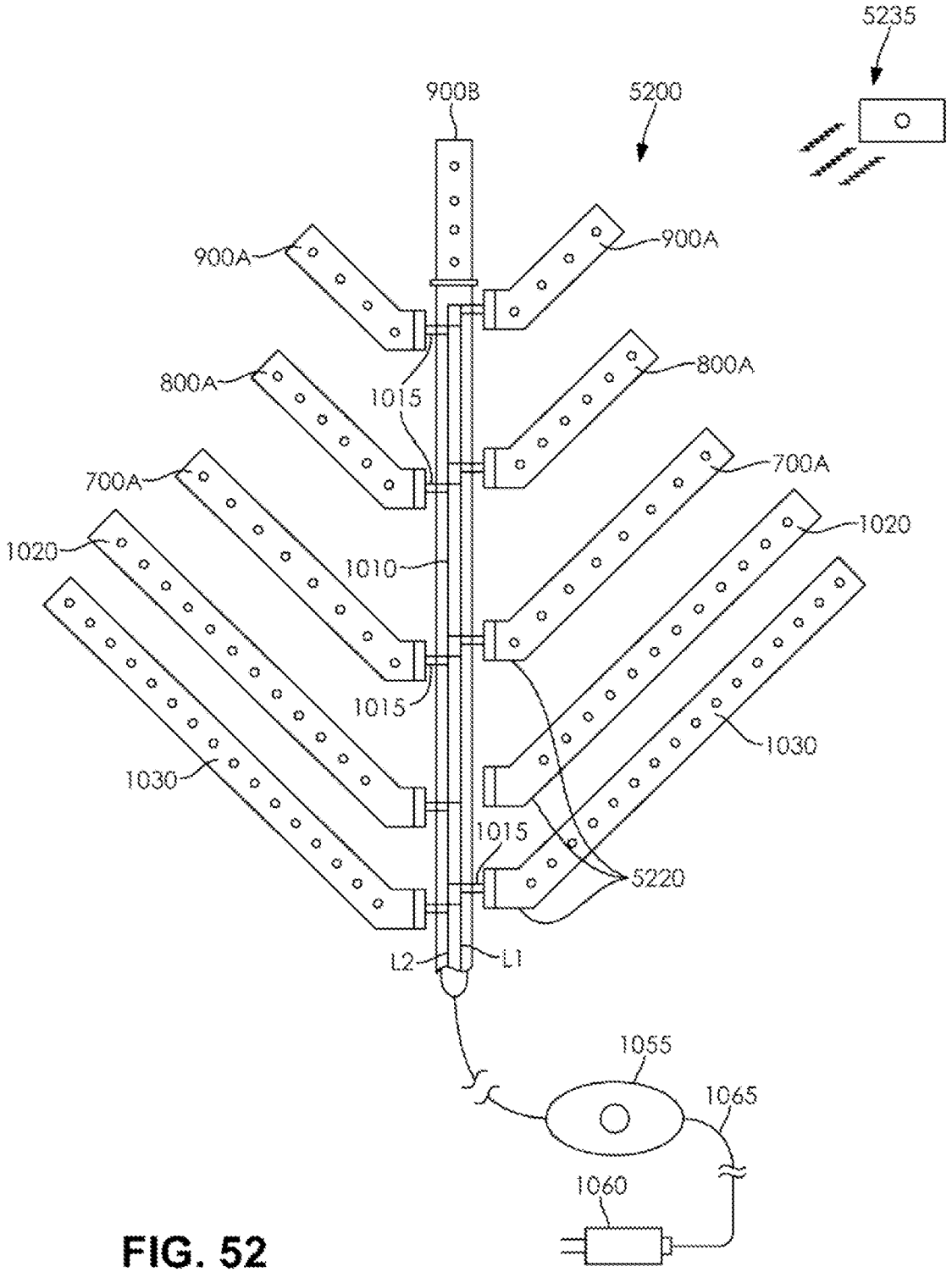
FIG. 52 is a schematic illustration of a light system according to one embodiment of the present invention.

FIG. 52 illustrates another exemplary embodiment of the present invention. A system 5200 may include components similar to as described above regarding FIG. 10. System 5200 may also include components similar to systems 4900, 5000, and 5100. For example, system 5200 may include a plurality of remote controllers 5220 that may be similar to remote controllers 4920, 5020, and 5120. Remote controllers 5220 may be built-on controls with receivers.

System 5200 may also include a communication device 5235 that may be similar to communication device 4635. Communication device 5235 may be for example a multi-addressable transmitter that may communicate with (e.g., and separately address) remote controllers 5220 and electrical component 1055 that may be a primary control (e.g., a master receiver control). Electrical component 1055 may be a controller similar to primary controller 4630.

As illustrated in FIG. 52, system 5200 may include a plurality of tree-shaped (e.g., tree branch-shaped) multi-color flat ropes such as systems 1020 and 1030. Electrical component 1055 may be a primary controller that may determine a lighting display of the exemplary disclosed multi-color flat ropes (e.g., individual branch displays). Each exemplary disclosed branch display (e.g., system 1020 or 1030) may have a display controlled by electrical component 1055 and/or a respective remote controller 5220 (e.g., which may add to the display options). For example as illustrated in FIG. 52, remote controllers 5220 (e.g., individual added controllers) may be disposed (e.g., built on) the flat rope (e.g., systems 1020 and 1030) behind (e.g., just behind) the connector.

Figure 53:
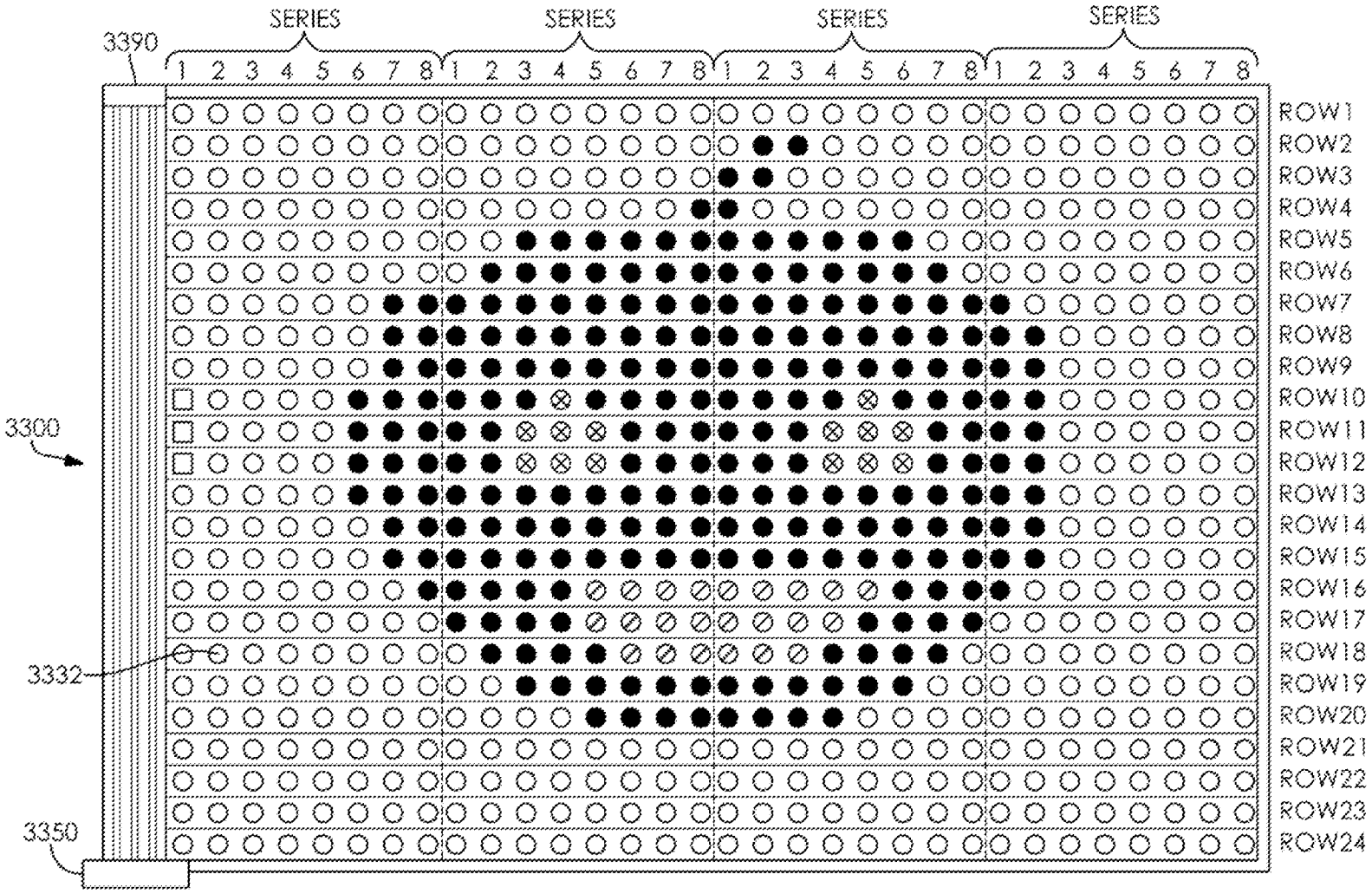
FIG. 53 is a schematic illustration of a flat rope light string system according to one embodiment of the present invention.

FIGS. 53, 54A, and 54B illustrate an exemplary operation of the exemplary systems of FIGS. 46 through 52. The exemplary disclosed systems (e.g., systems 4600, 4700, 4800, 5000, 5100, and 5200) may operate to expand display operations of the exemplary disclosed embodiments. For example, the exemplary disclosed systems may operate to allow flashing configurations and other suitable variations to the exemplary disclosed displays.

As illustrated in FIG. 53, a display pattern of a Halloween pattern (e.g., similar to as described above regarding FIG. 33) may include exemplary controllers of systems 4600, 4700, 4800, 4900, 5000, 5100, and 5200 (e.g., adapter remote controllers) added to lighting assemblies of rows 10, 11, and 12. The exemplary disclosed remote controllers (e.g., of systems 4600, 4700, 4800, 4900, 5000, 5100, and 5200) may allow for select lighting elements (e.g., the pumpkin's eyes) to be controlled to flash when desired (e.g., using the exemplary disclosed circuit configuration when controlled by their respective remote controllers for example as described above). FIGS. 54A and 54B, which may be similar to FIGS. 45A and 45B, illustrate the appropriate rows, series, and bulbs (e.g., noted with the illustrated arrows) for the display elements (e.g., of the eyes of the pumpkin) that may be controlled to flash when selected by the exemplary disclosed remote controllers (e.g., row adapter controls).

In at least some exemplary embodiments, the exemplary disclosed remote-controllable controllers (e.g., remote controllers 4620 as well as the other exemplary disclosed remote controllers) may be controlled by a same remote control transmitter (e.g., communication device 4630 as well as the other exemplary disclosed transmitters) that may address each remote controller (e.g., including a remote receiver) individually. The exemplary disclosed remote controllers may allow the signals of the exemplary primary controllers (e.g., primary controller 4630 as well as the other exemplary disclosed primary controllers) to be passed on to the exemplary disclosed lighting assemblies (e.g., rope light strings) or to be changed or varied by respective exemplary disclosed remote controllers.

In at least some exemplary embodiments, the exemplary lighting system may include a plurality of lighting assemblies; a first controller coupled to a power source at a first connection and at least one of the plurality of lighting assemblies at a second connection, each of said plurality of lighting assemblies including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions including: a first switch position for providing electrical power at said second connection to said plurality of lighting assemblies by applying said first voltage polarity on a first connection lead, said first voltage polarity biasing said first light in each of said plurality of pairs of different colored lights within each of said plurality of lighting elements; a second switch position for providing electrical power at said second connection to said plurality of lighting assemblies by applying said second voltage polarity on said first connection lead, said second voltage polarity biasing said second light in each of said plurality of pairs of different colored lights within each of said plurality of lighting elements: a third switch position for providing electrical power at said second connection to said plurality of lighting assemblies by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of lighting assemblies by applying said second voltage polarity on said second connection lead, said second voltage polarity biasing said second light in each of said plurality of pairs of different colored lights within each of said plurality of lighting elements; a second controller coupled to one of the plurality of lighting assemblies; and a communication device configured to communicate with the first controller and the second controller. The one of the plurality of lighting assemblies may be controlled by a signal transferred by the first controller via the second connection. The one of the plurality of lighting assemblies may be controlled by a varied signal that is based on the second controller varying a signal transferred by the first controller. The one of the plurality of lighting assemblies may be controlled by either a signal transferred by the first controller via the second connection or a varied signal that is based on the second controller varying the signal transferred by the first controller. The second controller may vary the signal transferred by the first controller based on a signal or data transferred by the communication device. Said plurality of lighting elements of said plurality of lighting assemblies may form a grid. Said plurality of lighting assemblies may be a plurality of flat rope light strings. The communication device may be a transmitter and the second controller includes a receiver configured to receive signals or data from the transmitter. Said second connection may be polarized such that said plurality of lighting assemblies is capable of one connection orientation at said second connection. The exemplary disclosed lighting system may also include a voltage conversion module for converting a high voltage AC electric power source to a low voltage AC electric power source, and a rectifier for accepting an input electrical power source to provide an output DC electrical power to the at least one of the plurality of lighting assemblies. Each of the plurality of lighting assemblies may be a rigid assembly including a bent portion.

In at least some exemplary embodiments, the exemplary lighting system may include a plurality of lighting assemblies; a first controller coupled to a power source at a first connection and at least one of the plurality of lighting assemblies at a second connection, each of said plurality of lighting assemblies including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions including: a first switch position for providing electrical power at said second connection to said plurality of lighting assemblies by applying said first voltage polarity on a first connection lead, said first voltage polarity biasing said first light in each of said plurality of pairs of different colored lights within each of said plurality of lighting elements; a second switch position for providing electrical power at said second connection to said plurality of lighting assemblies by applying said second voltage polarity on said first connection lead, said second voltage polarity biasing said second light in each of said plurality of pairs of different colored lights within each of said plurality of lighting elements; a third switch position for providing electrical power at said second connection to said plurality of lighting assemblies by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of lighting assemblies by applying said second voltage polarity on said second connection lead, said second voltage polarity biasing said second light in each of said plurality of pairs of different colored lights within each of said plurality of lighting elements; a second controller coupled to a first one of the plurality of lighting assemblies; a third controller coupled to a second one of the plurality of lighting assemblies; and a communication device configured to communicate with the first controller, the second controller, and the third controller. The first one and the second one of the plurality of lighting assemblies may be controlled by either a signal transferred by the first controller via the second connection or a varied signal that is based on the second controller or the third controller varying the signal transferred by the first controller. The second controller or the third controller may vary the signal transferred by the first controller based on a signal or data transferred by the communication device. Said plurality of lighting assemblies may be a plurality of flat rope light strings. Each of the plurality of lighting assemblies may be a rigid assembly including a bent portion. The plurality of rigid assemblies including bent portions may be connected together to form a decorative assembly shaped as a Christmas tree.

In at least some exemplary embodiments, the exemplary lighting system may include a plurality of flat rope light strings; a first controller coupled to a power source at a first connection and at least one of the plurality of flat rope light strings at a second connection, each of said plurality of flat rope light strings including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions including: a first switch position for providing electrical power at said second connection to said plurality of flat rope light strings by applying said first voltage polarity on a first connection lead, said first voltage polarity biasing said first light in each of said plurality of pairs of different colored lights within each of said plurality of lighting elements; a second switch position for providing electrical power at said second connection to said plurality of flat rope light strings by applying said second voltage polarity on said first connection lead, said second voltage polarity biasing said second light in each of said plurality of pairs of different colored lights within each of said plurality of lighting elements; a third switch position for providing electrical power at said second connection to said plurality of flat rope light strings by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of flat rope light strings by applying said second voltage polarity on said second connection lead, said second voltage polarity biasing said second light in each of said plurality of pairs of different colored lights within each of said plurality of lighting elements; a second controller coupled to one of the plurality of flat rope light strings; and a communication device configured to communicate with the first controller and the second controller. The one of the plurality of flat rope light strings may be controlled by either a signal transferred by the first controller via the second connection or a varied signal that is based on the second controller varying the signal transferred by the first controller. Said plurality of lighting elements of said plurality of flat rope light strings may form a grid. The communication device may be a transmitter and the second controller may include a receiver configured to receive signals or data from the transmitter.

While multiple embodiments are disclosed, still other embodiments of the present disclosure will become apparent to those skilled in the art from this detailed description. There may be aspects of this disclosure that may be practiced without the implementation of some features as they are described. It should be understood that some details have not been described in detail in order to not unnecessarily obscure the focus of the disclosure. The disclosure is capable of myriad modifications in various obvious aspects, all without departing from the spirit and scope of the present disclosure. Accordingly, the drawings and descriptions are to be regarded as illustrative rather than restrictive in nature.

What is claimed is:

1. A lighting system, comprising:

a plurality of lighting assemblies;

a first controller coupled to a power source at a first connection and at least one of the plurality of lighting assemblies at a second connection, each of said plurality of lighting assemblies including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions including:

a first switch position for providing electrical power at said second connection to said plurality of lighting assemblies by applying said first voltage polarity on a first connection lead, said first voltage polarity biasing said first light in each of said plurality of pairs of different colored lights within each of said plurality of lighting elements;

a second switch position for providing electrical power at said second connection to said plurality of lighting assemblies by applying said second voltage polarity on said first connection lead, said second voltage polarity biasing said second light in each of said plurality of pairs of different colored lights within each of said plurality of lighting elements;

a third switch position for providing electrical power at said second connection to said plurality of lighting assemblies by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of lighting assemblies by applying said second voltage polarity on said second connection lead, said second voltage polarity biasing said second light in each of said plurality of pairs of different colored lights within each of said plurality of lighting elements;

a second controller coupled to one of the plurality of lighting assemblies; and a communication device configured to communicate with the first controller and the second controller.

2. The lighting system of claim 1, wherein the one of the plurality of lighting assemblies is controlled by a signal transferred by the first controller via the second connection.

3. The lighting system of claim 1, wherein the one of the plurality of lighting assemblies is controlled by a varied signal that is based on the second controller varying a signal transferred by the first controller.

4. The lighting system of claim 1, wherein the one of the plurality of lighting assemblies is controlled by either a signal transferred by the first controller via the second connection or a varied signal that is based on the second controller varying the signal transferred by the first controller.

5. The lighting system of claim 4, wherein the second controller varies the signal transferred by the first controller based on a signal or data transferred by the communication device.

6. The lighting system of claim 1, wherein said plurality of lighting elements of said plurality of lighting assemblies form a grid.

7. The lighting system of claim 1, wherein said plurality of lighting assemblies is a plurality of flat rope light strings.

8. The lighting system of claim 1, wherein the communication device is a transmitter and the second controller includes a receiver configured to receive signals or data from the transmitter.

9. The lighting system of claim 1, wherein said second connection is polarized such that said plurality of lighting assemblies is capable of one connection orientation at said second connection.

10. The lighting system of claim 1, further comprising:

a voltage conversion module for converting a high voltage AC electric power source to a low voltage AC electric power source; and a rectifier for accepting an input electrical power source to provide an output DC electrical power to the at least one of the plurality of lighting assemblies.

11. The lighting system of claim 1, wherein each of the plurality of lighting assemblies is a rigid assembly including a bent portion.

12. A lighting system, comprising:

a plurality of lighting assemblies;

a first controller coupled to a power source at a first connection and at least one of the plurality of lighting assemblies at a second connection, each of said plurality of lighting assemblies including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions including:

a first switch position for providing electrical power at said second connection to said plurality of lighting assemblies by applying said first voltage polarity on a first connection lead, said first voltage polarity biasing said first light in each of said plurality of pairs of different colored lights within each of said plurality of lighting elements;

a second switch position for providing electrical power at said second connection to said plurality of lighting assemblies by applying said second voltage polarity on said first connection lead, said second voltage polarity biasing said second light in each of said plurality of pairs of different colored lights within each of said plurality of lighting elements;

a third switch position for providing electrical power at said second connection to said plurality of lighting assemblies by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of lighting assemblies by applying said second voltage polarity on said second connection lead, said second voltage polarity biasing said second light in each of said plurality of pairs of different colored lights within each of said plurality of lighting elements;

a second controller coupled to a first one of the plurality of lighting assemblies;

a third controller coupled to a second one of the plurality of lighting assemblies; and a communication device configured to communicate with the first controller, the second controller, and the third controller.

13. The lighting system of claim 12, wherein the first one and the second one of the plurality of lighting assemblies are controlled by either a signal transferred by the first controller via the second connection or a varied signal that is based on the second controller or the third controller varying the signal transferred by the first controller.

14. The lighting system of claim 13, wherein the second controller or the third controller varies the signal transferred by the first controller based on a signal or data transferred by the communication device.

15. The lighting system of claim 12, wherein said plurality of lighting assemblies is a plurality of flat rope light strings.

16. The lighting system of claim 12, wherein each of the plurality of lighting assemblies is a rigid assembly including a bent portion.

17. The lighting system of claim 16, wherein the plurality of rigid assemblies including bent portions are connected together to form a decorative assembly shaped as a Christmas tree.

18. A lighting system, comprising:

a plurality of flat rope light strings;

a first controller coupled to a power source at a first connection and at least one of the plurality of flat rope light strings at a second connection, each of said plurality of flat rope light strings including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said first controller having a switch with a plurality of switch positions including:

a first switch position for providing electrical power at said second connection to said plurality of flat rope light strings by applying said first voltage polarity on a first connection lead, said first voltage polarity biasing said first light in each of said plurality of pairs of different colored lights within each of said plurality of lighting elements;

a second switch position for providing electrical power at said second connection to said plurality of flat rope light strings by applying said second voltage polarity on said first connection lead, said second voltage polarity biasing said second light in each of said plurality of pairs of different colored lights within each of said plurality of lighting elements;

a third switch position for providing electrical power at said second connection to said plurality of flat rope light strings by applying said first voltage polarity on a second connection lead, said first voltage polarity biasing said first light in each of said plurality of pairs of different colored lights within each of said plurality of lighting elements; and a fourth switch position for providing electrical power at said second connection to said plurality of flat rope light strings by applying said second voltage polarity on said second connection lead, said second voltage polarity biasing said second light in each of said plurality of pairs of different colored lights within each of said plurality of lighting elements;

a second controller coupled to one of the plurality of flat rope light strings; and a communication device configured to communicate with the first controller and the second controller;

wherein the one of the plurality of flat rope light strings is controlled by either a signal transferred by the first controller via the second connection or a varied signal that is based on the second controller varying the signal transferred by the first controller.

19. The lighting system of claim 18, wherein said plurality of lighting elements of said plurality of flat rope light strings form a grid.

20. The lighting system of claim 18, wherein the communication device is a transmitter and the second controller includes a receiver configured to receive signals or data from the transmitter.

* * * * *